US010971129B2

(12) United States Patent
Yamazoe et al.

(10) Patent No.: US 10,971,129 B2
(45) Date of Patent: Apr. 6, 2021

(54) SOUNDPROOF STRUCTURE, LOUVER, AND SOUNDPROOF WALL

(71) Applicant: FUJIFILM Corporation, Tokyo (JP)

(72) Inventors: Shogo Yamazoe, Ashigara-kami-gun (JP); Shinya Hakuta, Ashigara-kami-gun (JP); Masayuki Naya, Ashigara-kami-gun (JP); Tadashi Kasamatsu, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 576 days.

(21) Appl. No.: 15/848,680

(22) Filed: Dec. 20, 2017

(65) Prior Publication Data

US 2018/0114517 A1 Apr. 26, 2018

Related U.S. Application Data

(63) Continuation of application No. PCT/JP2016/074427, filed on Aug. 22, 2016.

(30) Foreign Application Priority Data

Aug. 20, 2015 (JP) ..... JP2015-163227
Jan. 26, 2016 (JP) ..... JP2016-012625
Apr. 28, 2016 (JP) ..... JP2016-090743

(51) Int. Cl.
*G10K 11/175* (2006.01)
*E04B 1/84* (2006.01)
(Continued)

(52) U.S. Cl.
CPC ..... *G10K 11/175* (2013.01); *E04B 1/84* (2013.01); *E04B 1/994* (2013.01); *G10K 11/172* (2013.01); *E04B 2001/848* (2013.01)

(58) Field of Classification Search
CPC ..... E04B 1/84; E04B 1/994; E04B 2001/848; G10K 11/172; G10K 11/175
(Continued)

(56) References Cited

U.S. PATENT DOCUMENTS 6,609,592 B2 * 8/2003 Wilson ..... B32B 3/20 181/292
7,395,898 B2 7/2008 Yang et al.
(Continued)

FOREIGN PATENT DOCUMENTS

DE 2352470 A1 4/1975
DE 3935350 A1 4/1991
(Continued)

OTHER PUBLICATIONS

Japanese Office Action, dated Dec. 18, 2018, for Japanese Application No. 2017-535587, with an English machine translation.
(Continued)

*Primary Examiner* — Forrest M Phillips
(74) *Attorney, Agent, or Firm* — Birch, Stewart, Kolasch & Birch, LLP

(57) ABSTRACT

A soundproof structure has at least one soundproof cell including a frame having a hole portion and a film fixed to the frame so as to cover the hole portion. The soundproof cell is disposed in an opening member having an opening in a state in which a film surface of the film is inclined with respect to an opening cross section of the opening member and a region serving as a ventilation hole, through which gas passes, is provided in the opening member.

23 Claims, 33 Drawing Sheets

(51) Int. Cl.
*G10K 11/172* (2006.01)
*E04B 1/99* (2006.01)

(58) Field of Classification Search
USPC ..... 181/214, 229, 293
See application file for complete search history.

(56) References Cited

U.S. PATENT DOCUMENTS

| | | | | |
|---|---|---|---|---|
| 8,813,708 | B2 * | 8/2014 | Miller | F02M 35/1211 123/184.22 |
| 8,869,933 | B1 * | 10/2014 | McKnight | G10K 11/172 181/207 |
| 2005/0167193 | A1 * | 8/2005 | Van Reeth | E04B 1/8404 181/293 |
| 2008/0017156 | A1 * | 1/2008 | Seko | F02M 35/1222 123/184.57 |
| 2013/0087407 | A1 * | 4/2013 | McKnight | G10K 11/172 181/287 |
| 2014/0027201 | A1 * | 1/2014 | Islam | G10K 11/172 181/294 |
| 2018/0010334 | A1 * | 1/2018 | Perdue | G10K 11/162 |
| 2018/0082668 | A1 * | 3/2018 | Yamazoe | G10K 11/16 |
| 2018/0122352 | A1 * | 5/2018 | Hakuta | E04B 1/84 |
| 2019/0019489 | A1 * | 1/2019 | Hakuta | G10K 11/16 |
| 2019/0341016 | A1 * | 11/2019 | Hakuta | G10K 11/172 |

FOREIGN PATENT DOCUMENTS

| | | | |
|---|---|---|---|
| EP | 0495763 | A1 | 7/1992 |
| JP | 8-50489 | A | 2/1996 |
| JP | 2000-88331 | A | 3/2000 |
| JP | 2000-257789 | A | 9/2000 |
| JP | 2002-123259 | A | 4/2002 |
| JP | 2005-250474 | A | 9/2005 |
| JP | 2007-536492 | A | 12/2007 |
| JP | 2008-25473 | A | 2/2008 |
| JP | 2008-151070 | A | 7/2008 |
| JP | 2009-139556 | A | 6/2009 |
| JP | 63-153592 | A | 4/2010 |
| JP | 2010-69976 | A | 4/2010 |
| JP | 483245 | B2 | 12/2011 |
| JP | 2013-88794 | A | 5/2013 |
| WO | WO 2005/108696 | A1 | 11/2005 |
| WO | WO 2006/123505 | A1 | 11/2006 |
| WO | WO 2016/033749 | A1 | 3/2016 |

OTHER PUBLICATIONS

Partial European Search Report, dated Jun. 27, 2018, for European Application No. 16837197.9.

Extended European Search Report, dated Oct. 17, 2018, for European Application No. 16837197.9.

International Preliminary Report on Patentability and Written Opinion of the International Searching Authority (Form PCT/IPEA/409) for International Application No. PCT/JP2016/074427, dated Aug. 22, 2017, with English translation.

International Search Report and Written Opinion of the International Searching Authority (Forms PCT/ISA/210 and PCT/ISA/237) for International Application No. PCT/JP2016/074427, dated Nov. 8, 2016, with English translation of the International Search Report.

* cited by examiner

SOUNDPROOF STRUCTURE, LOUVER, AND SOUNDPROOF WALL

CROSS-REFERENCE TO RELATED APPLICATIONS

This application is a Continuation of PCT International Application No. PCT/JP2016/074427 filed on Aug. 22, 2016, which claims priority under 35 U.S.C. § 119(a) to Japanese Patent Application No. 2015-163227 filed on Aug. 20, 2015, Japanese Patent Application No. 2016-012625 filed on Jan. 26, 2016 and Japanese Patent Application No. 2016-090743 filed on Apr. 28, 2016. Each of the above applications is hereby expressly incorporated by reference, in its entirety, into the present application.

BACKGROUND OF THE INVENTION

1. Field of the Invention

The present invention relates to a soundproof structure and a louver and a soundproof wall having the same, and more particularly to a soundproof structure that is formed by one soundproof cell, in which a frame and a film fixed to the frame are formed, or formed by arranging a plurality of soundproof cells in a two-dimensional manner and that is for strongly shielding the sound of a target frequency selectively, and a louver and a soundproof wall having the same.

2. Description of the Related Art

In the case of a general sound insulation material, as the mass increases, the sound is more effectively shielded. Accordingly, in order to obtain a good sound insulation effect, the sound insulation material itself becomes large and heavy. On the other hand, in particular, it is difficult to shield the sound of low frequency components. In general, this region is called a mass law, and it is known that the shielding increases by 6 dB in a case where the frequency doubles.

Thus, many of the conventional soundproof structures are disadvantageous in that the soundproof structures are large and heavy due to sound insulation by the mass of the structures and that it is difficult to shield low frequencies.

On the other hand, a soundproof structure in which the stiffness of a member is enhanced by laminating a frame on a sheet or a film has been reported (refer to JP4832245B, U.S. Pat. No. 7,395,898B (refer to corresponding Japanese Patent Application Publication: JP2005-250474A), and JP2009-139556A). Such a sound insulation structure is lightweight and can have high shielding performance at a specific frequency compared with conventional sound insulation members. In addition, it is possible to control the sound insulation frequency by changing the shape of the frame, the stiffness of the film, or the mass of the weight.

JP4832245B discloses a sound absorber that has a frame body, which has through openings formed therein, and a sound absorbing material, which covers one of the through openings and whose storage modulus is in a specific range (refer to abstract, claim 1, paragraphs [0005] to [0007] and [0034], and the like). The storage modulus of the sound absorbing material means a component, which is internally stored, of the energy generated in the sound absorbing material by sound absorption.

In JP4832245B, as a frame body, a material having a low specific gravity, such as resin, is preferably considered from the viewpoint of weight saving (refer to paragraph [0019]). In the embodiment, an acrylic resin is used (refer to paragraph [0030]). As a sound absorbing material, it is considered that a thermoplastic resin can be used (refer to paragraph [0022]). In the embodiment, a sound absorbing material in which a resin or a mixture of a resin and a filler is a formulation material is used (refer to paragraphs [0030] to [0034]). Therefore, it is possible to achieve a high sound absorption effect in a low frequency region without causing an increase in the size of the sound absorber.

In addition, U.S. Pat. No. 7,395,898B (corresponding Japanese Patent Application Publication: JP2005-250474A) discloses a sound attenuation panel including an acoustically transparent two-dimensional rigid frame divided into a plurality of individual cells, a sheet of flexible material fixed to the rigid frame, and a plurality of weights, and a sound attenuation structure (refer to claims 1, 12, and 15, FIG. 5, page 4, and the like). In the sound attenuation panel, the plurality of individual cells are approximately two-dimensional cells, each weight is fixed to the sheet of flexible material so that the weight is provided in each cell, and the resonance frequency of the sound attenuation panel is defined by the two-dimensional shape of each cell, the flexibility of the flexible material, and each weight thereon.

JP2009-139556A discloses a sound absorber which is partitioned by a partition wall serving as a frame and is closed by a rear wall (rigid wall) of a plate-shaped member and in which a film material (film-shaped sound absorbing material) covering an opening portion of the cavity whose front portion is the opening portion is covered, a pressing plate is placed thereon, and a resonance hole for Helmholtz resonance is formed in a region (corner portion) in the range of 20% of the size of the surface of the film-shaped sound absorbing material from the fixed end of the peripheral portion of the opening portion that is a region where the displacement of the film material due to sound waves is the least likely to occur. In the sound absorber, the cavity is blocked except for the resonance hole. The sound absorber performs both a sound absorbing action by film vibration and a sound absorbing action by Helmholtz resonance.

SUMMARY OF THE INVENTION

Incidentally, in the conventional soundproofing using ducts, pipes, and the like, in order to remove noise while maintaining the air permeability, there is a problem that it is necessary to perform additional work, such as making a hole in the duct or changing the thickness of the duct or the pipe.

In addition, the devices disclosed in JP4832245B, U.S. Pat. No. 7,395,898B (refer to corresponding Japanese Patent Application Publication: JP2005-250474A), and JP2009-139556A are disposed so as to block the opening vertically with respect to the incidence direction of sound waves. Since the devices induce the soundproof function in this manner, it is not possible to maintain the air permeability.

In order to overcome the aforementioned problems of the conventional techniques, it is an object of the present invention to provide a soundproof structure in which the film surface of a soundproof cell is attached to an opening member so as to be inclined with respect to the incidence direction of sound so that it is possible to exhibit a large soundproofing effect even in a state of high opening ratio, it is possible to remove noise without additional processing for ducts or pipes at the time of attaching a soundproof cell, and it is possible to maintain high air permeability, and a louver and a soundproof wall having the soundproof structure.

In order to achieve the aforementioned object, a soundproof structure of a first aspect of the present invention is a soundproof structure comprising at least one soundproof cell comprising a frame having a hole portion and a film fixed to the frame so as to cover the hole portion. The soundproof cell is disposed in an opening member having an opening in a state in which a film surface of the film is inclined with respect to an opening cross section of the opening member and a region serving as a ventilation hole, through which gas passes, is provided in the opening member.

In addition, in order to achieve the aforementioned object, a louver of a second aspect of the present invention comprises the soundproof structure of the first aspect described above.

In addition, in order to achieve the aforementioned object, a soundproof wall of a third aspect of the present invention comprises the soundproof structure of the first aspect described above.

It is preferable that the soundproof cell is disposed within an opening end correction distance from an opening end of the opening member.

It is preferable that the soundproof cell has a size smaller than a wavelength of a first natural vibration frequency of the film.

It is preferable that the first natural vibration frequency is included within a range of 10 Hz to 100000 Hz.

It is preferable that the soundproof cell is disposed at a position where sound pressure formed on the opening member by sound waves of a first natural vibration frequency of the soundproof cell is high.

It is preferable that the soundproof cell is disposed at a position of an antinode of a sound pressure distribution of standing waves formed on the opening member by sound waves of a first natural vibration frequency of the soundproof cell.

The soundproof structure may have a plurality of the soundproof cells.

It is preferable that the plurality of soundproof cells include two or more types of soundproof cells having different first natural vibration frequencies and that each of the two or more types of soundproof cells having different first natural vibration frequencies is disposed at a position where sound pressure formed on the opening member by sound waves of the first natural vibration frequency corresponding to each soundproof cell is high.

It is preferable that the plurality of soundproof cells include two or more types of soundproof cells having different first natural vibration frequencies and that each of the two or more types of soundproof cells having different first natural vibration frequencies is disposed at a position of an antinode of a sound pressure distribution of standing waves formed on the opening member by sound waves of the first natural vibration frequency corresponding to each soundproof cell.

It is preferable that the plurality of soundproof cells include two or more soundproof cells having the same first natural vibration frequency and that the two or more soundproof cells are disposed on the same circumference of an inner peripheral wall of the opening member.

It is more preferable that the plurality of soundproof cells further include one or more types of soundproof cells having the first natural vibration frequency different from the same first natural vibration frequency of the two or more soundproof cells and that the one or more types of soundproof cells having the different first natural vibration frequency are disposed in series with one of the two or more soundproof cells having the same first natural vibration frequency in a central axis direction of the opening member.

It is preferable that the plurality of soundproof cells include two or more soundproof cells having the same first natural vibration frequency and that the two or more soundproof cells are disposed in series in a central axis direction of the opening member.

It is more preferable that the plurality of soundproof cells further include one or more types of soundproof cells having the first natural vibration frequency different from the same first natural vibration frequency of the two or more soundproof cells and that the one or more types of soundproof cells having the different first natural vibration frequency are disposed in series in the central axis direction of the opening member.

It is preferable that the hole portion is open and the film is fixed to both end surfaces of the hole portion.

It is preferable that the hole portion is open and the film is fixed to both end surfaces of the hole portion and that first natural vibration frequencies of the films on both the surfaces are different.

It is preferable to further comprise a through-hole communicating with rear surface spaces of the films of the soundproof cells adjacent to each other.

It is preferable that a weight is disposed on the film.

It is preferable that the film has a through-hole.

It is preferable to further comprise a sound absorbing material disposed in the hole portion of the frame.

It is preferable to further comprise a mechanism for adjusting an inclination angle of the film surface of the soundproof cell with respect to the opening cross section.

It is preferable that the soundproof cell is a member that is removable from the opening member.

It is preferable that the opening member is a cylindrical body and the soundproof cell is disposed inside the cylindrical body.

It is preferable that the opening member has an opening formed in the region of the object that blocks the passage of gas, and it is preferable that the opening member is provided in a wall separating two spaces from each other.

According to the present invention, even in a case where the film surface of the soundproof cell is attached to the opening member so as to be inclined with respect to the incidence direction of sound, it is possible to exhibit a large soundproofing effect even in a state of high opening ratio. In addition, at the time of attaching the soundproof cell, it is possible to remove noise without additional processing for ducts or pipes, and it is possible to maintain high air permeability.

DESCRIPTION OF THE PREFERRED EMBODIMENTS

Hereinafter, a soundproof structure and a louver and a soundproof wall having the same according to the present invention will be described in detail with reference to preferred embodiments shown in the accompanying diagrams. First, the soundproof structure according to the present invention will be described.

First Embodiment

Figure 1:
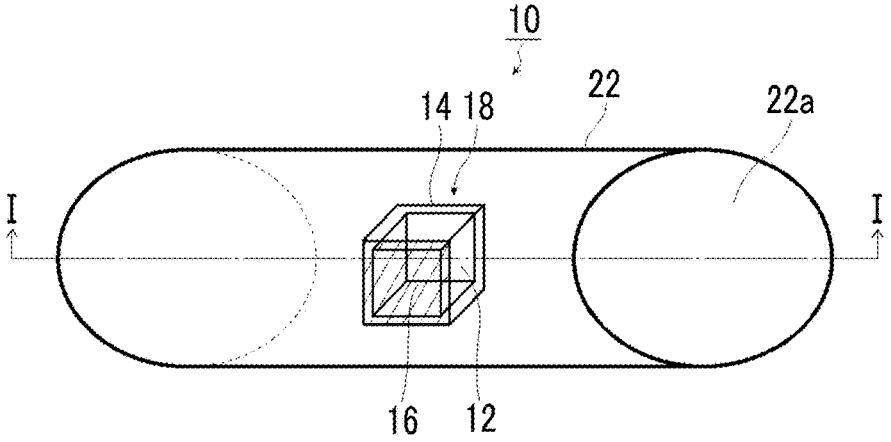
FIG. 1 is a perspective view schematically showing an example of a soundproof structure according to Embodiment 1 of the present invention.
Figure 2:
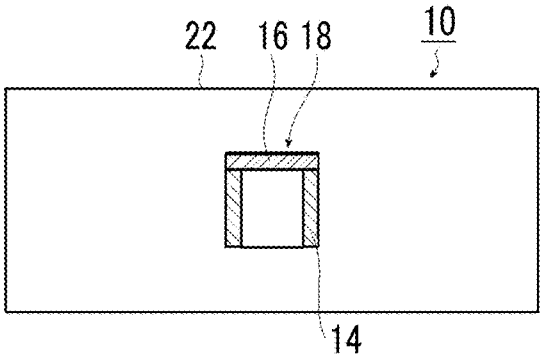
FIG. 2 is a schematic cross-sectional view of the soundproof structure shown in FIG. 1 taken along the line I-I.
Figure 3:
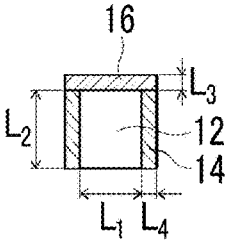
FIG. 3 is a schematic cross-sectional view of a soundproof cell shown in FIG. 1.

FIG. 1 is a perspective view schematically showing an example of a soundproof structure according to Embodiment 1 of the present invention. FIG. 2 is a schematic cross-sectional view of the soundproof structure shown in FIG. 1 taken along the line I-I, and FIG. 3 is a schematic cross-sectional view of a soundproof cell shown in FIG. 1.

A soundproof structure 10 of Embodiment 1 shown in FIG. 1 has a structure in which a soundproof cell 18 having a frame 14 having a hole portion 12 penetrating therethrough and a vibratable film 16 fixed to the frame 14 so as to cover one surface of the hole portion 12 is disposed in an aluminum tubular body 22 (its opening 22*a*), which is an opening member of the present invention, in a state in which the film surface of the film 16 is inclined at a predetermined angle (angle θ in the example shown in FIG. 14, θ=90° in the example shown in FIG. 2) with respect to an opening cross section 22*b* (refer to FIG. 14 described later) of the tubular body 22 and a region serving as a ventilation hole through which gas passes is provided in the opening 22*a* in the tubular body 22.

Although the tubular body 22 is an opening member formed in a region of an object that blocks the passage of gas herein, the tube wall of the tubular body 22 forms a wall of an object that blocks the passage of gas, for example, a wall of an object separating two spaces from each other, and the inside of the tubular body 22 forms the opening 22*a* formed in a region of a part of the object that blocks the passage of gas.

In the present invention, it is preferable that the opening member has an opening formed in the region of the object that blocks the passage of gas, and it is preferable that the opening member is provided in a wall separating two spaces from each other.

Here, the object that has a region where an opening is formed and that blocks the passage of gas refers to a member, a wall, and the like separating two spaces from each other. The member refers to a member, such as a tubular body and a cylindrical body. The wall refers to, for example, a fixed wall forming a building structure such as a house, a building, and a factory, a fixed wall such as a fixed partition disposed in a room of a building to partition the inside of the room, or a movable wall such as a movable partition disposed in a room of a building to partition the inside of the room.

The opening member of the present invention may be a tubular body or a cylindrical body, such as a duct, or may be a wall itself having an opening for attaching a ventilation hole, such as a louver or a gully, or a window, or may be a mounting frame, such as a window frame attached to a wall.

The shape of the opening of the opening member of the present invention is a cross-sectional shape, which is a circle in the illustrated example. In the present invention, however, the shape of the opening of the opening member is not particularly limited as long as a soundproof cell, that is, a soundproof cell unit can be disposed in the opening. For example, the shape of the opening of the opening member may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, an ellipse, and the like, or may be an irregular shape.

As materials of the opening member of the present invention, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, glass fiber reinforced plastics (GFRP), and wall materials such as concrete similar to the wall material of buildings and mortar can be mentioned.

The frame 14 of the soundproof cell 18 is formed by a portion surrounding the hole portion 12.

Since the frame 14 is formed so as to annularly surround the hole portion 12 penetrating therethrough and fixes and supports the film 16 so as to cover one surface of the hole portion 12, the frame 14 serves as a node of film vibration of the film 16 fixed to the frame 14. Therefore, the frame 14 has higher stiffness than the film 16. Specifically, it is preferable that both the mass and the stiffness of the frame 14 per unit area are high.

It is preferable that the frame 14 has a closed continuous shape capable of fixing the film 16 so as to restrain the entire periphery of the film 16. However, the present invention is not limited thereto, and the frame 14 may be made to have a discontinuous shape by cutting a part thereof as long as the frame 14 serves as a node of film vibration of the film 16 fixed to the frame 14. That is, since the role of the frame 14 is to fix and support the film 16 to control the film vibration, the effect is achieved even if there are small cuts in the frame 14 or even if there are unbonded parts.

The shape of the hole portion 12 of the frame 14 is a planar shape (in the illustrated example, a square). In the present invention, however, the shape of the hole portion 12 of the frame 14 is not particularly limited. For example, the shape of the hole portion 12 of the frame 14 may be a quadrangle such as a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. End portions on both sides of the hole portion 12 of the frame 14 are not blocked but opened to the outside as they are. The film 16 is fixed to the frame 14 so as to cover the hole portion 12 in at least one opened end portion of the hole portion 12.

Although the end portions on both sides of the hole portion 12 of the frame 14 are not blocked but opened to the outside as they are in FIGS. 1 and 2, only one end portion of the hole portion 12 may be opened to the outside and the other end portion may be blocked. In this case, the film 16 covering the hole portion 12 is fixed only to the opened one end portion of the hole portion 12.

The size of the frame 14 is a size in plan view, that is, $L_1$ in FIG. 3, and can be defined as the size of the hole portion 12. Accordingly, in the following explanation, the size of the frame 14 is the size $L_1$ of the hole portion 12. However, in the case of a regular polygon such as a circle or a square, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

The size $L_1$ of the hole portion 12 of the frame 14 is not particularly limited, and may be set according to a soundproofing target to which the opening member of the soundproof structure 10 of the present invention is applied for soundproofing, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier.

The soundproof structure 10 itself can also be used like a partition in order to shield sound from a plurality of noise sources. Also in this case, the size $L_1$ of the frame 14 can be selected from the frequency of the target noise.

It is preferable that the soundproof cell 18 configured to include the frame 14 and the film 16 is smaller than the wavelength of the first natural vibration frequency of the film 16. For this, that is, in order to make the soundproof cell 18 smaller than the wavelength of the first natural vibration frequency, it is preferable to make the size $L_1$ of the frame 14 small.

For example, although the size $L_1$ of the hole portion 12 is not particularly limited, the size $L_1$ of the hole portion 12 is preferably 0.5 mm to 300 mm, more preferably 1 mm to 100 mm, and most preferably 10 mm to 50 mm.

The width $L_4$ and the thickness $L_2$ of the frame 14 are not particularly limited as long as the film 16 can be fixed so that the film 16 can be reliably supported. For example, the width $L_4$ and the thickness $L_2$ of the frame 14 can be set according to the size of the hole portion 12.

For example, in a case where the size $L_1$ of the hole portion 12 is 0.5 mm to 50 mm, the width $L_4$ of the frame 14 is preferably 0.5 mm to 20 mm, more preferably 0.7 mm to 10 mm, and most preferably 1 mm to 5 mm.

In a case where the size $L_1$ of the hole portion 12 exceeds 50 mm and is equal to or less than 300 mm, the width $L_4$ of the frame 14 is preferably 1 mm to 100 mm, more preferably 3 mm to 50 mm, and most preferably 5 mm to 20 mm.

In a case where the ratio of the width $L_4$ of the frame 14 to the size $L_1$ of the frame 14 is too large, the area ratio of the frame 14 with respect to the entire structure increases. Accordingly, there is a concern that the device (soundproof cell 18) will become heavy. On the other hand, in a case where the ratio is too small, it is difficult to strongly fix the film 16 with an adhesive or the like in the frame 14 portion.

In addition, the thickness $L_2$ of the frame 14, that is, the thickness $L_2$ of the hole portion 12 is preferably 0.5 mm to 200 mm, more preferably 0.7 mm to 100 mm, and most preferably 1 mm to 50 mm.

Since it is preferable to make the soundproof cell 18 smaller than the wavelength of the first natural vibration frequency of the film 16, it is preferable that the size $L_1$ of the frame 14 (hole portion 12) is a size equal to or less than the wavelength of the first natural vibration frequency of the film 16 fixed to the soundproof cell 18.

In a case where the size $L_1$ of the frame 14 (hole portion 12) of the soundproof cell 18 is a size equal to or less than the wavelength of the first natural vibration frequency of the film 16, sound pressure with low strength unevenness is applied to the film surface of the film 16. Therefore, a vibration mode of a film in which it is difficult to control sound is hard to be induced. That is, the soundproof cell 18 can acquire high sound controllability.

In order to apply a sound pressure with less strength unevenness to the film surface of the film 16, that is, in order to make the sound pressure applied to the film surface of the film 16 more uniform, assuming that the wavelength of the first natural vibration frequency of the film 16 fixed to the soundproof cell 18 is $\lambda$, the size $L_1$ of the frame 14 (hole portion 12) is preferably $\lambda/2$ or less, more preferably $\lambda/4$ or less, and most preferably $\lambda/8$ or less.

The material of the frame 14 is not particularly limited as long as the material can support the film 16, has a suitable strength in the case of being applied to the above soundproofing target, and is resistant to the soundproof environment of the soundproofing target, and can be selected according to the soundproofing target and the soundproof environment. For example, as materials of the frame 14, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastic (CFRP), carbon fiber, and glass fiber reinforced plastic (GFRP) can be mentioned.

A plurality of types of these materials may also be used in combination as materials of the frame 14.

A known sound absorbing material may be disposed in the hole portion 12 of the frame 14.

By arranging the sound absorbing material, the sound insulation characteristics can be further improved by the sound absorption effect of the sound absorbing material.

The sound absorbing material is not particularly limited, and various known sound absorbing materials, such as a urethane plate and a nonwoven fabric, can be used.

The soundproof structure 10 of the present invention may be placed in an opening member including the tubular body 22, such as a duct, together with various known sound absorbing materials, such as a urethane plate and a nonwoven fabric.

As described above, by using a known sound absorbing material in combination within the soundproof structure of the present invention or together with the soundproof structure of the present invention, both the effect of the soundproof structure of the present invention and the effect of the known sound absorbing material can be obtained.

Since the film 16 is fixed so as to be restrained by the frame 14 so as to cover the hole portion 12 inside the frame 14, the film 16 vibrates in response to sound waves from the outside. By absorbing or reflecting the energy of sound waves, the sound is insulated.

Incidentally, since the film 16 needs to vibrate with the frame 14 as a node, it is necessary that the film 16 is fixed to the frame 14 so as to be reliably restrained by the frame 14 and accordingly becomes an antinode of film vibration, thereby absorbing or reflecting the energy of sound waves to insulate sound. For this reason, it is preferable that the film 16 is formed of a flexible elastic material.

Therefore, the shape of the film 16 can be said to be the shape of the hole portion 12 of the frame 14 shown in FIG. 3. In addition, the size of the film 16 can be said to be the size $L_1$ of the frame 14 (hole portion 12).

The thickness of the film 16 is not particularly limited as long as the film can vibrate by absorbing the energy of sound waves to insulate sound. However, it is preferable to make the film 16 thick in order to obtain a natural vibration mode on the high frequency side and thin in order to obtain the natural vibration mode on the low frequency side. For example, the thickness $L_3$ of the film 16 shown in FIG. 3 can be set according to the size $L_1$ of the hole portion 12, that is, the size $L_1$ of the film 16 in the present invention.

For example, in a case where the size $L_1$ of the hole portion 12 is 0.5 mm to 50 mm, the thickness $L_3$ of the film 16 is preferably 0.001 mm (1 μm) to 5 mm, more preferably 0.005 mm (5 μm) to 2 mm, and most preferably 0.01 mm (10 μm) to 1 mm.

In a case where the size $L_1$ of the hole portion 12 exceeds 50 mm and is equal to or less than 300 mm, the thickness $L_3$ of the film 16 is preferably 0.01 mm (10 μm) to 20 mm, more preferably 0.02 mm (20 μm) to 10 mm, and most preferably 0.05 mm (50 μm) to 5 mm.

It is preferable that the thickness of the film 16 is expressed by an average thickness, for example, in a case where there are different thicknesses in one film 16.

Here, the film 16 fixed to the frame 14 of the soundproof cell 18 has a first natural vibration frequency, which is the frequency of the lowest order natural vibration mode that can be induced in the structure of the soundproof cell 18.

For example, the film 16 fixed to the frame 14 of the soundproof cell 18 has a resonance frequency having a lowest absorption peak at which the transmission loss of the film is minimized with respect to the sound field incident substantially perpendicular to the film 16, which is the frequency of the lowest order natural vibration mode, that is, has the first natural vibration frequency. That is, in the present invention, at the first natural vibration frequency of the film 16, sound is transmitted and an absorption peak of the lowest order frequency is obtained. In the present invention, the resonance frequency is determined by a soundproof cell unit 20 configured to include the frame 14 and the film 16.

That is, the resonance frequency of the film 16, which is fixed so as to be restrained by the frame 14, in the structure configured to include the frame 14 and the film 16 is a frequency at which the sound wave most vibrates the film, and is a frequency of the natural vibration mode in which the sound wave is largely transmitted at the frequency and which has an absorption peak of the lowest order frequency.

In the present invention, the first natural vibration frequency is determined by the soundproof cell 18 configured to include the frame 14 and the film 16. In the present invention, the first natural vibration frequency determined in this manner is referred to as a first natural vibration frequency of a film.

The first natural vibration frequency (for example, a boundary between a frequency region according to the stiffness law and a frequency region according to the mass law becomes the lowest order first resonance frequency) of the film 16 fixed to the frame 14 is preferably 10 Hz to 100000 Hz corresponding to the sound wave sensing range of a human being, more preferably 20 Hz to 20000 Hz that is the audible range of sound waves of a human being, even more preferably 40 Hz to 16000 Hz, most preferably 100 Hz to 12000 Hz.

In the soundproof cell 18 of the present embodiment, the resonance frequency of the film 16 in the structure configured to include the frame 14 and the film 16, for example, the first natural vibration frequency of the film 16 can be determined by the geometric form of the frame 14 of the soundproof cell 18, for example, the shape and size of the frame 14 and the stiffness of the film 16 of the soundproof cell 18, for example, the thickness and flexibility of the film 16 and the volume of the space behind the film.

For example, as a parameter characterizing the natural vibration mode of the film 16, in the case of the film 16 of the same material, a ratio between the thickness (t) of the film 16 and the square of the size (R) of the hole portion 12 can be used. For example, in the case of a square, a ratio $[R^2/t]$ between the size of one side and the square of the size (R) of the hole portion 12 can be used. In a case where the ratio $[R^2/t]$ is the same, the natural vibration mode is the same frequency, that is, the same resonance frequency. That is, by setting the ratio $[R^2/t]$ to a fixed value, the scale law is established. Accordingly, an appropriate size can be selected.

The Young's modulus of the film 16 is not particularly limited as long as the film has elasticity capable of vibrating in order to insulate sound by absorbing or reflecting the energy of sound waves. However, it is preferable to set the Young's modulus of the film 16 to be large in order to obtain the natural vibration mode on the high frequency side and set the Young's modulus of the film 16 to be small in order to obtain the natural vibration mode on the low frequency side. For example, the Young's modulus of the film 16 can be set according to the size of the frame 14 (hole portion 12), that is, the size of the film in the present invention.

For example, the Young's modulus of the film 16 is preferably 1000 Pa to 3000 GPa, more preferably 10000 Pa to 2000 GPa, and most preferably 1 MPa to 1000 GPa.

The density of the film 16 is not particularly limited either as long as the film can vibrate by absorbing or reflecting the energy of sound waves to insulate sound. For example, the density of the film 16 is preferably 5 $kg/m^3$ to 30000 $kg/m^3$, more preferably 10 $kg/m^3$ to 20000 $kg/m^3$, and most preferably 100 $kg/m^3$ to 10000 $kg/m^3$.

In a case where a film-shaped material or a foil-shaped material is used as a material of the film 16, the material of the film 16 is not particularly limited as long as the material has a strength in the case of being applied to the above soundproofing target and is resistant to the soundproof environment of the soundproofing target so that the film 18 can vibrate by absorbing or reflecting the energy of sound waves to insulate sound, and can be selected according to the soundproofing target, the soundproof environment, and the like. Examples of the material of the film 16 include resin materials that can be made into a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, metal materials that can be made into a foil shape such as aluminum, chromium, titanium, stainless steel, nickel, tin, niobium, tantalum, molybdenum, zirconium, gold, silver, platinum, palladium, iron, copper, and permalloy, fibrous materials such as paper and cellulose, and materials or structures capable of forming a thin structure such as a nonwoven fabric, a film containing nano-sized fiber, porous materials including thinly processed urethane or synthrate, and carbon materials processed into a thin film structure.

In addition, the film 16 is fixed to the frame 14 so as to cover an opening on at least one side of the hole portion 12 of the frame 14. That is, the film 16 may be fixed to the frame 14 so as to cover openings on one side, the other side, or both sides of the hole portion 12 of the frame 14.

The method of fixing the film 16 to the frame 14 is not particularly limited. Any method may be used as long as the film 16 can be fixed to the frame 14 so as to serve as a node of film vibration. For example, a method using an adhesive, a method using a physical fixture, and the like can be mentioned.

In the method of using an adhesive, an adhesive is applied onto the surface of the frame 14 surrounding the hole portion 12 and the film 16 is placed thereon, so that the film 16 is fixed to the frame 14 with the adhesive. Examples of the adhesive include epoxy-based adhesives (Araldite (registered trademark) (manufactured by Nichiban Co., Ltd.) and the like), cyanoacrylate-based adhesives (Aron Alpha (registered trademark) (manufactured by Toagosei Co., Ltd.) and the like), and acrylic-based adhesives.

As a method using a physical fixture, a method can be mentioned in which the film 16 disposed so as to cover the hole portion 12 of the frame 14 is interposed between the frame 14 and a fixing member, such as a rod, and the fixing member is fixed to the frame 14 by using a fixture, such as a screw.

Although the soundproof cell 18 of Embodiment 1 has a structure in which the frame 14 and the film 16 are formed as separate bodies and the film 16 is fixed to the frame 14, the present invention is not limited thereto, and a structure in which the film 16 and the frame 14 formed of the same material are integrated may be adopted.

The soundproof cell 18 of the present embodiment is formed as described above.

The opening ratio of the soundproof structure 10 is preferably 10% or more, more preferably 25% or more, and even more preferably 50% or more. Details of "opening ratio" will be described later.

From the viewpoint of air permeability, the inclination angle θ of the film surface of the film 16 with respect to the opening cross section 22*b* of the tubular body 22 is preferably 20° or more, more preferably 45° or more, and even more preferably 80° or more. The details of the inclination angle θ of the film surface of the film 16 with respect to the opening cross section 22*b* of the tubular body 22 will be described later.

The soundproof cell 18 is disposed at a position of high sound pressure, which is formed on the tubular body 22 by the sound wave of the first natural vibration frequency of the soundproof cell 18, in the tubular body 22 that is an opening member. Specifically, the soundproof cell 18 is preferably disposed within ±λ/4 from the position of the antinode of the sound pressure distribution of the standing wave formed on the tubular body 22 by the sound wave of the first natural vibration frequency of the soundproof cell 18, more preferably disposed within ±λ/6 from the position of the antinode of the sound pressure distribution of the standing wave, even more preferably disposed within ±λ/8 from the position of the antinode of the sound pressure distribution of the standing wave, and most preferably disposed at the position of the antinode of the sound pressure distribution of the standing wave.

For example, in a case where the tubular body 22 is a cylinder or a duct in which an object, such as a wall or a cover, is disposed at its open end, that is, in a case where the object is a fixed end of the sound wave, the soundproof cell 18 is preferably disposed within λ/4 of the sound wave of the first natural vibration frequency of the soundproof cell 18 from the object, more preferably disposed within λ/6 of the sound wave of the first natural vibration frequency of the soundproof cell 18 from the object, and most preferably disposed within λ/8 of the sound wave of the first natural vibration frequency of the soundproof cell 18 from the object.

On the other hand, in a case where the tubular body 22 is a cylinder or a duct in which there is no object, such as a wall or a cover, disposed at its open end, that is, in a case where the open end of the tubular body is the free end of the sound wave, the soundproof cell 18 is preferably disposed within λ/4 of the sound wave of the first natural vibration frequency of the soundproof cell 18—opening end correction distance of ±λ/4 from the open end, more preferably disposed within λ/4—opening end correction distance of ±λ/6 from the open end, and even more preferably disposed within λ/4—opening end correction distance of ±λ/8 from the open end.

The predetermined arrangement of the soundproof cell in the tubular body will be described in detail later.

The soundproof structure 10 of Embodiment 1 of the present invention is basically formed as described above.

In the soundproof structure 10 of Embodiment 1 described above, one soundproof cell 18 configured to include one frame 14 having one hole portion 12 and one film 16 is disposed in the tubular body 22 (its opening 22*a*). However, the present invention is not limited thereto, and a plurality of soundproof cells 18 may be disposed in the tubular body 22.

Second Embodiment

Figure 4:
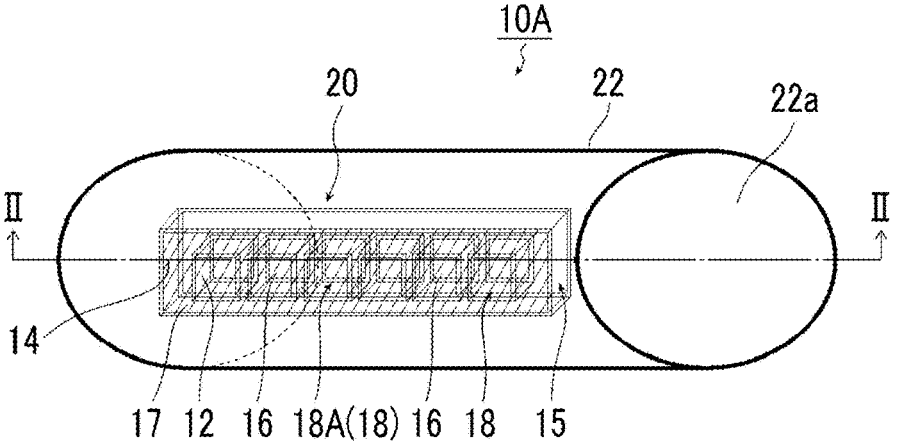
FIG. 4 is a perspective view schematically showing an example of a soundproof structure according to Embodiment 2 of the present invention.
Figure 5:
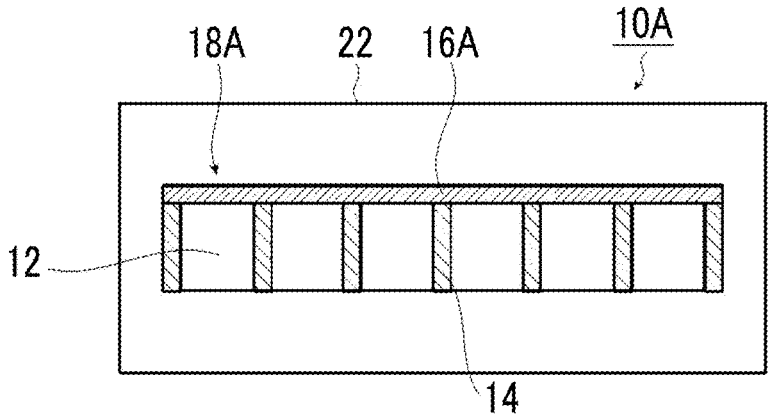
FIG. 5 is a schematic cross-sectional view of the soundproof structure shown in FIG. 4 taken along the line II-II.

FIG. 4 is a perspective view schematically showing an example of a soundproof structure according to Embodiment 2 of the present invention. FIG. 5 is a schematic cross-sectional view of the soundproof structure shown in FIG. 4 taken along the line II-II.

A soundproof structure 10A of Embodiment 2 shown in FIGS. 4 and 5 has a structure in which a soundproof cell unit 20, in which a plurality of soundproof cells 18A (18) each having a frame 14 having a hole portion 12 penetrating therethrough and a vibratable film 16 fixed to the frame 14 so as to cover one surface of the hole portion 12 are arranged (in the illustrated example shown in FIGS. 4 and 5, six soundproof cells 18A (18) are arranged in a column), is disposed in the aluminum tubular body 22 (its opening 22*a*), which is an opening member of the present invention, in a state in which the film surface of the film 16 is inclined with respect to the opening cross section 22*b* of the tubular body 22 and a region serving as a ventilation hole through which gas passes is provided in the opening 22*a* in the tubular body 22.

The soundproof structure 10A of Embodiment 2 shown in FIGS. 4 and 5 has the same configuration as the soundproof structure 10 of Embodiment 1 shown in FIGS. 1 and 2 except that the number of soundproof cells 18A having the same configuration as the soundproof cell 18 is different from the number of soundproof cells 18 arranged in the tubular body 22, that is, the number of soundproof cells 18 arranged in the tubular body 22 is one while there is a plurality of soundproof cells 18A having the same configuration as the soundproof cell 18. Accordingly, the same components are denoted by the same reference numerals, and the explanation thereof will be omitted. In Embodiment 2, a plurality of soundproof cells 18A may be the same soundproof cells as the soundproof cell 18 of Embodiment 1 described above, or may be different from the soundproof cell 18 of Embodiment 1. However, since the plurality of soundproof cells 18A have the same configuration, the explanation thereof will be omitted.

The soundproof cell unit 20 of the soundproof structure 10A shown in FIGS. 4 and 5 is formed by the six soundproof cells 18A, but the present invention is not limited thereto. As long as the soundproof cell unit 20 of the soundproof structure 10A shown in FIGS. 4 and 5 is formed by a plurality of soundproof cells 18A, the soundproof cell unit 20 may be formed by any number of soundproof cells 18A.

In the soundproof cell unit 20 of Embodiment 2, a plurality of (six) hole portions 12 are provided in a quadrangular rod-shaped frame member 15 having a fixed thickness, and the frame 14 of each soundproof cell 18A is formed by a portion surrounding each hole portion 12.

In the example shown in FIGS. 4 and 5, a plurality of frames 14 are configured as a frame body arranged so as to be connected in a two-dimensional manner, preferably one frame body, and the frame body is formed by the frame member 15.

Although the plurality of frames 14 are arranged in a column in FIGS. 4 and 5, the present invention is not limited thereto, and the plurality of frames 14 may be arranged in a two-dimensional manner.

In the soundproof cell unit 20 of Embodiment 2, the size $L_1$ of the hole portion 12 of the frame 14 may be fixed in all hole portions 12. However, frames having different sizes (including a case where shapes are different) may be included. In this case, the average size of the hole portions 12 may be used as the size of the hole portion 12. That is, the size $L_1$ of the frame 14 (hole portion 12) is preferably expressed by an average size, for example, in a case where different sizes are included in each frame 14.

It is preferable that the width $L_4$ and the thickness $L_2$ of the frame 14 are expressed by an average width and an average thickness, respectively, for example, in a case where different widths and thicknesses are included in each frame 14.

The number of frames 14 of the soundproof cell unit 20 of Embodiment 2, that is, the number of hole portions 12, is not particularly limited, and may be set according to the above-described soundproofing target of the soundproof structure 10A of the present invention. Alternatively, since the size of the hole portion 12 described above is set according to the above-described soundproofing target, the number of hole portions 12 of the frame 14 may be set according to the size of the hole portion 12.

For example, in the case of shielding noise in a device, the number of frames 14 is preferably 1 to 10000, more preferably 2 to 5000, and most preferably 4 to 1000. "Shielding" herein refers to shielding by reflection and/or absorption.

The reason is as follows. For the size of general equipment, the size of the equipment is fixed. Accordingly, in order to make the size of one soundproof cell 18A suitable for the frequency and volume of noise, it is often necessary to perform shielding with a frame body obtained by combining a plurality of soundproof cells 18A. In addition, by increasing the number of soundproof cells 18A too much, the total weight is increased by the weight of the frame 14. On the other hand, in a structure such as a partition that is not limited in size, it is possible to freely select the number of frames 14 according to the required overall size.

In addition, since one soundproof cell 18A has one frame 14 as a constitutional unit, the number of frames 14 of the soundproof cell unit 20 of the present embodiment can be said to be the number of soundproof cells 18A.

As the material of the frame member 15, it is possible to use the same material as the material of the frame 14 in Embodiment 1. As the material of the frame 14, that is, as the material of the rod-shaped soundproof frame member 15, a plurality of kinds of materials of the frame 14 described in Embodiment 1 may be used in combination.

A plurality of films 16 (in the example shown in FIG. 4, six films 16) are fixed so as to cover the respective hole portions 12 of a plurality of (six) frames 14. However, as shown in FIG. 4, the plurality of films 16 may be fixed so as to cover the respective hole portions 12 of a plurality of (six) frames 14 with one sheet-shaped film body 17, or may be fixed so that each film 16 covers the hole portion 12 of each frame 14. That is, a plurality of films 16 may be formed by one sheet-shaped film body 17 covering a plurality of frames 14, or may cover the hole portion 12 of each frame 14.

It is preferable that the thickness of the film 16 is expressed by an average thickness, for example, in a case where different thicknesses are included in each film 16.

In addition, the film 16 is fixed to the frame 14 so as to cover an opening on at least one side of the hole portion 12 of the frame 14. That is, the film 16 may be fixed to the frame 14 so as to cover openings on one side, the other side, or both sides of the hole portion 12 of the frame 14.

Here, all the films 16 may be provided on the same side of the hole portions 12 of the plurality of frames 14 of the soundproof cell unit 20. Alternatively, some of the films 16 may be provided on one side of each of some of the hole portions 12 of the plurality of frames 14, and the remaining films 16 may be provided on the other side of each of the remaining some hole portions 12 of the plurality of frames 14. Furthermore, films provided on one side, the other side, and both sides of the hole portion 12 of the frame 14 may be mixed.

The soundproof cell 18A of Embodiment 2 is a structure in which the film 16 is fixed to each of a plurality of frames 14 or a structure in which a plurality of frames 14 are covered with one sheet-shaped film body 17. However, the present invention is not limited thereto, and the soundproof cell 18A of Embodiment 2 may be a structure in which the film 16 or the film body 17 formed of the same material and the frame 14 are integrated.

As described in the soundproof structure 10 of Embodiment 1, the film 16 fixed to the frame 14 of the soundproof cell 18 has a first natural vibration frequency, which is a frequency of the lowest order natural vibration mode that can be induced, in the structure of the soundproof cell 18. In Embodiment 2, the first natural vibration frequency is determined by the soundproof cell unit 20 in which a plurality of soundproof cells 18A each including the frame 14 and the film 16 are arranged. In the present invention, the first natural vibration frequency determined in this manner is referred to as the first natural vibration frequency of the film as described above.

In the soundproof cell unit 20 of the present embodiment, the resonance frequency of the film 16 in the structure configured to include the frame 14 and the film 16, for example, the first natural vibration frequency can be determined by the geometric form of the frame 14 of the plurality of soundproof cells 18A, for example, the shape and size of the frame 14 and the stiffness of the film 16 of the plurality of soundproof cells, for example, the thickness and flexibility of the film and the volume of the space behind the film. The soundproof structure 10A of Embodiment 2 of the present invention is configured as described above.

In the soundproof structure 10 of Embodiment 1 and the soundproof structure 10A of Embodiment 2 described above, the soundproof cells 18 and 18A in which the film 16 covers only one end surface of the hole portion 12 are used. However, the present invention is not limited thereto, and a soundproof cell in which both end surfaces of the hole portion 12 are covered with the film 16.

Third Embodiment

Figure 6:
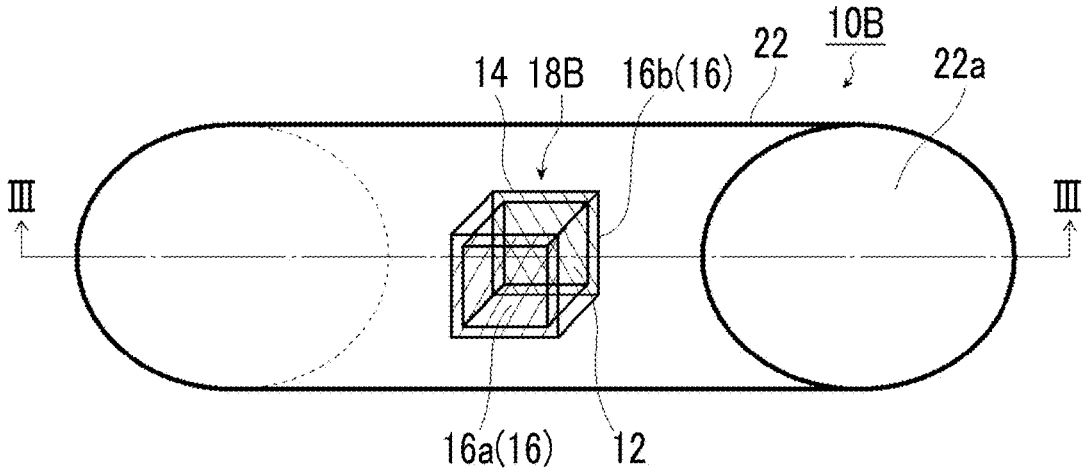
FIG. 6 is a perspective view schematically showing an example of a soundproof structure according to Embodiment 3 of the present invention.
Figure 7:
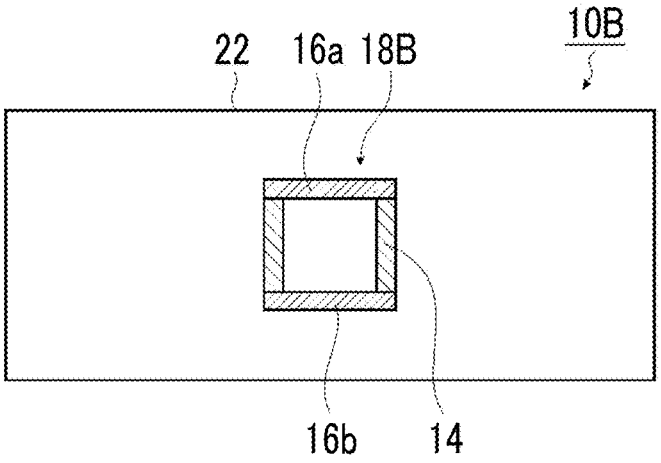
FIG. 7 is a schematic cross-sectional view of the soundproof structure shown in FIG. 6 taken along the line III-III.

FIG. 6 is a perspective view schematically showing an example of a soundproof structure according to Embodiment 3 of the present invention. FIG. 7 is a schematic cross-sectional view of the soundproof structure shown in FIG. 6 taken along the line III-III.

A soundproof structure 10B of Embodiment 3 shown in FIGS. 6 and 7 has a structure in which a soundproof cell 18B having a frame 14 having a hole portion 12 penetrating therethrough and a vibratable film 16 (16*a* and 16*b*) fixed to the frame 14 so as to cover both surfaces of the hole portion 12 is disposed in the aluminum tubular body 22 (its opening 22*a*), which is an opening member of the present invention, in a state in which the film surface of the film 16 is inclined with respect to the opening cross section 22*b* of the tubular body 22 and a region serving as a ventilation hole through which gas passes is provided in the opening 22*a* in the tubular body 22.

The soundproof structure 10B of Embodiment 3 shown in FIGS. 6 and 7 has the same configuration as the soundproof structure 10 of Embodiment 1 shown in FIG. 1 except that the same film 16 (16*a* and 16*b*) is fixed to both surfaces of the hole portion 12 of the frame 14. Accordingly, the same components are denoted by the same reference numerals, and the explanation thereof will be omitted. In addition, since the films 16*a* and 16*b* of the soundproof cell 18B of Embodiment 3 have the same configuration as the film 16 of the soundproof cell 18 of Embodiment 1 described above, the explanation thereof will be omitted.

Also in Embodiment 3, as in Embodiments 1 and 2, the first natural vibration frequency of the soundproof structure 10B is determined by the soundproof cell 18B configured to include the frame 14 and the films 16*a* and 16*b*, and the first natural vibration frequencies of the two films 16*a* and 16*b* determined in this manner are the same. Therefore, the same first natural vibration frequency is referred to as the first natural vibration frequency of the film.

The soundproof structure 10B of Embodiment 3 of the present invention is configured as described above.

Modification Example of Third Embodiment

In the soundproof cell 18B of the soundproof structure 10B of Embodiment 3 shown in FIGS. 6 and 7, the same film 16 (16*a* and 16*b*) is used on both surfaces of the hole portion 12 of the frame 14. However, it is also possible to use a soundproof structure in which film stiffness and/or soundproofing characteristics are changed by changing the film thickness, the film material, and at least one of the size, width, thickness, or frame material of the frame 14 so that the first natural vibration frequencies of two films as the films 16*a* and 16*b* are different.

In the soundproof structure 10B of the modification example of the present embodiment, two films have different first natural vibration frequencies. However, a lower order first natural vibration frequency may be set as a first natural vibration frequency representing the soundproof structure 10B.

Fourth Embodiment

Figure 8:
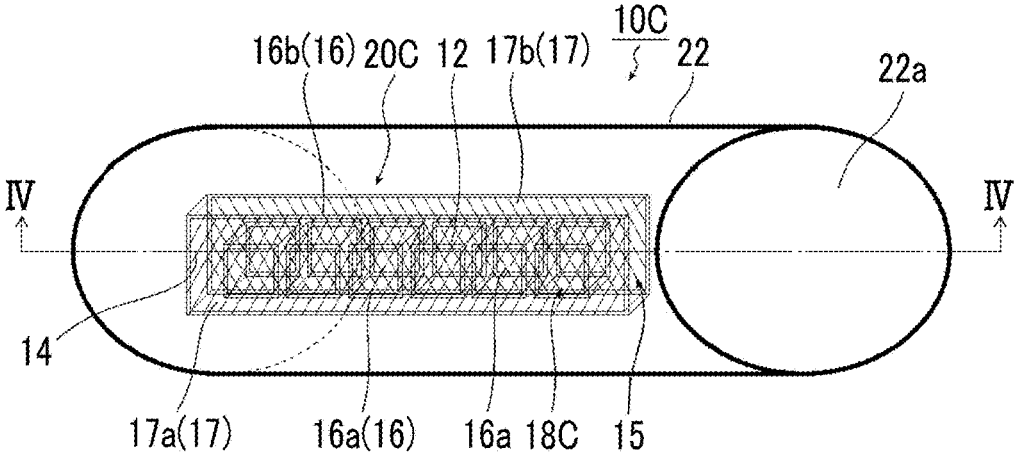
FIG. 8 is a perspective view schematically showing an example of a soundproof structure according to Embodiment 4 of the present invention.
Figure 9:
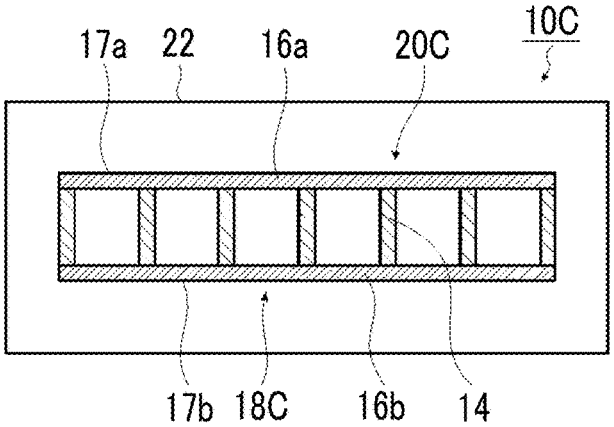
FIG. 9 is a schematic cross-sectional view of the soundproof structure shown in FIG. 8 taken along the line IV-IV.

FIG. 8 is a perspective view schematically showing an example of a soundproof structure according to Embodiment 4 of the present invention. FIG. 9 is a schematic cross-sectional view of the soundproof structure shown in FIG. 8 taken along the line IV-IV.

A soundproof structure 10C of Embodiment 4 shown in FIGS. 8 and 9 has a structure in which a soundproof cell unit 20C, in which a plurality of soundproof cells 18C each having a frame 14 having a hole portion 12 penetrating therethrough and a vibratable film 16 (16*a* and 16*b*) fixed to the frame 14 so as to cover both surfaces of the hole portion 12 are arranged (in the illustrated example shown in FIGS. 8 and 9, six soundproof cells 18C are arranged in a column), is disposed in the aluminum tubular body 22 (its opening 22*a*), which is an opening member of the present invention, in a state in which the film surface of the film 16 is inclined with respect to the opening cross section 22*b* of the tubular body 22 and a region serving as a ventilation hole through which gas passes is provided in the opening 22*a* in the tubular body 22.

The soundproof structure 10C of Embodiment 4 shown in FIGS. 8 and 9 has the same configuration as the soundproof structure 10A of Embodiment 2 shown in FIGS. 4 and 5 except that a soundproof cell B of the soundproof structure 10B of Embodiment 3 shown in FIGS. 6 and 7, in which the same film 16 (16*a* and 16*b*) is fixed to both surfaces of the hole portion 12 of the frame 14, is used as a plurality of soundproof cells 18C of the soundproof cell unit 20C. Accordingly, the same components are denoted by the same reference numerals, and the explanation thereof will be omitted. The soundproof cell unit 20C of Embodiment 4 has the same configuration as the soundproof cell unit 20 of Embodiment 2 except that the film of the soundproof cell has a single surface or two surfaces.

The soundproof structure 10C of the present embodiment shown in FIGS. 8 and 9 has the same configuration as the soundproof structure 10A of Embodiment 2 shown in FIG. 4 except that the same sheet-shaped film body 17 (17*a* and 17*b*) is bonded to both surfaces of the hole portion 12 of the frame 14 so that the film 16 (16*a* and 16*b*) is fixed. Therefore, the films 16*a* and 16*b* of the soundproof cell 18C of Embodiment 4 have the same configuration as the films 16*a* and 16*b* of the soundproof cell 18B of Embodiment 2 described above.

Accordingly, the explanation of each of these components will be omitted.

In the soundproof cell unit 20C, in a plurality of soundproof cells 18C, all the films 16 may be provided on the same side of the hole portions 12 of the plurality of frames 14. Alternatively, the film 16 may be provided on one side of each of some of the hole portions 12 of the plurality of frames 14, and the film 16 may be provided on the other side of each of the remaining some hole portions 12 of the plurality of frames 14. Furthermore, films provided on one side, the other side, and both sides of the hole portion 12 of the frame 14 may be mixed.

Also in Embodiment 4, as in Embodiments 1, 2, and 3, the first natural vibration frequency of the soundproof structure 10B is determined by the soundproof cell 18B configured to include the frame 14 and the films 16*a* and 16*b*, and the first natural vibration frequencies of the two films 16*a* and 16*b* determined in this manner are the same. Therefore, the same first natural vibration frequency is referred to as the first natural vibration frequency of the film.

The soundproof structure 10C of Embodiment 4 is configured as described above.

Fifth Embodiment

Figure 10:
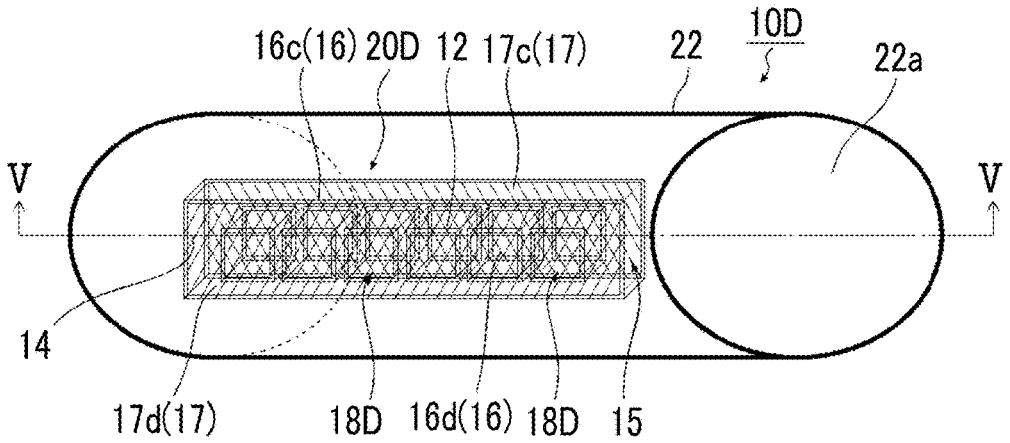
FIG. 10 is a perspective view schematically showing an example of a soundproof structure according to Embodiment 5 of the present invention.
Figure 11:
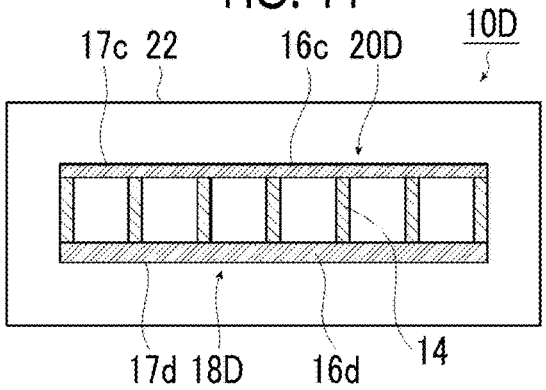
FIG. 11 is a schematic cross-sectional view of the soundproof structure shown in FIG. 10 taken along the line V-V.

FIG. 10 is a perspective view schematically showing an example of a soundproof structure according to Embodiment 5 of the present invention. FIG. 11 is a schematic cross-sectional view of the soundproof structure shown in FIG. 10 taken along the line V-V.

A soundproof structure 10D of Embodiment 5 shown in FIGS. 10 and 11 has the same configuration as the soundproof structure 10C of Embodiment 4 shown in FIGS. 8 and 9 except that a soundproof cell unit 20D is used in which a plurality of soundproof cells 18D (for example, six soundproof cells 18D), to which films 16*c* and 16*d* having different thicknesses are fixed by bonding sheet-shaped film bodies 17*c* and 17*d* having different thicknesses to both surfaces of the hole portion 12 of the frame 14, are arranged. Therefore, other detailed explanation will be omitted.

The soundproof cell unit 20D of the soundproof structure 10D of Embodiment 5 can be a soundproof structure in which the first natural vibration frequencies of the two films 16*c* and 16*d* are different.

In the soundproof structure 10D of Embodiment 5, the two films 16*c* and 16*d* have different first natural vibration frequencies. However, a lower order first natural vibration frequency may be set as a first natural vibration frequency representing the soundproof structure 10B.

The soundproof structure 10D of Embodiment 5 of the present invention is configured as described above.

Modification Example of Fifth Embodiment

In the soundproof structure 10D of Embodiment 5 shown in FIG. 10, by bonding the films 16 (16*c* and 16*d*) of the same material having different film thicknesses to both surfaces of the hole portion 12 of the frame 14, that is, by changing the film thickness, the two films 16*c* and 16*d* having different first natural vibration frequencies (resonance frequencies) are fixed. However, it is also possible to use a soundproof structure in which the film stiffness is changed by changing the film material or the soundproofing characteristics of the soundproof cell 18D are changed by changing at least one of the size, width, thickness, or frame material of the frame 14 so that the first natural vibration frequencies (resonance frequencies) of two films are different.

Each of the soundproof cells 18 and 18A to 18D shown in Embodiments 1 to 5 is configured to include the hexahedron frame 14 having one hole portion 12 having two openings. However, the present invention is not limited thereto, and a soundproof cell may be used in which the hexahedron frame 14 has a hole portion having three to six openings. In the case of a soundproof cell in which the hexahedron frame 14 has a hole portion having three to six openings, three to six films for fixing three to six surfaces may be further included.

Effect of Embodiments 1 to 5

According to the soundproof structures shown in Embodiments 1 to 5, even if the film surface of the soundproof cell is disposed so as to be inclined with respect to the sound incidence direction in the opening member, such as a duct or a pipe, it is possible to obtain a high soundproofing effect while having a high opening ratio, that is, high air permeability.

Effect of Embodiment 1

The soundproof structure 10 shown in Embodiment 1 has not only a high sound absorption effect by the soundproof cell 18 but also an effect that the sound emitted from the film of the soundproof cell 18 and the sound passing through the tubular body 22, that is, the sound transmitted through the soundproof cell 18 interfere with each other to cause high reflection. Therefore, a high transmission loss can also be obtained.

Figure 20A:
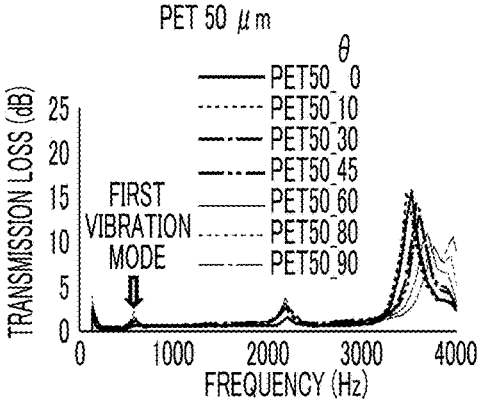
FIG. 20A is a graph showing the inclination angle dependency of the film surface of the sound insulation characteristics of a soundproof cell, which has films with different thicknesses, of the soundproof structure of the present invention.
Figure 20B:
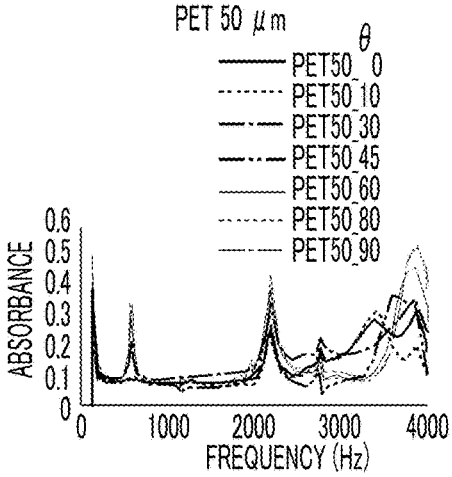
FIG. 20B is a graph showing the inclination angle dependency of the film surface of the sound absorption characteristics of a soundproof cell, which has films with different thicknesses, of the soundproof structure of the present invention.
Figure 20C:
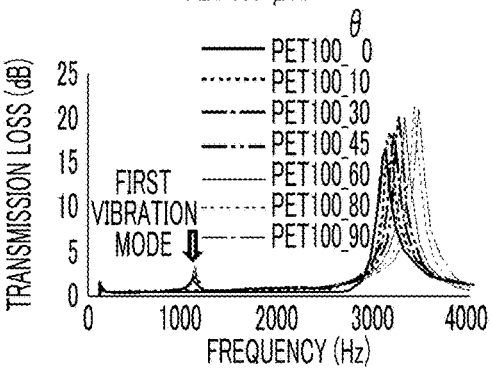
FIG. 20C is a graph showing the inclination angle dependency of the film surface of the sound insulation characteristics of a soundproof cell, which has films with different thicknesses, of the soundproof structure of the present invention.
Figure 20D:
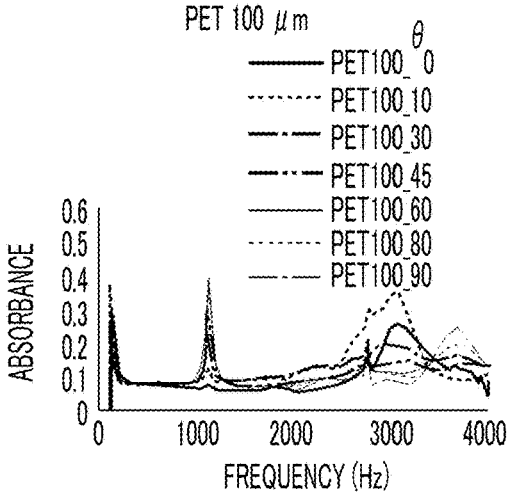
FIG. 20D is a graph showing the inclination angle dependency of the film surface of the sound absorption characteristics of a soundproof cell, which has films with different thicknesses, of the soundproof structure of the present invention.
Figure 20E:
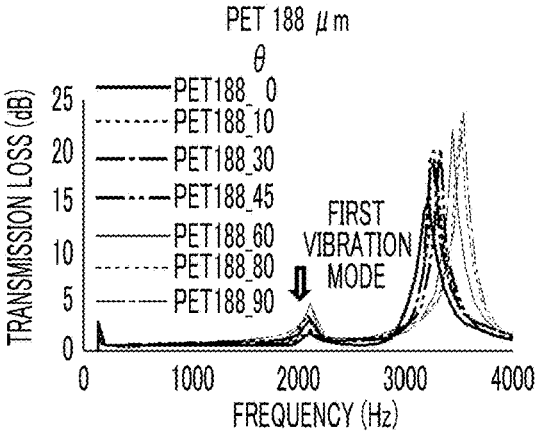
FIG. 20E is a graph showing the inclination angle dependency of the film surface of the sound insulation characteristics of a soundproof cell, which has films with different thicknesses, of the soundproof structure of the present invention.
Figure 20F:
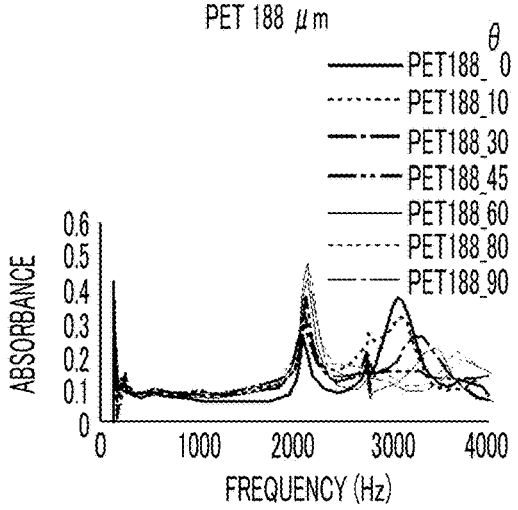
FIG. 20F is a graph showing the inclination angle dependency of the film surface of the sound absorption characteristics of a soundproof cell, which has films with different thicknesses, of the soundproof structure of the present invention.

In FIGS. 20A to 20F, in a soundproof structure (single side PET 50 μm/100 μm/188 μm) having the same configuration as the soundproof structure 10 shown in Embodiment 1, at a second natural vibration frequency (2000 to 4000 Hz), the transmission loss shown in FIGS. 20A, 20C, and 20E is a very large value of 5 to 25 dB even though the absorbance of sound (sound absorption rate) shown in FIGS. 20B, 20D, and 20F is equal to or less than 50% (corresponding to the transmission loss of 3 dB). This is because the sound emitted from the film of the soundproof cell 18 and the sound transmitted through the soundproof cell 18 interfere with each other to cause high reflection.

The details of FIGS. 20A to 20F will be described later.

Effect of Embodiment 2

Figure 12A:
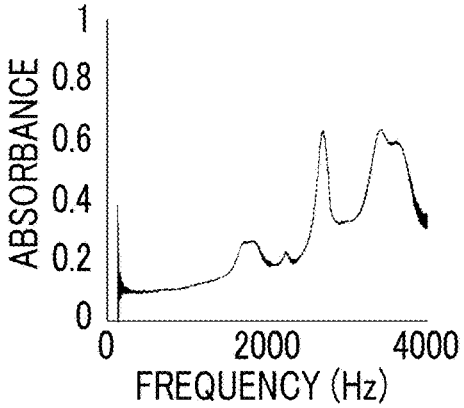
FIG. 12A is a graph showing the sound absorption characteristics expressed by the absorbance of the soundproof structure shown in FIG. 4 with respect to the frequency.
Figure 12B:
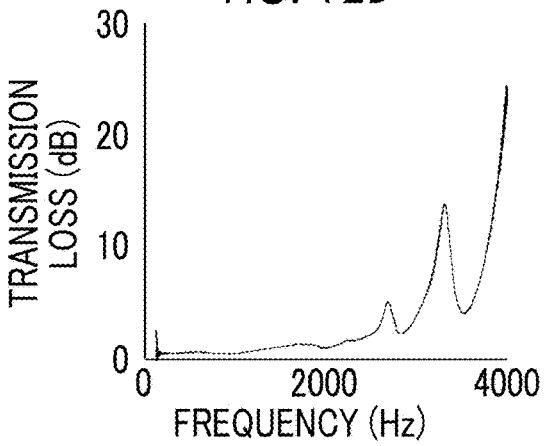
FIG. 12B is a graph showing the sound insulation characteristics expressed by the transmission loss of the soundproof structure shown in FIG. 4 with respect to the frequency.

FIG. 12A is a graph showing the sound absorption characteristics of the soundproof structure 10A of Embodiment 2, and FIG. 12B is a graph showing the sound insulation characteristics of the soundproof structure 10A of Embodiment 2.

In the soundproof structure 10A of Embodiment 2, three peaks of absorption of sound waves at which the absorbance becomes a peak (maximum) appear from the low frequency side as shown in FIG. 12A, and three peaks of shielding of sound waves at which the transmission loss becomes a peak (maximum) appear from the low frequency side as shown in FIG. 12B.

Therefore, in the soundproof structure 10A of Embodiment 2, since the sound absorption (absorbance) becomes a peak (maximum) at the three absorption peak frequencies, it is possible to selectively insulate sound in a predetermined frequency band centered on each absorption peak frequency. In addition, since the shielding (transmission loss) becomes a peak (maximum) at the three shielding peak frequencies, it is possible to selectively insulate sound in a predetermined frequency band centered on each shielding peak frequency.

In the measurement of the acoustic characteristics shown in FIGS. 12A and 12B, the absorbance and the transmission loss (dB) in the soundproof structure 10A of Embodiment 2 were measured as follows.

Figure 13:
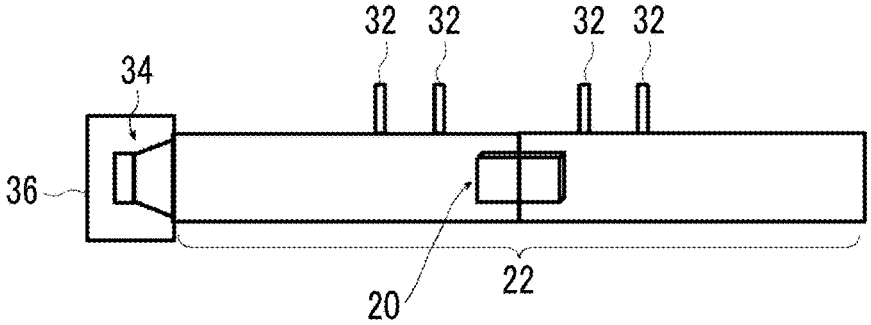
FIG. 13 is a perspective view illustrating an example of a measurement system for measuring the soundproofing performance of a soundproof cell unit inserted and disposed in a tubular opening member of the soundproof structure of the present invention.

As shown in FIG. 13, the acoustic characteristics were measured by a transfer function method using four microphones in an aluminum acoustic tube (tubular body 22). This method is based on "ASTM E2611-09: Standard Test Method for Measurement of Normal Incidence Sound Transmission of Acoustical Materials Based on the Transfer Matrix Method". As the acoustic tube, for example, the aluminum tubular body 22 based on the same measurement principle as WinZac manufactured by Nitto Bosei Aktien Engineering Co., Ltd. was used. A cylindrical box 36 containing a speaker 34 was disposed inside the tubular body 22, and the tubular body 22 of the box 36 was placed. The sound with a predetermined sound pressure was output from the speaker 34, and was measured using four microphones 32. It is possible to measure the sound transmission loss in a wide spectral band using this method. The soundproof structure 10A of Embodiment 2 was formed by arranging the soundproof cell unit 20 of Embodiment 2 at a predetermined measurement portion of the tubular body 22 serving as an acoustic tube so that the film surface of the film 16 (17) of the soundproof cell 18A (18) was inclined, and the sound absorbance and the transmission loss were measured in the range of 100 Hz to 4000 Hz.

FIG. 12A shows the sound absorption characteristics of the soundproof structure 10A shown in FIG. 4 that are expressed by the absorbance with respect to the frequency, and FIG. 12B shows the sound insulation characteristics of the soundproof structure 10A shown in FIG. 4 that are expressed by the transmission loss with respect to the frequency.

Figure 14:
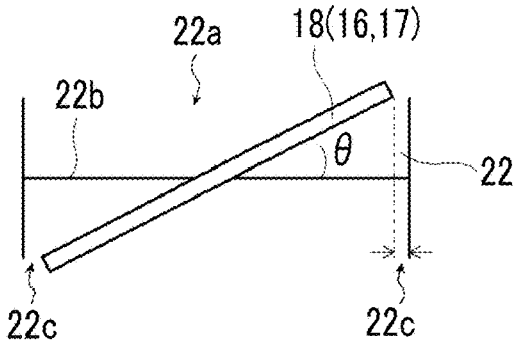
FIG. 14 is an explanatory view illustrating the inclination angle of the film surface of a soundproof cell with respect to the opening cross section of the opening member of the soundproof structure of the present invention.

As shown in FIG. 4, in the soundproof structure 10A of Embodiment 2 of the present invention used for acoustic measurement, the soundproof cell unit 20 is disposed in the aluminum tubular body 22 having a diameter of 4 cm so that the film surface of the film 16 is inclined with respect to the opening cross section 22*b* of the tubular body 22 (refer to FIG. 14). In the soundproof cell unit 20, a 250-μm PET film serving as the film 16 is fixed to one surface of the hole portion 12 of the acrylic frame 14 having a thickness of 12 mm, in which six hole portions 12 penetrating therethrough each having a size of 20 mm square are provided, by a double-sided adhesive tape. There are six consecutive soundproof cells. The height of the soundproof cell unit 20 and the height of the frame 14 (that is, $L_1+L_4\times2$ in FIG. 3) are 35 mm.

In the soundproof structure 10A of Embodiment 2, as shown in FIG. 12A, it can be seen that there are absorption peaks at about 1776 Hz, about 2688 Hz, and about 3524 Hz. In addition, as shown in FIG. 12B, it can be seen that there are shielding peaks at about 2669 Hz, about 3298 Hz, and about 4000 Hz.

Even with such a high opening ratio, the film 16 formed of a PET film can vibrate with respect to sound waves, and it is possible to provide high absorption and shielding performance for specific frequencies.

The opening ratio of the soundproof structure of the present invention is defined by the following Equation (1). In the soundproof structure 10A of Embodiment 2, the opening ratio defined by the following Equation (1) is about 67%. Accordingly, it is possible to obtain high air permeability or ventilation.

$$\text{Opening ratio (\%)}=\{1-(\text{cross-sectional area/opening cross-sectional area of soundproof cell unit in opening cross section})\}\times100 \quad (1)$$

Figure 15A:
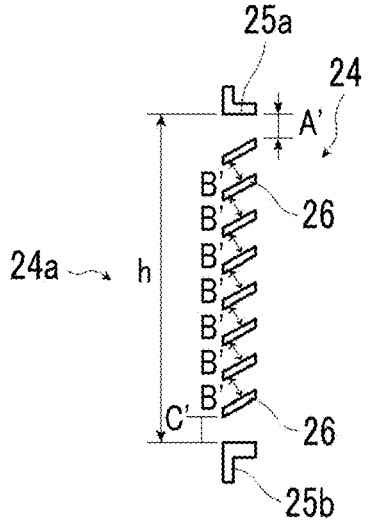
FIG. 15A is a schematic cross-sectional explanatory view of the opening member illustrating the opening ratio of the ventilation hole of the opening member in which the soundproof cell of the soundproof structure of the present invention is disposed.
Figure 15B:
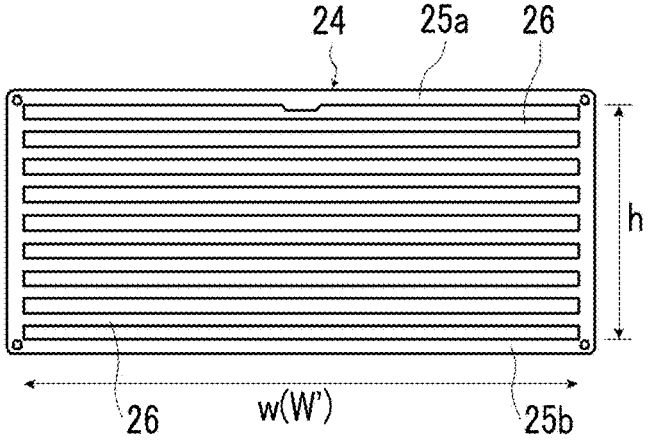
FIG. 15B is a schematic frontal explanatory view of the opening member illustrating the opening ratio of the ventilation hole of the opening member in which the soundproof cell of the soundproof structure of the present invention is disposed.

In a gully 24 shown in FIGS. 15A and 15B, the opening ratio (%) is calculated by dividing a ventilation hole area obtained by adding a projected area A'×W' represented by the product of an opening size A' and a width W' between an upper attachment portion 25*a* and an uppermost inclined portion 26, a projected area C'×W' that is the product of an opening size C' and the width W' between a lower attachment portion 25*b* and a lowermost inclined portion 26, and the total area 7×B'×W' between the adjacent inclined portions 26 among a plurality of inclined portions 26 (in FIGS. 15A and 15B, eight inclined portions 26) parallel to each other, that is, an opening area (A'+7×B'+C')×W', by an attachment area represented by the product of an attachment portion size h in the height direction and an attachment portion size w in the width direction, that is, an opening cross-sectional area (h×w). The opening ratio (%) is defined as in the following Equation (2).

$$\text{Opening ratio (\%)}=\{(A'+7\times B'+C')\times W'/(h\times w)\}\times 100 \quad (2)$$

In a case where the width W' is equal to the attachment portion size w in the width direction, the above Equation (2) is given by the following Equation (3).

$$\text{Opening ratio (\%)}=\{(A'+7\times B'+C')/h\}\times 100 \quad (3)$$

In the soundproof structure 10A of Embodiment 2, as shown in FIG. 14, the soundproof cell 18A (hereinafter, simply referred to as the soundproof cell 18) of the soundproof cell unit 20 is disposed in the tubular body 22, which is an opening member, so that the film surface of the film 16 (sheet-shaped film body 17) is inclined at a predetermined inclination angle θ with respect to the opening cross section 22*b* of the tubular body 22. A gap formed between the film surface of the film 16 (sheet-shaped film body 17) of the inclined soundproof cell 18 shown in FIG. 14 and the tube wall of the tubular body 22 serves as a ventilation hole through which the gas formed in the opening 22*a* of the tubular body 22 can pass.

In the present invention, the opening ratio of the ventilation hole is preferably 10% or more, more preferably 25% or more, and even more preferably 50% or more.

The reason why the opening ratio of the ventilation hole is preferably 10% or more is that the opening ratio of a commercially available air-permeable soundproof member (AirTooth (registered trademark)) is about 6%, but the soundproof structure of the present invention can exhibit high soundproofing performance even with the opening ratio of 2 digits or more which has not been conventionally possible (in a commercially available product).

The reason why the opening ratio of the ventilation hole is preferably 25% or more is that the soundproof structure of the present invention can exhibit high soundproofing performance even with the opening ratio of 25% to 30% of a standard sash or gully.

The reason why the opening ratio of the ventilation hole is preferably 50% or more is that the soundproof structure of the present invention can exhibit high soundproofing performance even with the opening ratio of 50% to 80% of a highly air-permeable sash or gully.

In the present invention, the inclination angle θ is preferably 20° or more, more preferably 45° or more, and even more preferably 80° or more, from the viewpoint of air permeability.

The reason why the inclination angle θ is preferably 20° or more is as follows. In a case where the device cross section (film surface of the film 16) of the soundproof cell 18 of the soundproof cell unit 20 is equal to the opening cross section 22*b*, it is possible to obtain a preferable opening ratio of 10% or more by increasing the inclination angle θ to 20° or more. In addition, as shown in FIG. 16, it is possible to obtain a wind speed of 10% or more with respect to the wind speed in a case where the inclination angle θ is 90°.

Figure 17:
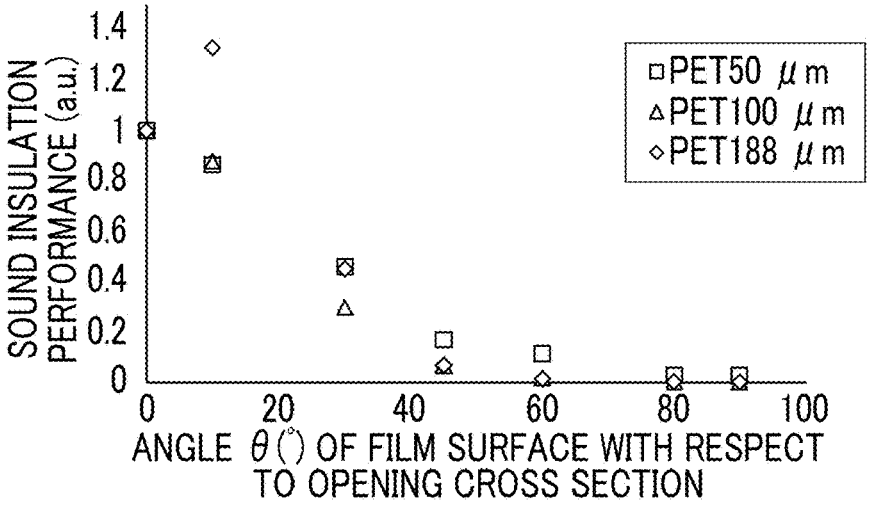
FIG. 17 is a graph showing the inclination angle dependency of the film surface of the sound insulation performance of the soundproof structure of the present invention.

In a case where the inclination angle θ is 20° to 45°, a sound insulation peak of the first vibration mode of the low frequency is present. As shown in FIG. 17, the sound insulation performance of 10% or more can be maintained with respect to the maximum sound insulation (θ=0°), which is preferable.

The reason why the inclination angle θ is preferably 45° or more is that the angle of the standard sash or gully considering ventilation is about 45°. The reason why the inclination angle θ is more preferably 80° or more is that the influence of constant pressure applied to the film 16 by the wind can be minimized and a change in soundproofing characteristics can be suppressed even if the wind speed increases. In addition, as shown in FIG. 16, in a case where the inclination angle θ is 80° or more, a reduction in the wind speed is eliminated, and a state with the highest ventilation capability is obtained.

Figure 16:
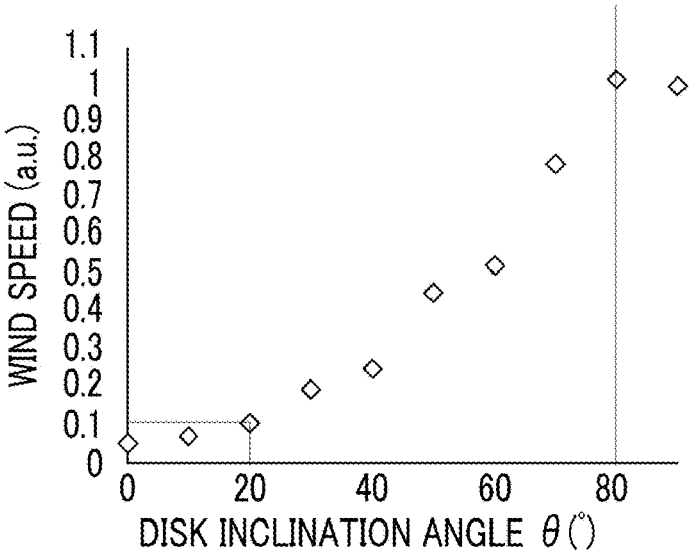
FIG. 16 is a graph showing the wind speed with respect to the inclination angle of a disk corresponding to the film surface, which is measured by flow rate measurement shown in FIGS. 18A and 18B.
Figure 18A:
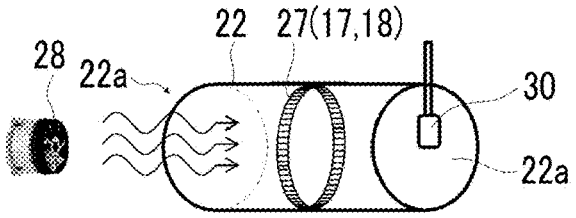
FIG. 18A is a side perspective view illustrating a flow rate measuring system for measuring the flow rate of a fluid passing through the ventilation hole of the opening member by the inclination angle of the film surface of the soundproof cell disposed in the opening member of the soundproof structure of the present invention.
Figure 18B:
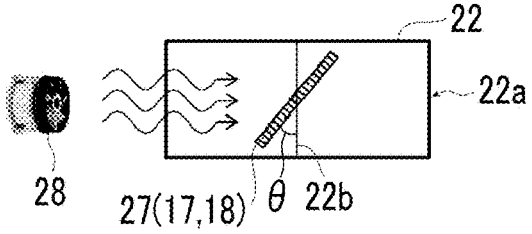
FIG. 18B is a top view illustrating the flow rate measuring system shown in FIG. 18A.

Here, the wind speed with respect to the inclination angle of a disk corresponding to the film surface shown in FIG. 16 is measured by a flow rate measuring system shown in FIGS. 18A and 18B.

In the flow rate measuring system shown in FIGS. 18A and 18B, a disk 27 corresponding to the sheet-shaped film body 17 forming the film 16 is disposed inside the tubular body 22 so as to be inclined at the inclination angle θ, an air blower 28 is disposed on one opening end side of the opening 22*a* of the tubular body 22, and an anemometer 30 is disposed at the other opening end. Air is blown from the air blower 28 at a predetermined wind speed, and the wind speed is measured by the anemometer 30.

As the inclination angle θ increases, the gap formed between the disk 27 and the tube wall of the tubular body 22 becomes large, and the ventilation hole also becomes large. As a result, the wind speed increases. In a case where the inclination angle θ becomes 90°, the ventilation hole becomes the maximum and the wind speed becomes the maximum (1.68 m/s). In the graph shown in FIG. 16, the wind speed on the vertical axis is normalized by the wind speed in a case where the inclination angle θ is 90°. The angle dependency of the wind speed greatly changes depending on the diameter of the disk 27 or the opening ratio. In the present invention, the angle dependency of the wind speed is estimated under the conditions considered that the attenuation ratio is the highest (disk cross section=opening cross section, diameter of the disk 27=inner diameter of the tubular body 22).

Figure 19:
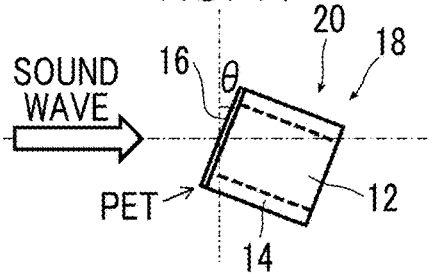
FIG. 19 is an explanatory view illustrating the relationship between the inclination angle of the film surface of the soundproof cell of the soundproof structure of the present invention and the movement direction of sound waves.

Then, as shown in FIG. 19, the inclination angle dependency of the film surface in the sound insulation performance of the soundproof structure shown in FIG. 17 can be obtained by measuring the transmission loss by changing the inclination angle θ of the soundproof cell 18 of the soundproof cell unit 20 of the soundproof structure 10A of Embodiment 2, that is, the soundproof cell 18 of the soundproof structure 10 of Embodiment 1 with respect to the movement direction of sound waves of the film surface of the film 16 fixed to one surface of the hole portion 12 of the frame 14.

In this method, for the soundproof cell 18 using PET films having three different thicknesses of 50 μm, 100 μm, and 188 μm as the film 16, the results of measurement of the transmission loss performed by the measurement system shown in FIG. 13 while changing the inclination angle θ in the range of 0° to 90° are shown in FIGS. 20A, 20C, and 20E, and the results of measurement of the absorbance performed by the measurement system shown in FIG. 13 while changing the inclination angle θ in the range of 0° to 90° are shown in FIGS. 20B, 20D, and 20F.

From the transmission loss measurement results shown in FIGS. 20A, 20C and 20E, it is possible to obtain a graph of the angle dependency of the first vibration mode sound insulation performance shown in FIG. 17. The sound insulation performance on the vertical axis in FIG. 17 is standardized by the transmission loss at the time of 0°.

As shown in FIG. 17, in a case where the inclination angle θ is 45° or less, it can be seen that the sound insulation performance of the first vibration mode, which is advantageous for low-frequency sound insulation, can be maintained at 10% or more for maximum sound insulation (θ=0°).

Figure 21:
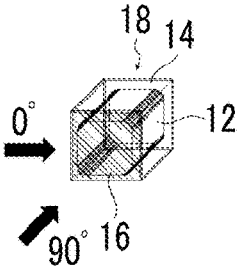
FIG. 21 is a perspective view illustrating the relationship between the inclination angle of the film surface of the soundproof cell of the soundproof structure of the present invention and the movement direction of sound waves.

In addition, the sound wave incidence angle dependency of the sound insulation characteristics (transmission loss) was calculated by measuring the transmission loss using the measurement system shown in FIG. 13 while inclining the film surface of one soundproof cell forming the soundproof cell unit 20 of Embodiment 2, that is, the soundproof cell 18 of the soundproof structure 10 of Embodiment 1 with respect to the movement direction of the sound wave indicated by the arrow at a predetermined inclination angle as shown in FIG. 21.

Figure 22:
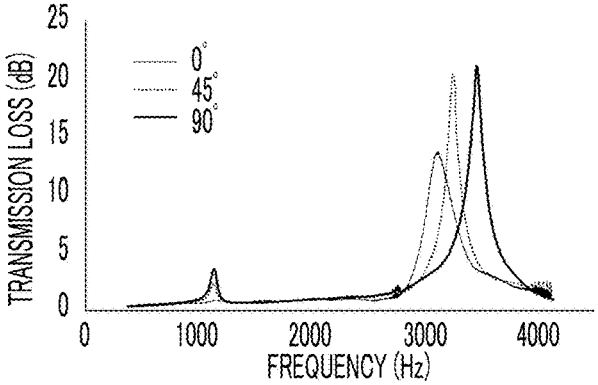
FIG. 22 is a graph showing the sound wave incidence angle dependency of the sound insulation characteristics (transmission loss) of the soundproof cell of the soundproof structure of the present invention.

FIG. 22 shows the obtained sound wave incidence angle dependency of the sound insulation characteristics (transmission loss) of the soundproof cell of the soundproof structure 10 of Embodiment 1.

The soundproof cell 18 for which the measurement has been performed has the same configuration as the soundproof cell 18 in the soundproof cell unit 20 of Embodiment 2. However, a PET film having a thickness of 100 μm serving as the film 16 is fixed to one surface of the frame 14, in which the hole portion 12 of 16×16 mm penetrating therethrough is formed in a 20-mm cubic block (frame member 15) formed of vinyl chloride, by a double-sided adhesive tape. The soundproofing performance (transmission loss) of the soundproof cell 18 was measured while changing the sound wave incidence angle in a state in which the film surface of the film 16 was inclined with respect to the opening cross section 22*b* of the tubular body 22 in the tubular body 22 serving as an acoustic tube. It can be seen that the shielding peak frequency on the high frequency side is shifted to low frequencies of about 3465, about 3243, and about 3100 Hz as the sound wave incidence angle with respect to the film surface of the film 16 of the soundproof cell 18 is changed to 90°, 45°, and 0°.

Thus, it can be seen that the shielding peak frequency can be adjusted by inclining the film surface of the film 16 with respect to the opening cross section 22*b*.

Effect of Embodiment 3

As in Embodiment 1, the soundproof structure 10B shown in Embodiment 3 has not only a high sound absorption effect by the soundproof cell 18B but also an effect that the sound emitted from the soundproof cell 18B and the sound passing through the tubular body 22, that is, the sound transmitted through the film of the soundproof cell 18B interfere with each other to cause high reflection. Therefore, a high transmission loss can also be obtained.

The soundproof structure of the modification example of Embodiment 3 also has the same effect as the soundproof structure 10B of Embodiment 3.

Figure 34A:
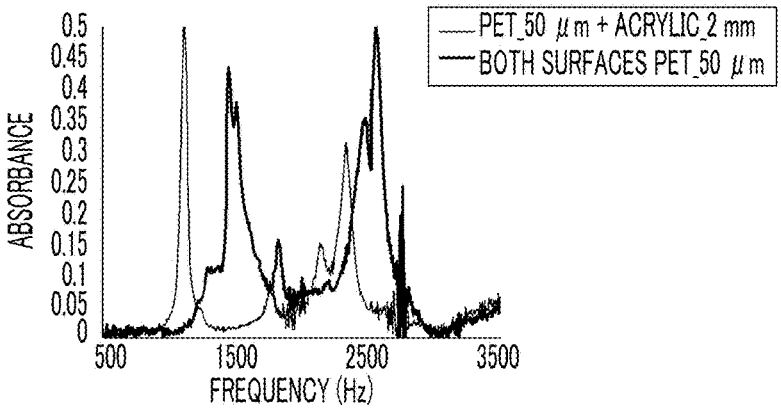
FIG. 34A is a graph showing the sound absorption characteristics of another example of the soundproof structure shown in FIG. 3.
Figure 34B:
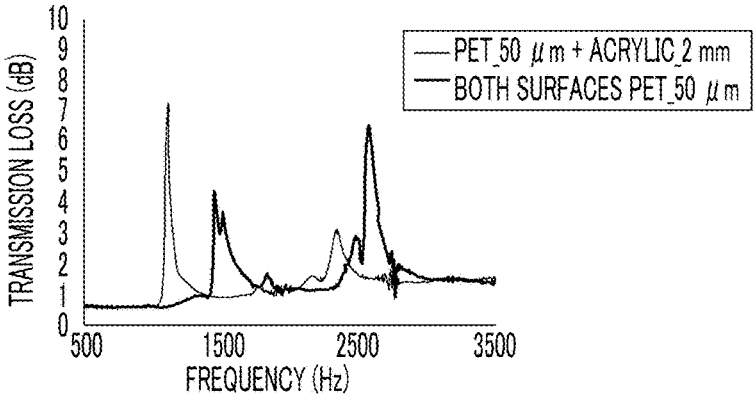
FIG. 34B is a graph showing the sound insulation characteristics of another example of the soundproof structure shown in FIG. 3.

In the soundproof structure (double-sided PET 50 μm) having the same configuration as the soundproof structure 10B shown in Embodiment 3, as shown in FIG. 34A, in the vicinity of about 1500 Hz, the transmission loss shown in FIG. 34B is as high as 4 to 5 dB even though the sound absorption rate is about 45% (corresponding to the transmission loss of 2 dB). The details of FIGS. 34A and 34B will be described later.

Also in the soundproof structure (PET 50 μm+acrylic 2 mm) having the same configuration as the soundproof structure 10B shown in the modification example of Embodiment 3, as shown in FIG. 34A, in the vicinity of about 1100 Hz, the transmission loss shown in FIG. 34B is as high as 7 dB even though the sound absorption rate is about 50% (corresponding to the transmission loss of 2 dB).

This is because the sound emitted from the film of the soundproof cell 18 and the sound transmitted through the soundproof cell 18 interfere with each other to cause high reflection.

Effect of Embodiment 4

Figure 23A:
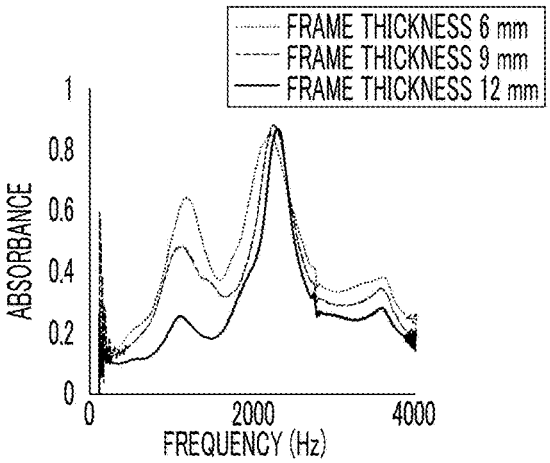
FIG. 23A is a graph showing the sound absorption characteristics of the soundproof structure shown in FIG. 8.
Figure 23B:
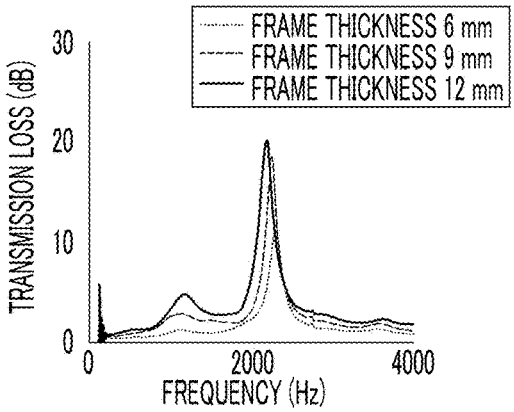
FIG. 23B is a graph showing the sound insulation characteristics of the soundproof structure shown in FIG. 8.

FIG. 23A is a graph showing the sound absorption characteristics of the soundproof structure 10C of Embodiment 4 shown in FIG. 8, and FIG. 23B is a graph showing the sound insulation characteristics of the soundproof structure 10C of Embodiment 4.

Although the soundproof cell unit 20C of the soundproof structure 10C according to Embodiment 4 shown in FIG. 8 has the same configuration as the soundproof cell unit 20A of the soundproof structure 10A of Embodiment 2, a PET film having a thickness of 250 μm is fixed to both surfaces of the frame 14 by a double-sided adhesive tape, and serves as the films 16*a* and 16*b*.

FIGS. 23A and 23B show the measurement results of the absorbance and the transmission loss measured by the measurement system shown in FIG. 13 in a case where the thickness of the frame 14 of the soundproof cell unit 20C is changed to 6 mm, 9 mm, and 12 mm, respectively. There are very high absorption peaks (about 1143 Hz and about 2150 Hz) on the low frequency side compared with the results of Embodiment 2 shown in FIGS. 12A and 12B. It can be seen that absorption at the peak on the low frequency side (about 1143 Hz) is increased by increasing the thickness of the frame 14. On the other hand, as the sound insulation characteristics, it can be seen that the transmission loss is also increased by increasing the thickness of the frame 14 since there are shielding peaks at about 1143 Hz and 2196 Hz.

Thus, it is possible to obtain the absorption peak on the low frequency side by forming the films 16*a* and 16*b* by bonding a PET film to both surfaces of the frame 14, which is preferable compared with Embodiment 2. In addition, by closing both the surfaces with the PET films 16*a* and 16*b*, it is possible to prevent dust from entering the hole portion 12 of the frame 14, which is preferable.

Figure 24A:
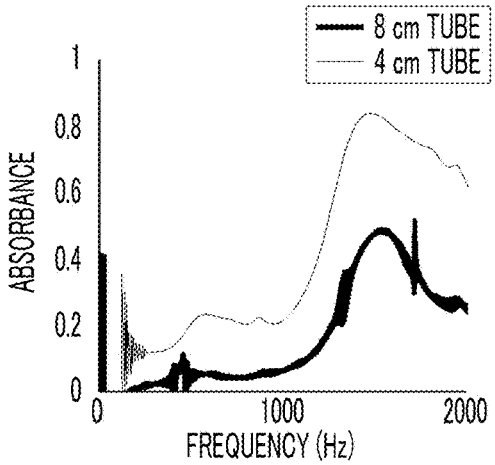
FIG. 24A is a graph showing the sound absorption characteristics of a soundproof cell in a case where a soundproof cell is disposed in acoustic tubes having different sizes that form an opening member of another example of the soundproof structure shown in FIG. 8.
Figure 24B:
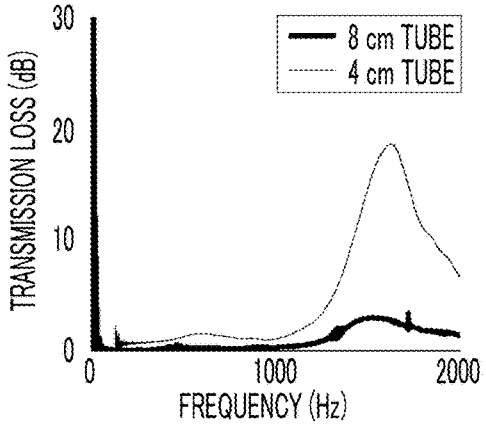
FIG. 24B is a graph showing the sound insulation characteristics of a soundproof cell in a case where a soundproof cell is disposed in acoustic tubes having different sizes that form an opening member of another example of the soundproof structure shown in FIG. 8.

Next, similarly to the structure of the soundproof cell unit 20C of Embodiment 4, another example of the soundproof structure 10C is constructed by arranging a soundproof cell unit 20C configured to include five soundproof cells 18C, in which the PET film 16 (16*a* and 16*b*) having a thickness of 188 μm is fixed to both surfaces of the frame 14 in which five hole portions 12 of 25 mm square penetrating therethrough are drilled, in the tubular body 22 serving as an acoustic tube having inner diameters of 8 cm and 4 cm, and the measurement results of the absorbance and the transmission loss measured by the measurement system shown in FIG. 13 are shown in FIGS. 24A and 24B, respectively.

As shown in FIGS. 24A and 24B, it can be seen that the absorbance and the transmission loss become smaller as the inner diameter of the acoustic tube becomes larger. However, since the thickness and the height of the frame 14 are 12 mm and 36 mm, the opening ratio according to the above Equation (1) is 91% in the case of an 8-cm acoustic tube and 66% in the case of a 4-cm acoustic tube. Even though the opening ratio is as high as 91%, sound absorption as high as 45% is possible at about 1570 Hz.

Figure 25:
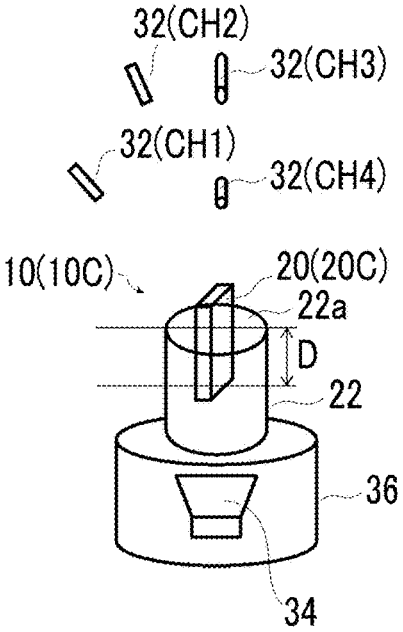
FIG. 25 is a perspective view illustrating an example of a measurement system for measuring the soundproofing performance of a soundproof cell unit inserted and disposed in a tubular opening member of the soundproof structure of the present invention.
Figure 26:
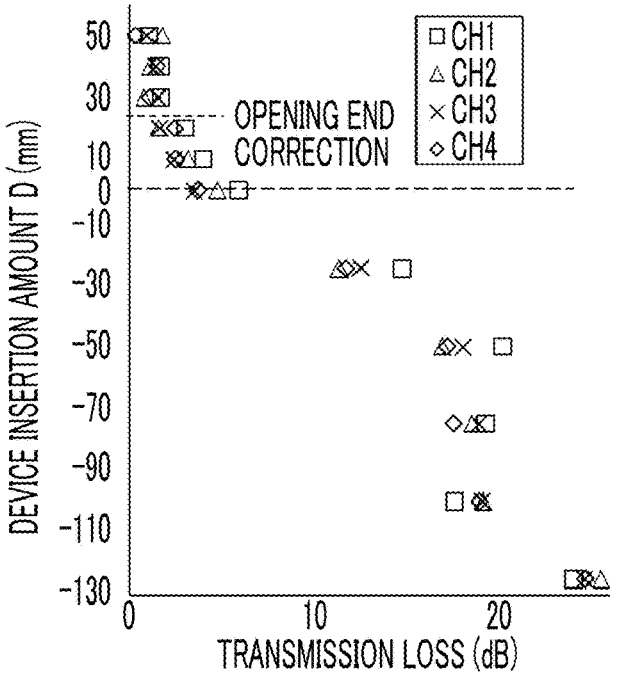
FIG. 26 is a graph showing the relationship between the insertion amount of the soundproof cell unit into the tubular opening member, which is measured by the measurement system shown in FIG. 13, and the soundproofing performance (transmission loss).

With the same configuration as in Embodiment 4, the soundproofing performance was measured in a case where the soundproof cell unit 20C, in which the PET film 16 (16*a* and 16*b*) having a thickness of 188 μm was fixed to both surfaces of the frame 14 having a width of 150 mm in which five hole portions 12 of 25 mm square penetrating therethrough were drilled in two columns, was inserted into the tubular body 22 having an inner diameter of 8 cm as shown in FIG. 25. FIG. 26 shows the amount of loss (dB) (20×log (sound pressure in a case where there is no cell unit 20C/sound pressure in a case where the cell unit 20C is present)) in a case where the soundproof cell unit 20C is inserted.

As shown in FIG. 26, it can be seen that soundproofing of about 20 dB is possible just by inserting the two soundproof cells 18C (device insertion amount D=50 mm) In addition, it can be seen that the soundproofing performance of 5 dB is obtained even in a state protruding from the tubular body 22 (D≥0 mm).

The antinode of the standing wave of the sound field is located outside the opening 22*a* of the tubular body 22 by the distance of opening end correction. Therefore, the soundproofing performance can be obtained even outside the tubular body 22. In the case of the cylindrical tubular body 22, the opening end correction distance is approximately 0.61×tube radius, which is about 24 mm in the present experimental example.

Figure 27:
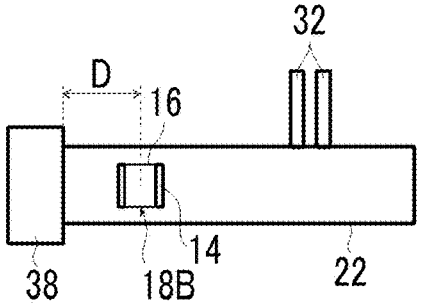
FIG. 27 is a perspective view illustrating an example of a measurement system for measuring the soundproofing performance of a soundproof structure in which one end of the tubular opening member of the soundproof structure of the present invention is a fixed end.

Next, one soundproof cell 18C forming the soundproof cell unit 20C of Embodiment 4, that is, the soundproof cell 18B which was the same soundproof cell 18B as in Embodiment 3 and in which the PET film 16 (16*a* and 16*b*) having a film thickness of 188 μm was fixed to both surfaces of the frame 14 having a frame size of 16 mm and a frame thickness of 20 mm, was inserted into the tubular body 22 serving as an acoustic tube having an inner diameter of 4 cm, and an aluminum plate having a thickness of 5 cm was disposed on the end surface of the tubular body 22 as a wall 38, as shown in FIG. 27. A predetermined sound pressure was output from the opening portion side of the tubular body 22, and the soundproofing performance (absorbance) was measured using two microphones 32. In addition, the absorbance of the soundproof cell 18B was measured by changing a distance D between the soundproof cell 18B and the wall 38.

Figure 28:
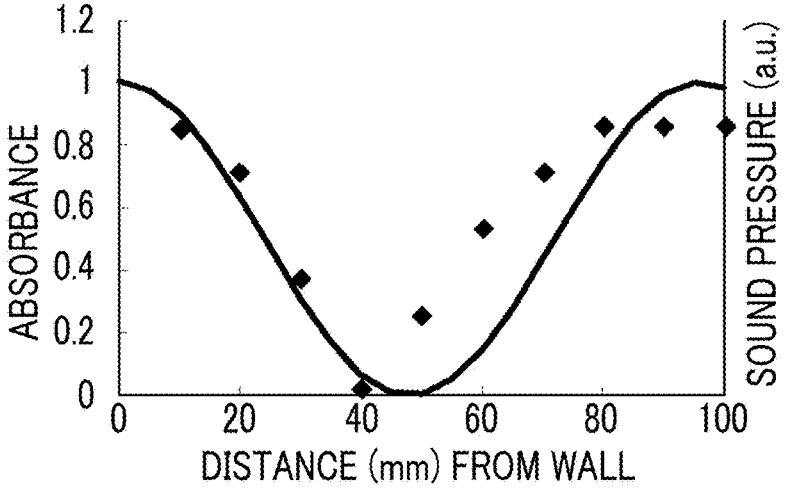
FIG. 28 is a graph showing the sound absorption characteristics expressed by the sound absorption rate with respect to the distance between the arrangement position of the soundproof cell of the soundproof structure of the present invention and the wall surface, which is measured by the measurement system shown in FIG. 27.

The relationship between the distance D from the wall 38 of the soundproof cell 18B and the sound absorption rate of the soundproof cell 18B is shown in the point plot in FIG. 28.

The solid line shown in FIG. 28 is the sound pressure distribution of standing waves formed on the tubular body 22 by the sound wave of about 1785 Hz that is the first natural vibration frequency of the film fixed to the soundproof cell 18B. Since the wall 38 serves as a fixed end of the sound wave, the sound pressure of the wall surface of the wall 38 is the maximum, that is, becomes the antinode of the standing wave. In addition, the sound pressure at a position of λ/4 away from the wall surface of the wall 38 is the minimum, that is, becomes the node of the standing wave.

From FIG. 28, it can be seen that the sound absorption rate is high in a case where the soundproof cell 18B is disposed at a position where the sound pressure is high (antinode of the standing wave) in the tubular body 22 that is an opening member and low in a case where the soundproof cell 18B is disposed at a position where the sound pressure is low (node of the standing wave) in the tubular body 22.

That is, it can be seen that a large sound absorption effect can be obtained in a case where the soundproof cell 18B is disposed at the position of the antinode of the standing wave formed on the tubular body 22 by the sound wave of the first natural vibration frequency of the soundproof cell 18B.

Figure 29:
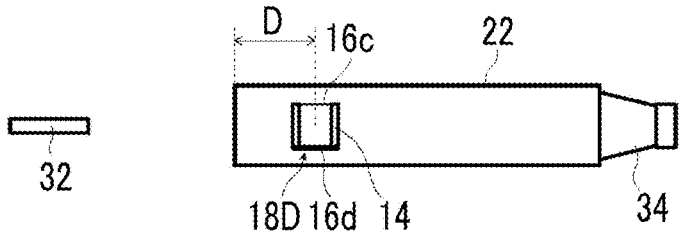
FIG. 29 is a perspective view illustrating an example of a measurement system for measuring the soundproofing performance (absorbance) of a soundproof structure in which one end of the tubular opening member of the soundproof structure of the present invention is an open end.

With the same configuration as one soundproof cell 18D forming the soundproof cell unit 20D of the modification example of Embodiment 5, the soundproof cell 18D in which the PET film 16*c* having a thickness of 50 μm was fixed to one surface of the frame 14 having a frame size of 16 mm and a frame thickness of 20 mm and an acrylic plate (film) having a film thickness of 2 mm was fixed to the other surface, was inserted into the tubular body 22 serving as an acoustic tube having an inner diameter of 4 cm, and the speaker 34 was disposed on the end surface of the tubular body 22, as shown in FIG. 29. A predetermined sound pressure was output, and the soundproofing performance (transmission loss) was measured using one microphone 32 disposed on the opening portion side. In addition, the transmission loss of the soundproof cell 18D was measured by changing the distance D of the soundproof cell 18D from the open end. The transmission loss was calculated from the sound pressure ratio between the sound pressure in a case where the soundproof cell 18D is disposed in the tubular body 22 and the sound pressure in a case where the soundproof cell 18D is not disposed in the tubular body 22.

Figure 30:
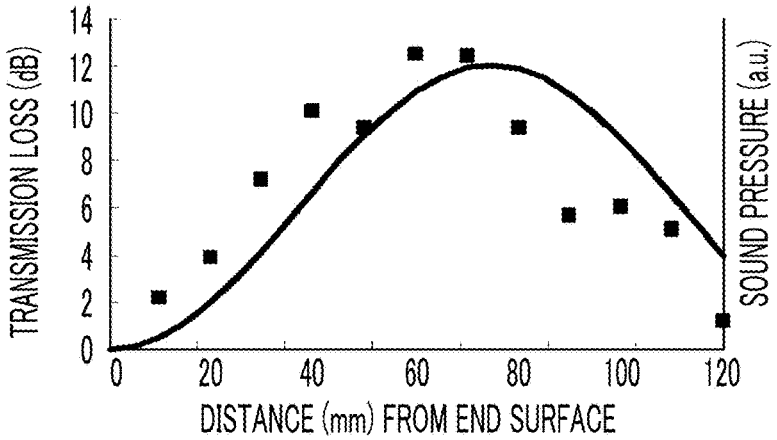
FIG. 30 is a graph showing the shielding characteristics (transmission loss) with respect to the distance between the arrangement position of the soundproof cell of the soundproof structure of the present invention and the end surface (open end), which is measured by the measurement system shown in FIG. 29.

The relationship between the distance D between the soundproof cell 18D and the open end of the tubular body 22 and the transmission loss at the transmission loss peak frequency of about 1135 Hz of the soundproof cell 18D is shown in the point plot in FIG. 30.

The solid line shown in FIG. 30 is the sound pressure distribution of standing waves formed on the tubular body 22 by the sound wave of about 1135 Hz that is the first natural vibration frequency of the film of the soundproof cell 18D. Since the end surface of the tubular body 22 shown in FIG. 29 is open unlike in the case of the tubular body 22 having a fixed end shown in FIG. 27, the end surface is the free end of the sound wave. Therefore, the sound pressure of the end surface of the tubular body 22 is the minimum, that is, becomes the node of the standing wave. In addition, the sound pressure at a position of λ/4 away from the end surface of the tubular body 22 is the maximum, that is, becomes the antinode of the standing wave.

However, the peak of the standing wave and the peak of the transmission loss plot in FIG. 30 are shifted by about 15 mm from each other. This is because the end of the standing wave is located outside the opening end by about 12 mm.

From FIG. 30, it can be seen that the transmission loss is large in a case where the soundproof cell 18D is disposed at a position where the sound pressure is high (antinode of the standing wave) in the tubular body 22 that is an opening member and low in a case where the soundproof cell 18D is disposed at a position where the sound pressure is low (node of the standing wave) in the tubular body 22.

That is, it can be seen that a large transmission loss can be obtained in a case where the soundproof cell 18D is disposed at the position of the antinode of the standing wave, which is formed on the tubular body 22 by the sound wave of the first natural vibration frequency of the soundproof cell 18D, in the tubular body 22 that is an opening member.

From the above-described results of FIGS. 28 and 30, it can be seen that not only the high sound absorption rate but also the high transmission loss can be obtained by arranging a soundproof cell at a position where the sound pressure is high (antinode of the standing wave) in the tubular body 22 that is an opening member. As shown in the result of FIG. 30, in a case where the open end of the tubular body 22 becomes the free end of the sound wave, the end of the standing wave is shifted to the outside of the opening end of the tubular body 22. Therefore, it is preferable to arrange the soundproof cell at a position where the distance between the end of the standing wave and the opening end (opening end correction distance) has been adjusted.

That is, as shown in the above-described result of FIG. 28, in the case of a soundproof structure in which the wall 38 is disposed on one end surface of the tubular body 22, the wall 38 serves as a fixed end of the sound wave. The soundproof cell is preferably disposed within λ/4 of the sound wave of the first natural vibration frequency of the soundproof cell 18 from the object (wall 38), more preferably disposed within λ/6 of the sound wave of the first natural vibration frequency of the soundproof cell 18 from the object (wall 38), and most preferably disposed within λ/8 of the sound wave of the first natural vibration frequency of the soundproof cell 18 from the object (wall 38).

On the other hand, as shown in the result of FIG. 30, in a case where the wall 38 is disposed on the open end of the tubular body 22, that is, in a case where the open end of the tubular body 22 is the free end of the sound wave, the soundproof cell is preferably disposed within λ/4 of the sound wave of the first natural vibration frequency of the soundproof cell—opening end correction distance of ±λ/4 from the open end, more preferably disposed within λ/4—opening end correction distance of ±λ/6 from the open end, and even more preferably disposed within λ/4—opening end correction distance of ±λ/8 from the open end.

Figure 31:
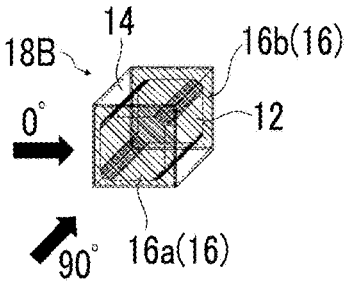
FIG. 31 is a perspective view illustrating the relationship between the inclination angle of the film surface of the soundproof cell of the soundproof structure of Embodiment 3 of the present invention and the movement direction of sound waves.

Next, the sound wave incidence angle dependency of the sound absorption characteristics (absorbance) was calculated by measuring the absorbance using the measurement system shown in FIG. 13 while inclining the film surface of one soundproof cell 18C forming the soundproof cell unit 20C of Embodiment 4, that is, the soundproof cell 18B of the soundproof structure 10B of Embodiment 3 with respect to the movement direction of the sound wave indicated by the arrow at a predetermined inclination angle as shown in FIG. 31.

Figure 32:
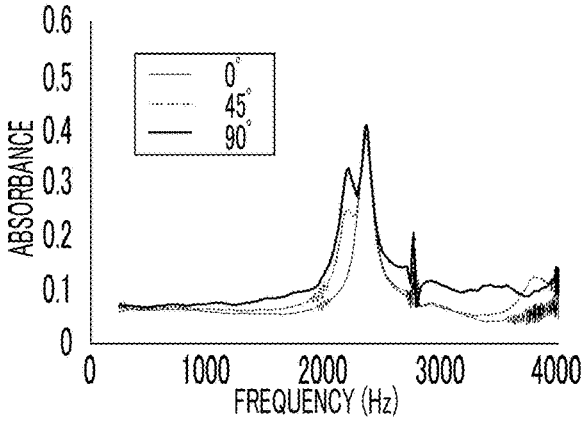
FIG. 32 is a graph showing the sound wave incidence angle dependency of the absorption characteristics (absorbance) of the soundproof cell of the soundproof structure of Embodiment 3 of the present invention.

FIG. 32 shows the obtained sound wave incidence angle dependency of the sound absorption characteristics (absorbance) of the soundproof cell 18B of the soundproof structure 10B of Embodiment 3.

In the soundproof cell 18B for which the measurement has been performed, the film 16 (16*a* and 16*b*) that is a PET film having a thickness of 100 μm is fixed to both surfaces of the frame 14, in which the hole portion 12 of 16×16 mm penetrating therethrough is formed in a 20-mm cubic block (frame member 15) formed of vinyl chloride, by a double-sided adhesive tape. The soundproofing performance (absorbance) of the soundproof cell 18B was measured while changing the sound wave incidence angle in a state in which the film surface of the film 16 (16*a* and 16*b*) was inclined with respect to the opening cross section 22*b* of the tubular body 22 within the tubular body 22 serving as an acoustic tube. It can be seen that the absorption peak frequency of 2339 Hz hardly changes even in a case where the incidence angle of the sound wave with respect to the film surface of the film 16 of the soundproof cell 18B is changed to 90°, 45°, and 0°.

The soundproof structures of Embodiments 3 and 4 are preferable in the case of insulating sound (other than a plane wave) randomly propagating through the tubular body 22 or sound waves of various incidence angle, such as a louver.

Effect of Embodiment 5

Figure 33A:
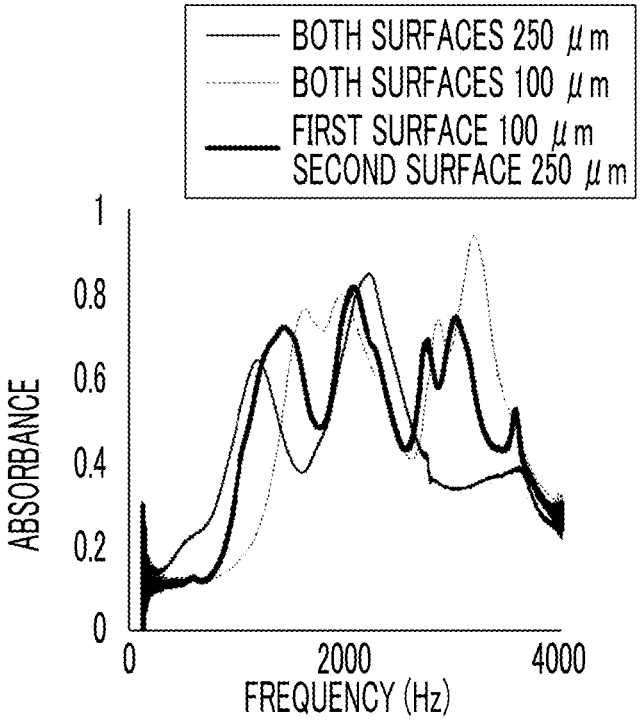
FIG. 33A is a graph showing the sound absorption characteristics of the soundproof structure shown in FIG. 8 (second example) and the soundproof structure (first example) shown in FIG. 10.
Figure 33B:
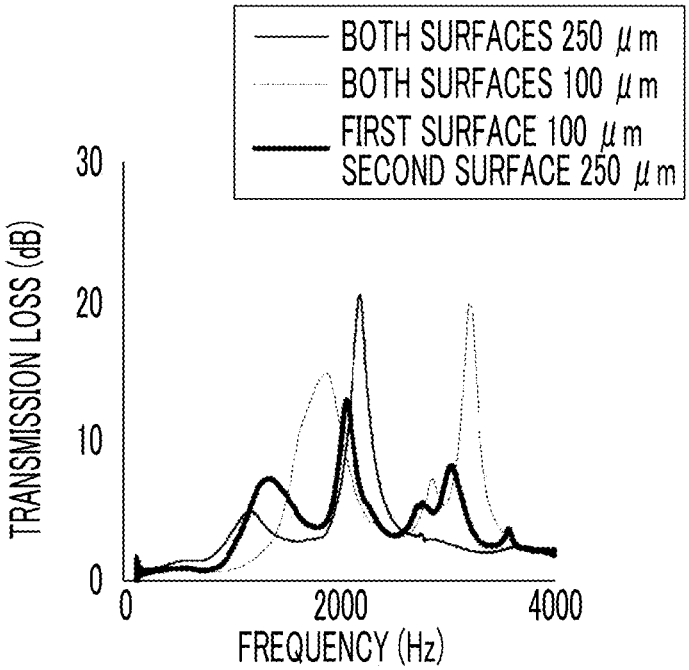
FIG. 33B is a graph showing the sound insulation characteristics of the soundproof structure (second example) shown in FIG. 8 and the soundproof structure (first example) shown in FIG. 10.

FIG. 33A is a graph showing the sound absorption characteristics of the soundproof structure 10C of Embodiment 4 shown in FIG. 8 and the soundproof structure 10D of Embodiment 5 shown in FIG. 10, and FIG. 33B is a graph showing the sound insulation characteristics of the soundproof structure 10C of Embodiment 4 shown in FIG. 8 and the soundproof structure 10D of Embodiment 5 shown in FIG. 10.

FIGS. 33A and 33B show the measurement results of the absorbance and the transmission loss of two soundproof structures 10C of Embodiment 4, in which PET films having thicknesses of 250 μm and 100 μm are respectively fixed as the film 16 (16*a* and 16*b*) to both surfaces of the frame 14 of the soundproof cell 18C of the soundproof structure 10C of Embodiment 4, and one soundproof structure 10D, in which a film 16*c* having a thickness of 100 μm is fixed to one surface (first surface) of the frame 14 of the soundproof cell 18D of the soundproof structure 10D of Embodiment 5 and a film 16*d* having a thickness of 250 μm is fixed to the other surface (second surface), using the measurement system shown in FIG. 13.

In the soundproof structure 10D of Embodiment 5, in both the absorbance and the transmission loss, absorption and shielding peaks in each of the two soundproof structures 10C of Embodiment 4 configured to include only PET films having thicknesses of 250 μm and 100 μm on both surfaces have a slight frequency shift, but are overlapping spectra.

Thus, as in the soundproof cell 18D, it is possible to broaden the band by changing the vibration conditions from those in the soundproof cell 18C, which is preferable.

In the case of the soundproof structure 10C of Embodiment 4 of a single PET film of 250 μm and 100 μm, the number of absorption/shielding peaks is two or one. However, it is possible to obtain three absorption/shielding peaks by combining the PET films of 250 μm and 100 μm as in the soundproof structure 10D of Embodiment 5.

In such Embodiment 5, by using PET films having different film thicknesses as the films 16, it is possible to obtain the absorption spectrum in which the absorbances of the respective films overlap each other. Such different resonance frequencies can be obtained by changing the film stiffness depending on not only the film thickness but also the film material or the size of the frame.

As an example, FIGS. 34A and 34B show the measurement results of the absorbance and the transmission loss of the soundproof cell 18D having a configuration in which the film 16*a* is a PET film having a thickness of 50 μm and the film 16*b* is an acrylic plate having a thickness of 2 mm so that the resonance frequencies of the two films 16 are greatly different, that is, a soundproof cell of the modification example of Embodiment 3, which have been measured using the measurement system shown in FIG. 13.

As shown in FIGS. 34A and 34B, the absorption peak and the transmission loss peak (about 1455 Hz) on the low frequency side in a case where the film 16 is a PET film with a thickness of 50 μm on both sides (that is, in the case of Embodiment 3) makes the resonance frequencies of the two films 16 greatly different (in the case of a PET film having a thickness of 50 μm+an acrylic plate having a thickness of 2 mm, that is, in the case of the modification example of Embodiment 3), it can be seen that a shift to the low frequency of about 1120 Hz occurs.

In a case where the films 16 on the both sides of Embodiment 3 have the same configuration, sound pressure distribution symmetrical to the closed space at the back of the film is considered to be caused by the film vibration of the same film resonance frequency. In contrast, in a case where the resonance frequencies of the two films 16 of the modification example of Embodiment 3 are made different, it is considered that the acoustic compliance of the closed space is increased to lower the frequency.

Figure 35A:
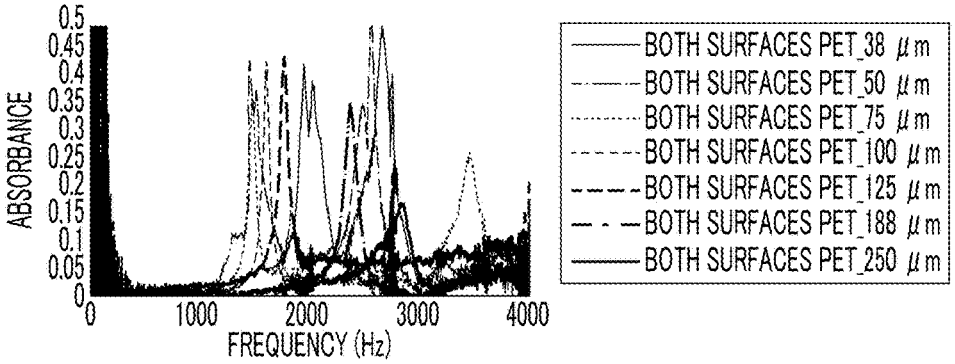
FIG. 35A is a graph showing the sound absorption characteristics of a soundproof cell, which has films with different thicknesses, of the soundproof structure shown in FIG. 3.
Figure 35B:
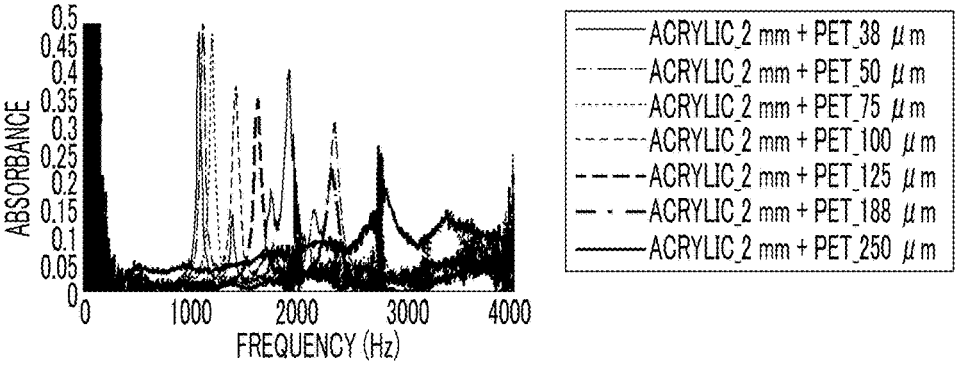
FIG. 35B is a graph showing the sound absorption characteristics of a soundproof cell, which has films with different thicknesses, of another example of the soundproof structure shown in FIG. 3.

FIG. 35A shows the measurement result of the absorbance, which has been measured by variously changing the thickness of the films 16 on both side using the measurement system shown in FIG. 13, in Embodiment 3 in which the film 16 of the soundproof cell 18B is a PET film on both sides. FIG. 35B shows the measurement result of the absorbance, which has been measured by variously changing the thickness of the PET film 16*c* using the measurement system shown in FIG. 13, in the modification example of Embodiment 3 in which the film 16*d* of the soundproof cell 18B is an acrylic plate having a thickness of 2 mm.

Figure 36:
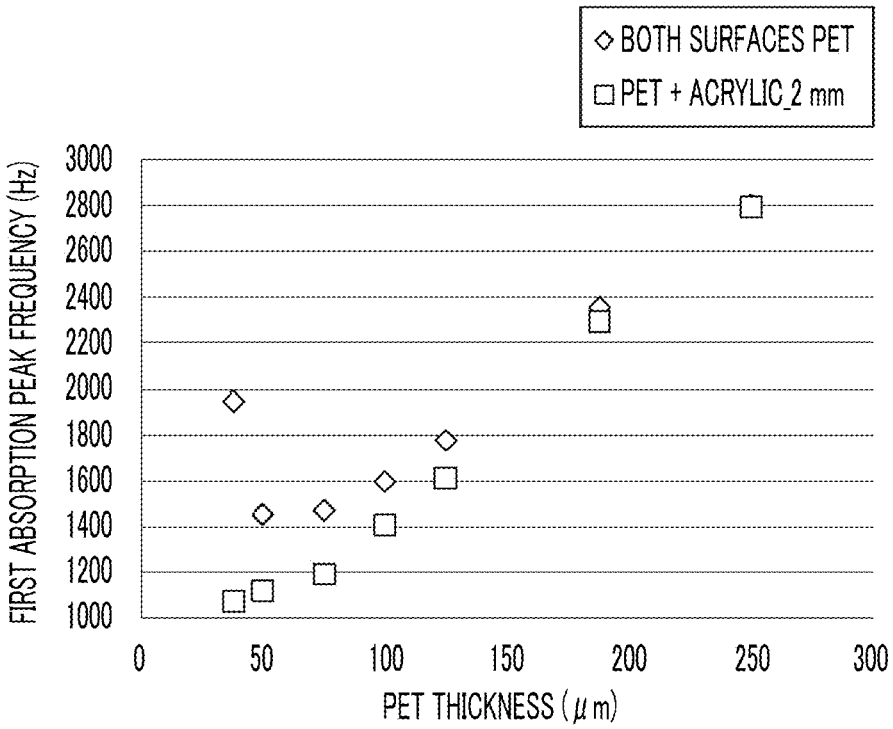
FIG. 36 is a graph showing the relationship between the film thickness and the sound absorption peak frequency in other examples of the soundproof structure shown in FIG. 3 and the soundproof structure shown in FIG. 3.

FIG. 36 shows the relationship between the absorption peak frequency on the low frequency side and the thickness of the PET film.

From FIG. 36, it can be seen that the peak frequency on the low frequency side of the absorbance becomes low as the thickness of the film 16 decreases in both of the two structures.

From FIG. 35B, it can be seen that the amount of change in the reduction of the absorption peak frequency in a case where the thickness of the film 16 is reduced increases in the modification example of Embodiment 3 in which the resonance frequencies of the two films 16 are different.

From FIG. 35A, in Embodiment 3 in which the films 16 on both sides have the same configuration, in a case where the thickness of the PET film is 38 μm, the absorption peak frequency is high. This is thought to be due to the induction of higher order modes.

From these results, it can be seen that the structure in which the resonance frequencies of the two films 16 are made different as in the modification example of Embodiment 3, Embodiment 5, and the modification example of Embodiment 5 is preferable for lowering the absorption peak frequency without increasing the frame size.

Figure 37:
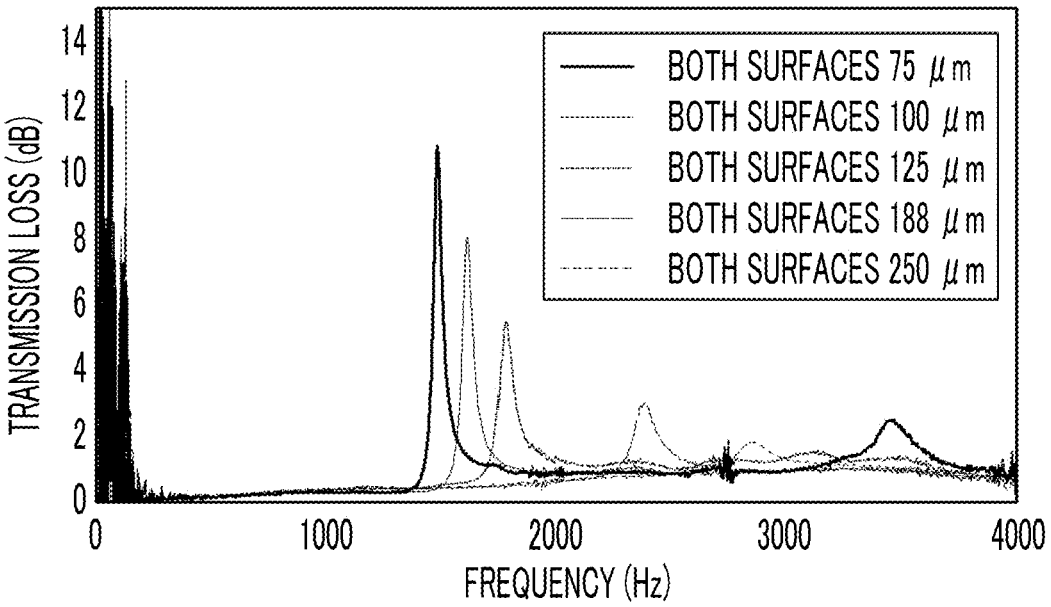
FIG. 37 is a graph showing the sound insulation characteristics of a soundproof cell, which has films with different thicknesses, of the soundproof structure shown in FIG. 3.
Figure 38:
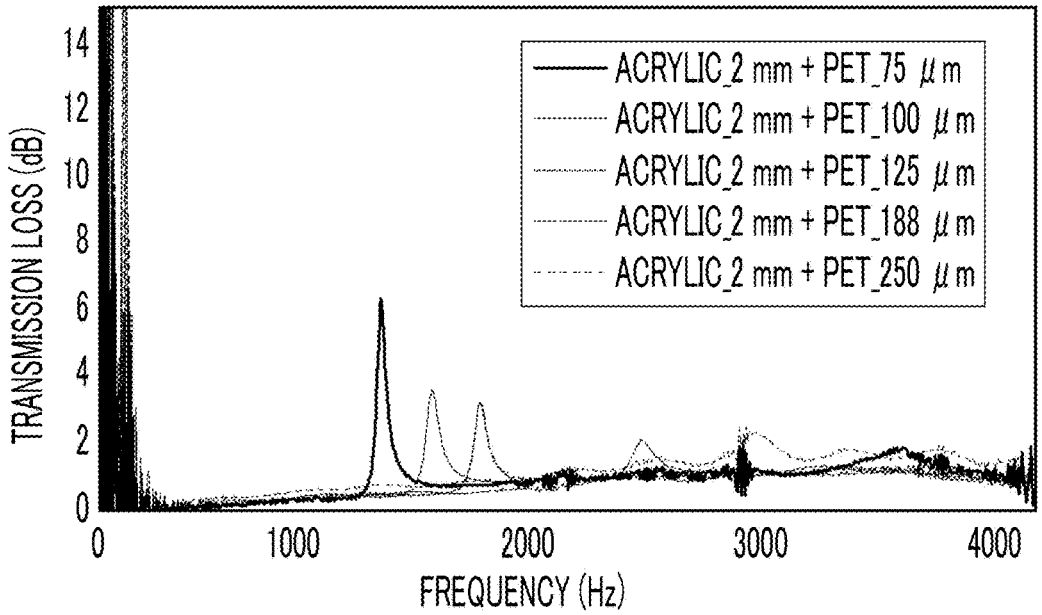
FIG. 38 is a graph showing the sound insulation characteristics of a soundproof cell, which has films with different thicknesses, of another example of the soundproof structure shown in FIG. 3.

Next, FIG. 37 shows the measurement result of the transmission loss (dB), which has been measured by variously changing the thickness of the films 16 using the measurement system shown in FIG. 13, in the soundproof structure 10B of Embodiment 3 in which the film 16 of the soundproof cell 18B is a PET film on both sides. FIG. 38 shows the measurement result of the transmission loss (dB), which has been measured by variously changing the thickness of the PET film 16*b* using the measurement system shown in FIG. 13, in the modification example of Embodiment 3 in which the film 16*a* of the soundproof cell 18B is an acrylic plate having a thickness of 2 mm.

Figure 39:
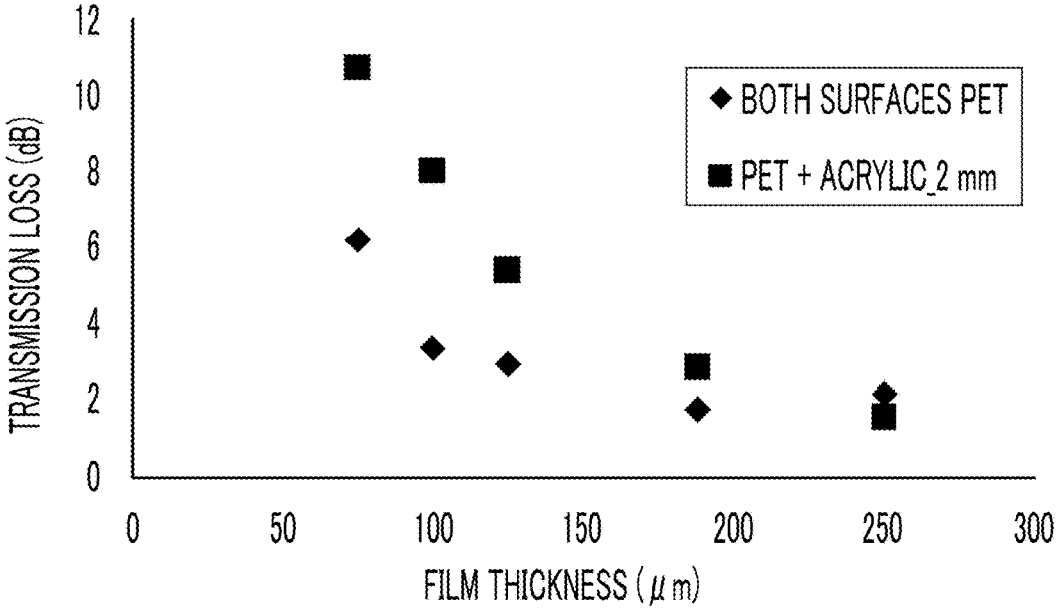
FIG. 39 is a graph showing the relationship between the film thickness and the shielding peak frequency in other examples of the soundproof structure shown in FIG. 3 and the soundproof structure shown in FIG. 3.

FIG. 39 shows the relationship between the transmission loss (dB) and the film thickness (μm) of the PET film at the shielding peak of each soundproof structure.

From FIG. 39, it can be seen that the shielding peak occurs on the lower frequency side as the thickness of the film 16 becomes smaller in both of the two structures.

From FIGS. 37 and 38, it can be seen that the shielding peak in Embodiment 3 in which the films 16 on both sides have the same configuration has a larger value than that in the modification example of Embodiment 3 in which the resonance frequencies of the two films 16 are made different. That is, it can be seen that a large transmission loss is obtained.

From these results, it can be seen that the soundproof structure 10B of Embodiment 3 in which the films 16 on both sides have the same configuration is preferable for obtaining the effect of a large transmission loss.

This is because sound waves re-emitted by film vibration of the film and sound waves passing over the film of the soundproof cell interfere with each other to cause high reflection. Accordingly, in Embodiment 3 in which the two films 16 have the same resonance frequency, the volume of sound reflected again increases and the reflection increases, compared with the soundproof structure of the modification example of Embodiment 3 in which the resonance frequencies of the two films 16 are different.

Therefore, it can be seen that a higher transmission loss is obtained as the number of film surfaces of the soundproof cell having the same film on both sides becomes larger as in the third or fourth embodiment.

Next, in Embodiment 5, the sound absorption characteristics of the configuration in which the two films 16 having close resonance frequencies are bonded to the frame 14 will be described in detail.

Figure 40:
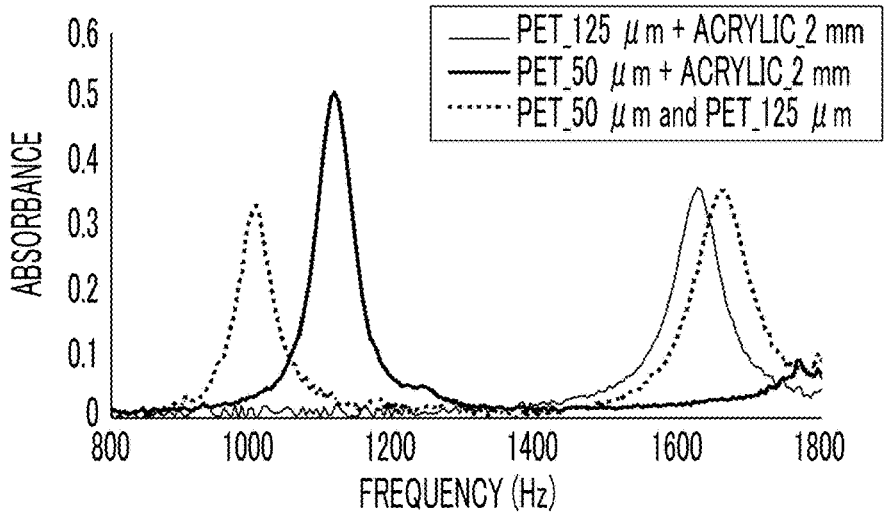
FIG. 40 is a graph showing the sound absorption characteristics of the soundproof structure shown in FIG. 3 and another example of the soundproof structure shown in FIG. 3.
Figure 41:
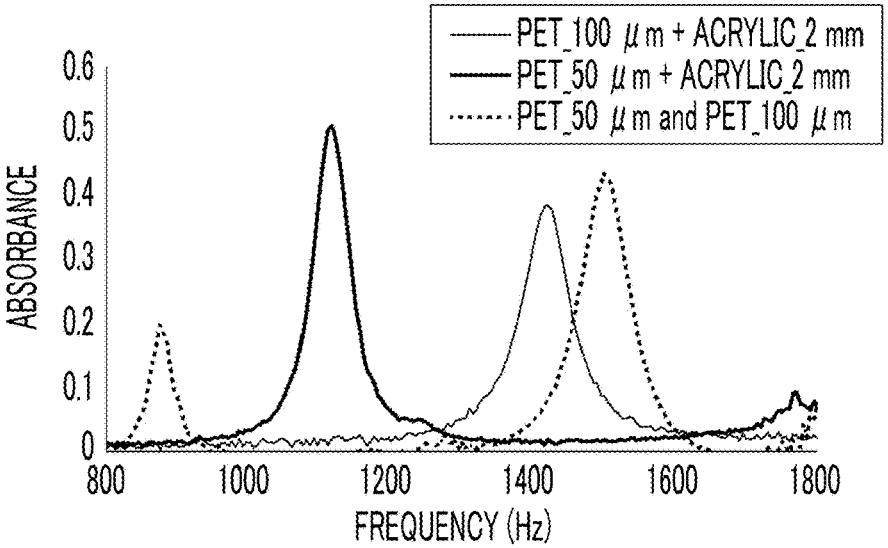
FIG. 41 is a graph showing the sound absorption characteristics of the soundproof structure shown in FIG. 3 and another example of the soundproof structure shown in FIG. 3.

FIG. 40 shows the measurement result of the absorbance of each of a soundproof structure in which the film 16*c* of the soundproof cell 18 D is a PET film having a thickness of 125 μm and the film 16*d* is an acrylic plate having a thickness of 2 mm, a soundproof structure in which the film 16*c* is a PET film having a thickness of 50 μm and the film 16*d* is an acrylic plate having a thickness of 2 mm, and a soundproof structure in which the film 16*c* is a PET film having a thickness of 50 μm and the film 16*d* is a PET film having a thickness of 125 μm, which has been measured using the measurement system shown in FIG. 13. FIG. 41 shows the measurement result of the absorbance of each of a soundproof structure in which the film 16*c* of the soundproof cell 18 D is a PET film having a thickness of 100 μm and the film 16*d* is an acrylic plate having a thickness of 2 mm, a soundproof structure in which the film 16*c* is a PET film having a thickness of 50 μm and the film 16*d* is an acrylic plate having a thickness of 2 mm, and a soundproof structure in which the film 16*c* is a PET film having a thickness of 50 μm and the film 16*d* is a PET film having a thickness of 100 μm, which has been measured using the measurement system shown in FIG. 13.

As shown in FIG. 40, the absorption peak frequency of the soundproof structure having a PET film with a thickness of 50 μm and an acrylic plate with a thickness of 2 mm is about 1115 Hz and the absorption peak frequency of the soundproof structure having a PET film with a thickness of 125 μm and an acrylic plate with a thickness of 2 mm is about 1620 Hz, while the peak at about 1115 Hz is shifted to the lower frequency of about 1000 Hz and the peak at about 1620 Hz is shifted to the higher frequency of about 1665 Hz in the soundproof structure having a PET film with a thickness of 50 μm and a PET film with a thickness of 125 μm.

Similarly, as shown in FIG. 41, the absorption peak frequency of the soundproof structure having a PET film with a thickness of 50 μm and an acrylic plate with a thickness of 2 mm is about 1115 Hz and the absorption peak frequency of the soundproof structure having a PET film with a thickness of 100 μm and an acrylic plate with a thickness of 2 mm is about 1415 Hz, while the absorption peak frequency of about 1115 Hz is shifted to the lower frequency of about 875 Hz and the peak at about 1415 Hz is shifted to the higher frequency of about 1500 Hz in the soundproof structure having a PET film with a thickness of 50 μm and a PET film with a thickness of 100 μm.

From FIGS. 40 and 41, it can be seen that the amount of shift of the absorption peak frequency in the soundproof structure having a PET film with a thickness of 50 μm and a PET film with a thickness of 100 μm is larger than that in the soundproof structure having a PET film with a thickness of 50 μm and a PET film with a thickness of 125 μm.

From these results, in a case where the soundproof cell has two films 16 having different resonance frequencies, the amount of shift of the absorption peak frequency becomes larger to cause a shift to the lower frequency as the resonance frequencies of the two films 16 become closer to each other, which is preferable.

In the soundproof structures of Embodiments 1 to 5, only one soundproof cell 18 or 18B or only one soundproof cell unit 20, 20C, or 20D configured to include a plurality of soundproof cells 18, 18A, 18C, or 18D is disposed in the tubular body 22. However, the present invention is not limited thereto, and a plurality of soundproof cells or a plurality of soundproof cell units may be disposed in the tubular body 22.

Sixth Embodiment

Figure 42:
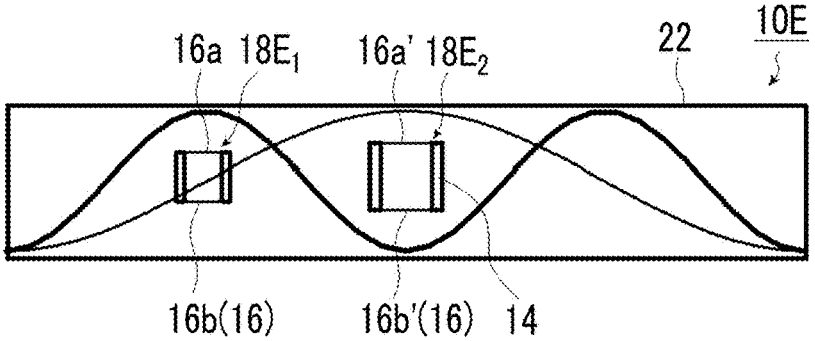
FIG. 42 is a schematic cross-sectional view showing an example of a soundproof structure according to Embodiment 6 of the present invention.

FIG. 42 is a schematic cross-sectional view showing an example of a soundproof structure according to Embodiment 6 of the present invention.

A soundproof structure 10E of Embodiment 6 shown in FIG. 42 has the same configuration as the soundproof cell 18C of third embodiment shown in FIG. 7, that is, a configuration in which two types of soundproof cells 18E (18$E_1$ and 18$E_2$) having a vibratable film 16 (16*a* and 16*b* and 16*a*' and 16*b*') fixed to the frame 14 so as to cover both surfaces of the hole portion 12 are disposed in the tubular body 22. The two types of soundproof cells 18E (18$E_1$ and 18$E_2$) have different first natural vibration frequencies of the film.

The heavy line shown in the tubular body 22 of FIG. 42 indicates the sound pressure distribution of the standing wave formed on the tubular body 22 by the sound wave of the first natural vibration frequency of the soundproof cell 18$E_1$, and the thin line indicates the sound pressure distribution of the standing wave formed on the tubular body 22 by the sound wave of the first natural vibration frequency of the soundproof cell 18$E_2$.

As shown in FIG. 42, the soundproof cells 18$E_1$ and 18$E_2$ of the soundproof structure 10E of Embodiment 6 are arranged in series in the central axis direction of the tubular body 22. Each of the soundproof cells 18$E_1$ and 18$E_2$ of the soundproof structure 10E of Embodiment 6 is disposed at the position of the antinode of standing waves formed on the tubular body 22 by the sound wave of the first natural vibration frequency corresponding to each soundproof cell. Specifically, the soundproof cell 18$E_1$ is disposed at the position of the antinode of the standing wave formed on the tubular body 22 by the sound wave of the first natural vibration frequency of the soundproof cell 18$E_1$, and the soundproof cell 18$E_2$ is disposed at the position of the antinode of the standing wave formed on the tubular body 22 by the sound wave of the first natural vibration frequency of the soundproof cell 18 $E_2$.

In this manner, by arranging each of the soundproof cells 18$E_1$ and 18$E_2$ at a position where the sound pressure is high (antinode of the standing wave) in the tubular body 22 that is an opening member, an excellent soundproofing effect (sound absorption rate and transmission loss) can be obtained. Specifically, as described based on the results according to FIGS. 28 and 30, an excellent soundproofing effect can be obtained in a case where the soundproof cells 18$E_1$ and 18$E_2$ are disposed in a predetermined range from the open end of the tubular body 22, that is, in the above-described predetermined range centered on a position where the sound pressure is high (position of the antinode of the standing wave).

Thus, according to the soundproof structure of the present embodiment in which a plurality of soundproof cells having different first natural vibration frequencies of the film are arranged in the tubular body 22, a high sound absorption effect and a high shielding effect can be obtained in a plurality of bands or a wide band.

Although two types of soundproof cells are shown in the tubular body 22 in FIG. 42, the present invention is not limited thereto, and two or more types of soundproof cells may be arranged in the tubular body 22.

Seventh Embodiment

Figure 43A:
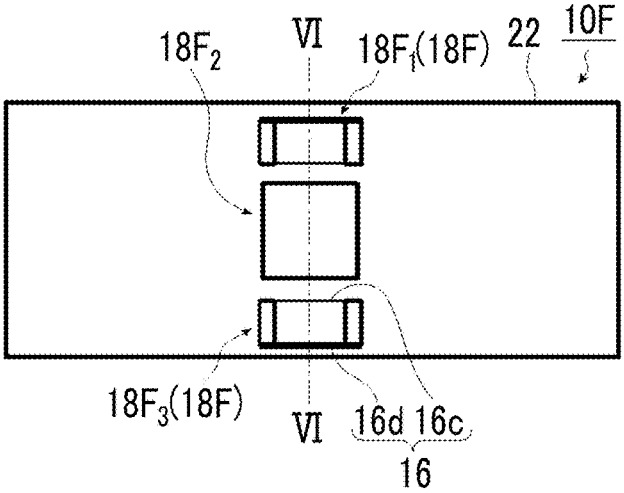
FIG. 43A is a schematic cross-sectional view showing an example of a soundproof structure according to Embodiment 7 of the present invention.
Figure 43B:
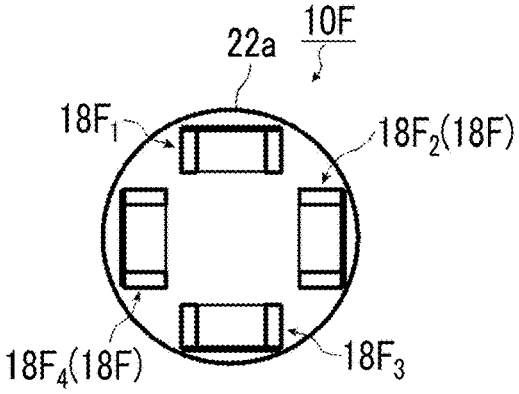
FIG. 43B is a schematic cross-sectional view of the soundproof structure shown in FIG. 43A taken along the line VI-VI.

FIG. 43A is a schematic cross-sectional view showing an example of a soundproof structure according to Embodiment 7 of the present invention, and FIG. 43B is a schematic cross-sectional view of the soundproof structure shown in FIG. 43A taken along the line VI-VI.

In a soundproof structure 10F of the present embodiment shown in FIGS. 43A and 43B, a plurality (four) of soundproof cells 18F (18$F_1$ to 18$F_4$) having different first natural vibration frequencies of the two films 16 (16*c* and 16*d*) that cover the opening of the hole portion 12 of the frame 14, each of which has the same configuration as the soundproof cell of the modification example of Embodiment 3, are arranged so as to face each other on the same circumference of the inner peripheral wall of the tubular body 22 having an inner diameter of 8 cm (hereinafter, this is referred to as "parallel arrangement").

In the soundproof cell 18F, the film 16*c* that is a PET film having a film thickness of 50 μm is fixed to one surface of the frame 14 having a frame size of 16 mm and a frame thickness of 20 mm, and an acrylic plate 16*d* having a film thickness of 2 mm is fixed to the other one surface. The plurality of soundproof cells 18F (18$F_1$ to 18$F_4$) have almost the same first natural vibration frequency of the film.

Figure 44:
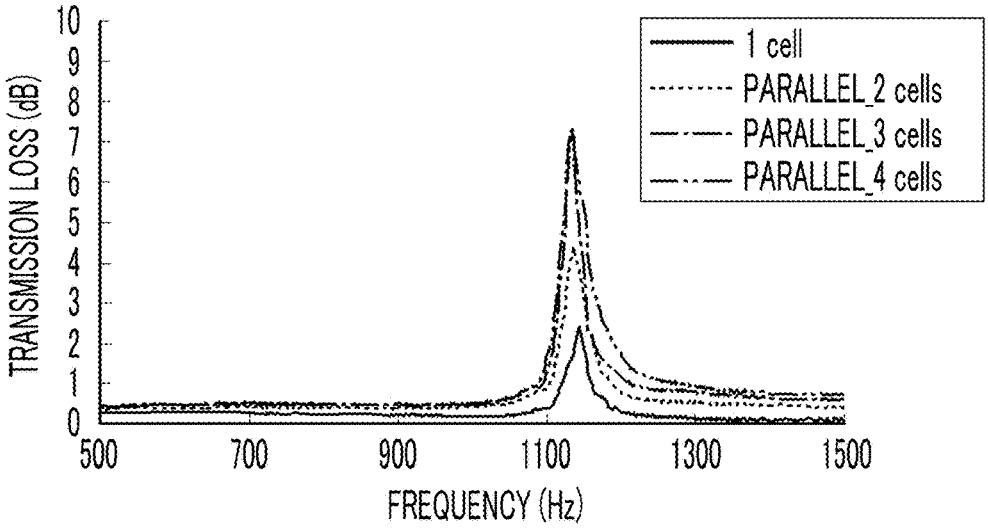
FIG. 44 is a graph showing the sound insulation characteristics of a soundproof cell having a different number of soundproof structures shown in FIGS. 43A and 43B.
Figure 45:
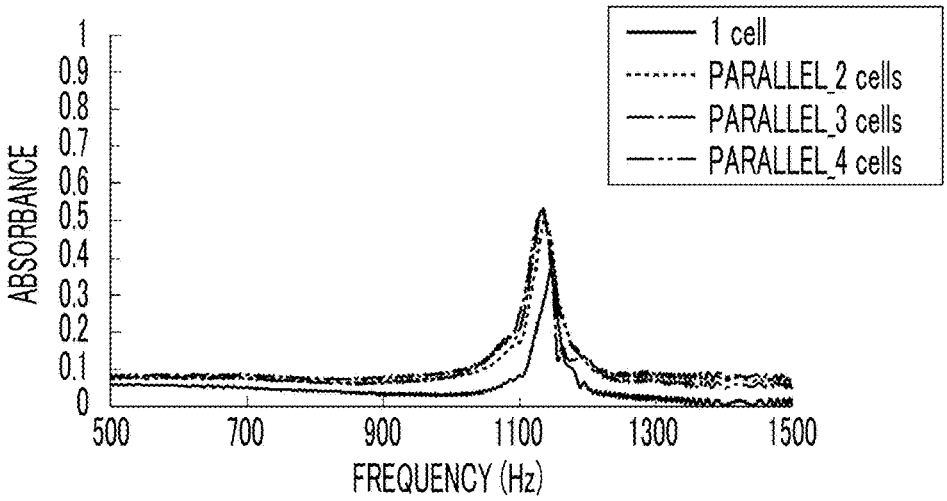
FIG. 45 is a graph showing the absorption characteristics of a soundproof cell having a different number of soundproof structures shown in FIGS. 43A and 43B.

FIG. 44 shows the measurement result of the transmission loss, which has been measured by variously changing the number of soundproof cells 18F arranged in the tubular body 22 to 1 to 4 using the measurement system shown in FIG. 13, in the soundproof structure 10F of Embodiment 7, and FIG. 45 shows the measurement result of the absorbance, which has been measured by variously changing the number of soundproof cells 18F arranged in the tubular body 22 to 1 to 4 using the measurement system shown in FIG. 13, in the soundproof structure 10F of Embodiment 7.

As shown in FIG. 44, it can be seen that the transmission loss increases as the number of soundproof cells 18 F arranged in the tubular body 22 increases. On the other hand, as shown in FIG. 45, it can be seen that, even if the number of soundproof cells 18F arranged in the tubular body 22 is increased, the sound absorption rate stays at about 50%.

Thus, the soundproof structure 10F of Embodiment 7 can obtain the effect of high transmission loss.

The plurality (four) of soundproof cells 18F (18$F_1$ to 18$F_4$) of the soundproof structure 10F of Embodiment 7 are preferably arranged at positions where the sound pressure formed on the tubular body 22 by the sound wave of the first natural vibration frequency of the soundproof cell 18F is high. In particular, the plurality (four) of soundproof cells 18F (18$F_1$ to 18$F_4$) of the soundproof structure 10F of Embodiment 7 are preferably arranged at the position of the antinode of the standing wave formed on the tubular body 22 by the sound wave of the first natural vibration frequency of the soundproof cell 18F. This is because a higher soundproofing effect (transmission loss) can be obtained.

Specifically, as described based on the results according to FIGS. 28 and 30, an excellent soundproofing effect (transmission loss) can be obtained in a case where the soundproof cell 18F is disposed in a predetermined range from the open end of the tubular body 22.

In the soundproof structure 10F of the present embodiment shown in FIGS. 43A and 43B, a plurality (four) of soundproof cells 18F (18$F_1$ to 18$F_4$) are arranged on the same circumference of the inner peripheral wall of the tubular body 22. However, as each of the soundproof cells 18F (18$F_1$ to 18$F_4$), a plurality of soundproof cells may be arranged in series in the central axis direction of the tubular body 22. The number of soundproof cells 18$F_1$ to 18$F_4$ arranged in series in the central axis direction of the tubular body 22 may be the same or may be different. The plurality of soundproof cells arranged in series in the central axis direction of the tubular body 22 may be a soundproof cell unit in which the soundproof cells are arranged so as to be spaced apart from each other, or may be a soundproof cell unit in which the soundproof cells are arranged so as to be in close contact with each other.

In such a case, the central axis (central axis of the length of the tubular body 22 in the central axis direction) of the plurality of soundproof cells arranged in series in the central axis direction of the tubular body 22 or the soundproof cell unit is preferably disposed at the position of the antinode of the standing wave formed on the tubular body 22 by the sound wave of the first natural vibration frequency of the soundproof cell 18F.

The length of the plurality of soundproof cells 18F arranged in series in the central axis direction of the tubular body 22 or the soundproof cell unit is preferably the size (number) at which both ends of the plurality of soundproof cells 18F arranged in series in the central axis direction of the tubular body 22 or the soundproof cell unit are not too far from the position of the antinode of the standing wave formed on the tubular body 22 by the sound wave of the first natural vibration frequency of the film of the soundproof cell 18F.

In the soundproof structure 10F of the present embodiment shown in FIGS. 43A and 43B, a plurality (four) of soundproof cells 18F (18$F_1$ to 18$F_4$) are arranged so as to face each other. However, the plurality (four) of soundproof cells 18F (18$F_1$ to 18$F_4$) may be arranged on the same circumference of the inner peripheral wall of the tubular body.

Since a plurality of soundproof cells are arranged on the same circumference of the inner peripheral wall of the opening member, such a soundproof structure 10F can be preferably used particularly in a case where the length of the opening member is limited.

Eighth Embodiment

Figure 46:
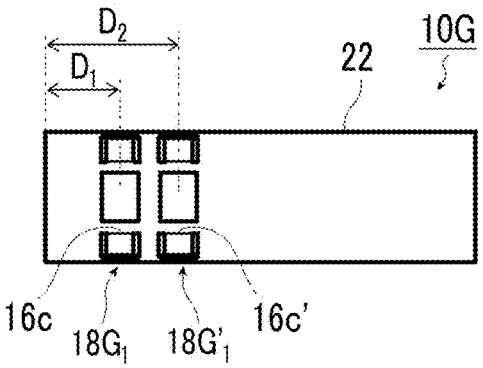
FIG. 46 is a schematic cross-sectional view showing an example of a soundproof structure according to Embodiment 8 of the present invention.

FIG. 46 is a schematic cross-sectional view showing an example of a soundproof structure according to Embodiment 8 of the present invention.

In the soundproof structure 10F of Embodiment 7, a plurality of soundproof cells 18F having substantially the same first natural vibration frequency of the film are arranged on the same circumference of the inner peripheral wall of the tubular body 22. However, as shown in FIG. 46, a plurality of soundproof cells having different first natural vibration frequencies can be further arranged in the tubular body 22.

In a soundproof structure 10G of the present embodiment shown in FIG. 46, a plurality of (for example, four) soundproof cells 18$G_1$ are arranged on the inner peripheral surface at a predetermined position (distance from the open end) $D_1$ from the end portion of the tubular body 22 having an inner diameter of 8 cm so as to face each other as in Embodiment 7 shown in FIG. 43, and a plurality of (for example, four) soundproof cells 18$G'_1$ having the first natural vibration frequency different from the plurality of (for example, four) soundproof cells 18$G_1$ are arranged on the inner peripheral surface at a predetermined position $D_2$ from the end portion (open end) of the tubular body 22 so as to face each other. The plurality of soundproof cell 18$G_1$ and 18$G'_1$, that is, one soundproof cell 18$G_1$ and one soundproof cell 18$G'_1$ are arranged in series in the central axis direction of the tubular body 22.

Each of the plurality (four) of soundproof cells 18$G_1$ and 18$G'_1$ is arranged at the position of the antinode of the standing wave formed on the tubular body 22 by the sound wave of the first natural vibration frequency corresponding to each soundproof cell. Specifically, the plurality (four) of soundproof cells 18$G_1$ are arranged at the position of the antinode of the standing wave, which is formed on the tubular body 22 by the sound wave of the first natural vibration frequency of the soundproof cell 18$G_1$, on the same circumference of the inner peripheral wall of the tubular body 22, and the plurality (four) of soundproof cells 18$G'_1$ are arranged at the position of the antinode of the standing wave, which is formed on the tubular body 22 by the sound wave of the first natural vibration frequency of the plurality (four) of soundproof cells 18$G'_1$, on the same circumference of the inner peripheral wall of the tubular body 22.

In the soundproof cell 18$G_1$, the film 16*c* that is a PET film having a film thickness of 100 μm is fixed to one surface of the frame 14 having a frame size of 16 mm and a frame thickness of 20 mm, and an acrylic plate having a film thickness of 2 mm is fixed to the other one surface. The plurality (four) of soundproof cells 18$G_1$ have almost the same first natural vibration frequency of the film. In the soundproof cell 18$G'_1$, the film 16*c* that is a PET film having a film thickness of 50 μm is fixed to one surface of the frame 14 having a frame size of 16 mm and a frame thickness of 20 mm, and an acrylic plate 16 having a film thickness of 2 mm is fixed to the other one surface. The plurality (four) of soundproof cells 18$G'_1$ have almost the same first natural vibration frequency of the film that is different from the soundproof cell 18$G_1$.

It is preferable that each of the plurality (four) of soundproof cells 18$G_1$ and 18$G'_1$ is arranged at a position where the sound pressure formed on the tubular body 22 by the sound wave of the first natural vibration frequency corresponding to each soundproof cell is high. In addition, it is preferable that each of the plurality (four) of soundproof cells 18$G_1$ and 18$G'_1$ is arranged at the position of the antinode of the standing wave by the sound wave of the first natural vibration frequency corresponding to each soundproof cell. By arranging the soundproof cells 18$G_1$ and 18$G'_1$ in this manner, it is possible to obtain an excellent soundproofing effect (transmission loss). Specifically, as described based on the results according to FIGS. 28 and 30, an excellent soundproofing effect can be obtained in a case where the soundproof cells 18$G_1$ and 18$G'_1$ are arranged in a predetermined range from the open end of the tubular body 22, that is, in a predetermined range centered on a position where the sound pressure is high (position of the antinode of the standing wave).

In the soundproof structure 10G of the present embodiment shown in FIG. 46, the plurality (four) of soundproof cells 18$G_1$ and the plurality (four) of soundproof cells 18$G'_1$ are arranged on the same circumference of the inner peripheral wall. However, as the respective soundproof cells, a plurality of soundproof cells can also be further arranged in series in the central axis direction.

Since the open end of the tubular body 22 is a free end, the soundproof structure 10G of Embodiment 8 shown in FIG. 46 is preferably disposed within λ/4—opening end correction distance of ±λ/4 from the position of the antinode of the standing wave by the sound wave of the first natural vibration frequency corresponding to each soundproof cell, more preferably disposed within λ/4—opening end correction distance of ±λ/6 from the position of the antinode of the standing wave, even more preferably disposed within λ/4—opening end correction distance of ±λ/8 from the position of the antinode of the standing wave, and most preferably disposed at the position of the antinode of the standing wave.

By arranging the plurality of soundproof cells 18$G_1$ and 18$G'_1$ in the tubular body 22 in this manner, the soundproof structure 10G of the present embodiment can obtain the effect of high transmission loss over a plurality of frequency bands or a wide frequency band.

Figure 47:
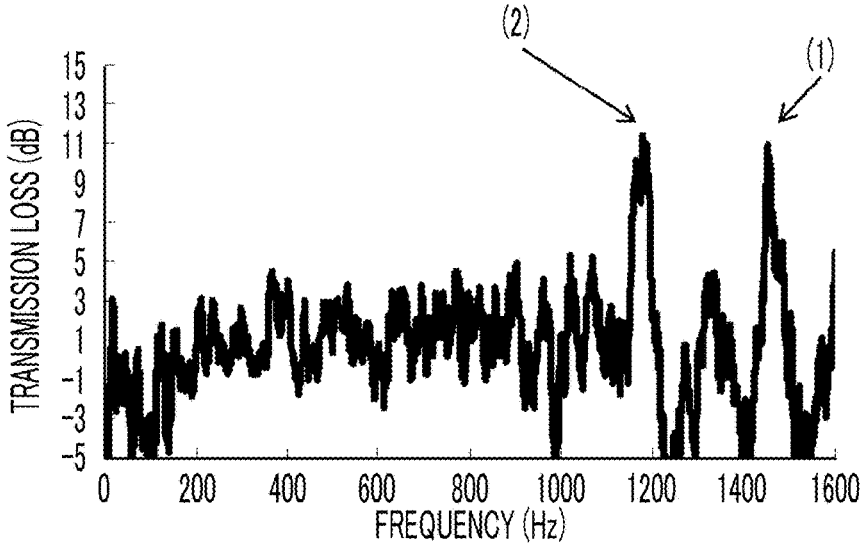
FIG. 47 is a graph showing the shielding characteristics of the soundproof structure shown in FIG. 46.

The measurement result of the transmission loss of the soundproof structure 10G in a state in which a speaker is disposed at one end portion of the tubular body 22 of the soundproof structure 10G of Embodiment 8 and one microphone is placed on the open portion side similarly to the transmission loss measuring method shown in FIG. 29 is shown in FIG. 47.

In this measurement, "$D_1$" shown in FIG. 46 is 36 mm from the open end of the tubular body 22, that is, indicates a distance from the open end of the tubular body 22 to the antinode of the standing wave by the sound wave of the first natural vibration frequency of the soundproof cell 18$G_1$. "$D_2$" is 51 mm from the open end of the tubular body 22, that is, indicates a position of the antinode of the standing wave formed on the tubular body 22 by the sound wave of the first natural vibration frequency of the soundproof cell 18$G'_1$. The first natural vibration frequency of the soundproof cell 18$G_1$ is about 1450 Hz, and the first natural vibration frequency of the soundproof cell 18$G'_1$ is about 1150 Hz.

From FIG. 47, it can be seen that a transmission loss corresponding to each soundproof cell can be obtained by arranging each soundproof cell at the position of the antinode of the standing wave formed on the tubular body 22 by the sound wave of the first natural vibration frequency of each soundproof cell. More specifically, it can be seen that a shielding peak (1) at 1455 Hz corresponding to the soundproof cell 18$G_1$ and a shielding peak (2) at 1162 Hz corresponding to the soundproof cell 18$G'_1$ occur.

Similarly to the soundproof structure 10F of Embodiment 7, the soundproof structure 10G of Embodiment 8 can be preferably used in a case where the length of the opening member is limited.

In the soundproof structure 10G of the present eighth embodiment shown in FIG. 46, a plurality (two) of types of soundproof cells 18$G_1$ and 18$G'_1$ having different first natural vibration frequencies are used. However, the present invention is not limited thereto, and three or more types of a plurality of soundproof cells having different first natural vibration frequencies can also be used.

In the soundproof structure 10G of the present embodiment shown in FIG. 46, all of the plurality (four) of soundproof cells 18$G_1$ and the plurality (four) of soundproof cells 18$G'_1$ are arranged on the same circumference of the inner peripheral wall of the tubular body 22. However, the present invention is not limited thereto, and a plurality of other soundproof cells 18$G_2$ may not be arranged on the same circumference of the inner peripheral wall of the tubular body 22 as long as at least one type of the plurality of soundproof cells 18$G_1$ are arranged on the same circumference of the inner peripheral wall of the tubular body 22.

In the soundproof structure 10G of the present embodiment shown in FIG. 46, a plurality (four) of soundproof cells 18$G_1$ and a plurality (four) of soundproof cells 18G'1 are arranged on the same circumference of the inner peripheral wall of the tubular body 22. However, as in Embodiment 7, as the soundproof cells 18$G_1$ and 18$G'_1$, a plurality of soundproof cells may be arranged in series in the central axis direction of the tubular body 22.

In the soundproof structure 10G of the present embodiment shown in FIG. 46, a plurality (four) of soundproof cells 18$G_1$ and a plurality (four) of soundproof cells 18$G'_1$ are arranged so as to face each other. However, the plurality (four) of soundproof cells 18$G_1$ and the plurality (four) of soundproof cells 18$G'_1$ may be arranged on the same circumference of the inner peripheral wall of the tubular body.

Ninth Embodiment

Figure 48A:
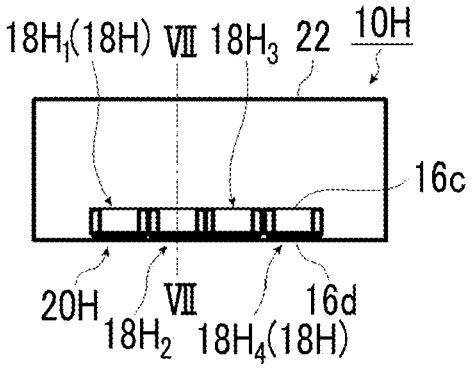
FIG. 48A is a schematic cross-sectional view showing an example of a soundproof structure according to Embodiment 9 of the present invention.
Figure 48B:
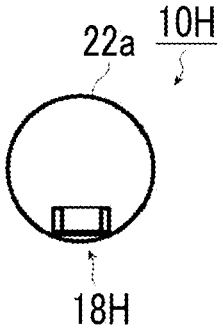
FIG. 48B is a schematic cross-sectional view of the soundproof structure shown in FIG. 48A taken along the line VII-VII.

FIG. 48A is a schematic cross-sectional view showing an example of a soundproof structure according to Embodiment 9 of the present invention, and FIG. 48B is a schematic cross-sectional view of the soundproof structure shown in FIG. 48A taken along the line VII-VII.

A soundproof structure 10H of the present embodiment shown in FIGS. 48A and 48B includes a soundproof cell unit 20H in which a plurality (four) of soundproof cells 18H (18$H_1$ to 18$H_4$), which have the same configuration as the soundproof cell of the modification example of Embodiment 5 and in which the films 16 (16*c* and 16*d*) having different thicknesses and materials are fixed to both surfaces of the hole portion 12 of the frame 14, are arranged in series. The soundproof cell unit 20H is disposed such that the plurality of soundproof cells 18H (18$H_1$ to 18$H_4$) arranged in series are arranged in series in the central axis direction of the tubular body 22 (hereinafter, this is referred to as "serial arrangement"). The configuration (frame size, frame thickness, frame material, film thickness, and film material) of the soundproof cell 18H is the same as that of the soundproof cell 18F of Embodiment 7.

Figure 49:
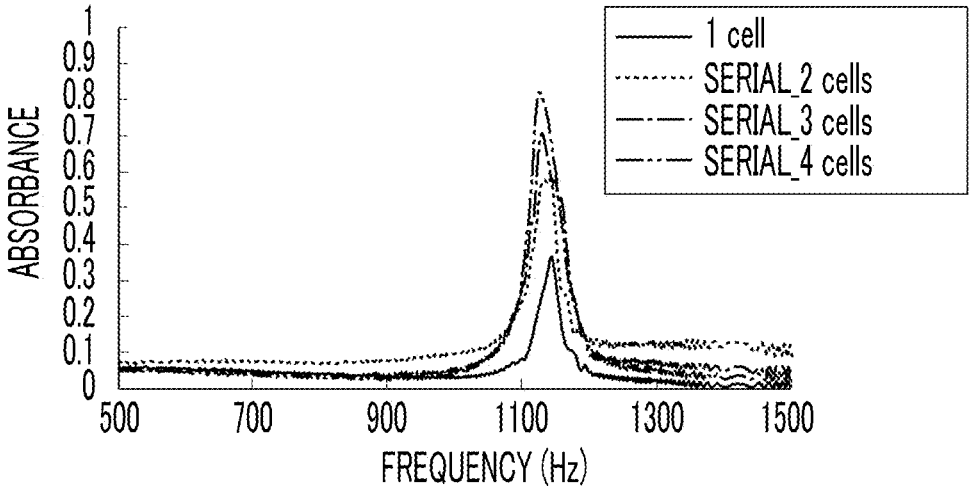
FIG. 49 is a graph showing the absorption characteristics of a soundproof cell having a different number of soundproof structures shown in FIGS. 48A and 48B.

FIG. 49 shows the measurement result of the sound absorption rate, which has been measured by variously changing the number of soundproof cells 18H arranged in series in the tubular body 22 to 1 to 4 using the measurement system shown in FIG. 13, in the soundproof structure 10H of Embodiment 9.

As shown in FIG. 49, it can be seen that the absorbance greatly increases as the number of soundproof cells 18H arranged in series in the tubular body 22, that is, the number of soundproof cell 18H forming the soundproof cell unit 20H, increases.

Incidentally, as shown in FIG. 35B, it can be seen that the absorbance of the soundproof structure (acrylic 2 mm+PET), which has the same film configuration as the soundproof structure of the modification example of Embodiment 3 in which the number of soundproof cells arranged in the tubular body 22 is one, does not exceed 50% even if the film thickness of the PET is changed.

In addition, it can be seen that the sound absorption rate of the soundproof structure 10F of Embodiment 7 shown in FIG. 45 is about 50% even if the number of soundproof cells 18F arranged in parallel in the tubular body 22 increases. As also described in Analytical coupled vibroacoustic modeling of membrane-type acoustic metamaterials: plate model, J. Acoust. Soc. Am. 136 (6), pages 2926 to 2934 (2014), this is thought to be because the absorbance of 50% or more cannot be obtained due to the continuous speed condition on the boundary surface which is much narrower than the wavelength at which the resonance structure is disposed. According to this theory, not only in the case of one soundproof cell but also in a case where a plurality of soundproof cells are arranged on the same circumference of the inner peripheral wall of the opening member (tubular body) as in the soundproof structure 10F of Embodiment 7, it is thought that the absorbance of 50% or more cannot be obtained.

In contrast, as shown in FIG. 49, in the case of the soundproof structure 10H of Embodiment 9, it can be seen that the sound absorption rate exceeds 50% just by arranging the two soundproof cells 18H in series in the central axis direction of the tubular body 22 in the tubular body 22.

According to the soundproof structure 10H of Embodiment 9, it is possible to obtain the effect of high sound absorption rate.

It is preferable that the soundproof cell unit 20H of the soundproof structure 10H of Embodiment 9 is disposed such that the central axis (that is, the central axis of the length of the tubular body 22 in the central axis direction) is located at a position where the sound pressure formed on the tubular body 22 by the sound wave of the first natural vibration frequency of the soundproof cell 18H is high. In particular, it is preferable that the soundproof cell unit 20H of the soundproof structure 10H of Embodiment 9 is disposed such that the central axis is located at the position of the antinode of the standing wave formed on the tubular body 22 by the sound wave of the first natural vibration frequency of the soundproof cell 18H. Specifically, as described based on the results according to FIGS. 28 and 30, an excellent soundproofing effect (absorbance and transmission loss) can be obtained in a case where the central axis of the soundproof cell unit 20H is disposed in a predetermined range from the open end of the tubular body 22.

In order to obtain the effect of high sound absorption rate, it is preferable that the length of the soundproof cell unit 20H, that is, the number of soundproof cells 18H arranged in a column, is the size (number) at which both ends of the soundproof cell unit 20H are not too far from the position of the antinode of the standing wave formed on the tubular body 22 by the sound wave of the first natural vibration frequency of the film of the soundproof cell 18H.

The plurality of soundproof cells 18H (18$H_1$ to 18$H_4$) of Embodiment 9 shown in FIGS. 48A and 48B are arranged in a column. However, as long as the plurality of soundproof cells 18H are arranged in series in the central axis direction, there may be deviation in the arrangement of the soundproof cells 18H without being limited thereto.

Although the soundproof structure 10H of Embodiment 9 shown in FIGS. 48A and 48B includes one soundproof cell unit, the present invention is not limited thereto, and the soundproof structure of the present invention may have two or more soundproof cell units.

Specifically, the soundproof structure of the present invention may include two or more soundproof cell units 20H in which a plurality (four) of soundproof cells 18H (18$H_1$ to 18$H_4$), in which the films 16 (16*c* and 16*d*) having different thicknesses are fixed to both surfaces of the hole portion 12 of the frame 14, are arranged in series. In each of the two or more soundproof cell units 20H, a plurality of soundproof cells 18H (18$H_1$ to 18$H_4$) arranged in series may be arranged in series in the central axis direction of the tubular body 22.

In Embodiment 9 shown in FIG. 48, the soundproof cell unit 20H is used. However, as long as the plurality of soundproof cells 18$H_1$ to 18$H_4$ are arranged in series in the central axis direction of the tubular body 22, it is possible to use a plurality of cells obtained by separating adjacent soundproof cells from each other without being limited thereto.

Tenth Embodiment

Figure 50A:
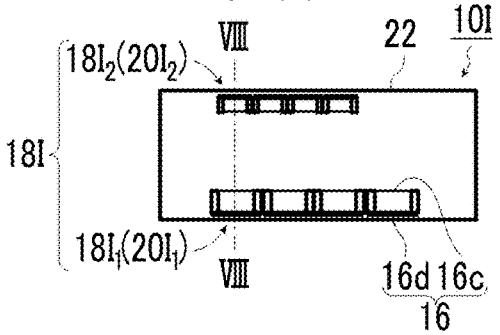
FIG. 50A is a schematic cross-sectional view showing an example of a soundproof structure according to Embodiment 10 of the present invention.
Figure 50B:
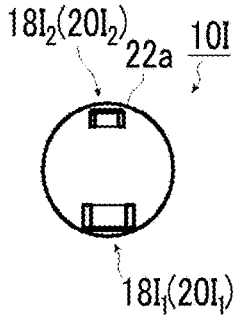
FIG. 50B is a schematic cross-sectional view of the soundproof structure shown in FIG. 50A taken along the line VIII-VIII.

FIG. 50A is a schematic cross-sectional view showing an example of a soundproof structure according to Embodiment 10 of the present invention, and FIG. 50B is a schematic cross-sectional view of the soundproof structure shown in FIG. 50A taken along the line VIII-VIII.

A soundproof structure 10I of the present embodiment shown in FIGS. 50A and 50B includes a soundproof cell unit 20$I_1$ in which a plurality (for example, four) of soundproof cells 18$I_1$, which have the same configuration as the soundproof cell of the modification example of Embodiment 5 and in which the films 16 (16*c* and 16*d*) having different thicknesses are fixed to both surfaces of the hole portion 12 of the frame 14, are arranged in series and a soundproof cell unit 20$I_2$ having a size smaller than the soundproof cell 18$I_1$. That is, the soundproof structure 10I of the present embodiment shown in FIGS. 50A and 50B includes two types of soundproof cell units having different first natural vibration frequencies of the film due to the difference in the size of the soundproof cell unit. Each of the two types of soundproof cell units 20$I_1$ and 20$I_2$ are disposed such that the plurality of soundproof cells 18I (18$I_1$ and 18$I_2$) are arranged in series in the central axis direction of the tubular body 22 and disposed on the inner peripheral wall of the tubular body 22 such that soundproof cells having different first natural vibration frequencies face each other.

By arranging the two types of soundproof cell units in this manner, in the soundproof structure 10I of the present embodiment, a plurality of soundproof cells can be arranged on the opening cross section of the opening member, and a plurality of soundproof cells can also be arranged in the longitudinal direction of the opening member. As a result, it is possible to obtain the effect of high transmission loss over a plurality of frequency bands or a wide frequency band and to obtain the effect of high absorbance over a plurality of frequency bands or a wide frequency band.

In FIGS. 50A and 50B, two types of soundproof cell units having different first natural vibration frequencies due to the difference in the size of the soundproof cell unit are used. However, Embodiment 10 is not particularly limited as long as the first natural vibration frequencies of the films of the two soundproof cell units are different, and two types of soundproof cell units having different first natural vibration frequencies according to the thickness or material of the film fixed to the frame can also be used.

Figure 51:
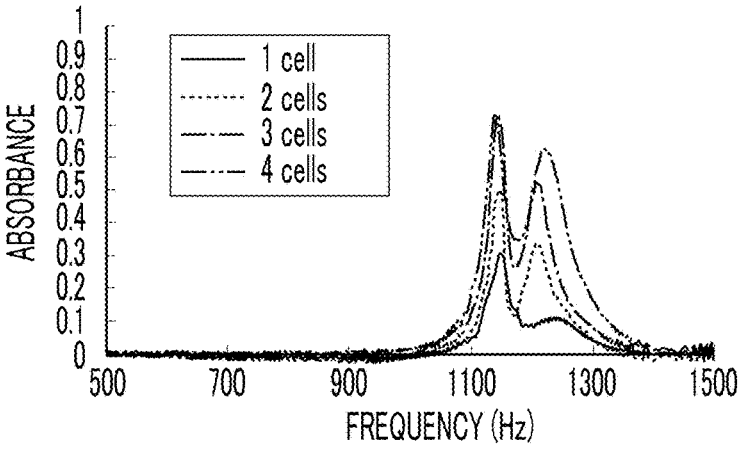
FIG. 51 is a graph showing the absorption characteristics of a soundproof cell having a different number of soundproof structures shown in FIGS. 50A and 50B.

In the soundproof structure 10I of Embodiment 10, two types of soundproof cell units 20$I_1$ and 20$I_2$ having different first natural vibration frequencies are arranged in the tubular body 22 by fixing films, which have the same frame size and material but have different film thicknesses, to the frame 14. FIG. 51 shows the measurement result of the sound absorption rate, which has been measured by variously changing the number of soundproof cell units 20$I_1$ and 20$I_2$ to 1 to 4 using the measurement system shown in FIG. 13. The configurations of the soundproof cells 18$I_1$ and 18$I_2$ forming the soundproof cell units 20$I_1$ and 20$I_2$ used herein are the same configuration (configuration in which an acrylic plate having a film thickness of 2 mm is fixed to one side of the frame 14 having a frame size of 16 mm and a frame thickness of 20 mm and the PET is fixed to the other surface) as the soundproof cell 18F of Embodiment 7 except for the film thickness of the PET. A PET film having a film thickness of 50 μm is fixed to one side of the frame 14 of the soundproof cell 18$I_1$, and a PET film having a film thickness of 75 μm is fixed to one side of the soundproof cell 18$I_2$.

As shown in FIG. 51, it can be seen that a plurality of absorption peaks occur or the sound absorption rate greatly increases as the number of soundproof cell units 20$I_1$ and 20$I_2$ increases. More specifically, it can be seen that only one absorption peak is found and the sound absorption rate is also only about 30% in a case where only one soundproof cell unit 20$I_1$ and one soundproof cell 20$I_2$ are arranged, but two absorption peaks occur in a case where the number of soundproof cell units 20$I_1$ and 20$I_2$ is 2 to 4. It can also be seen that the sound absorption rate at each absorption peak increases as the number of soundproof cell units 20$I_1$ and 20$I_2$ increases.

In Embodiment 10, two types of soundproof cell units are used, but the invention is not limited thereto, and two or more types of soundproof cell units can also be used.

As in Embodiment 9, it is preferable that each of the two types of soundproof cell units 20$I_1$ and 20$I_2$ is disposed such that the central axis (that is, the central axis of the length of the tubular body 22 in the central axis direction) is located at a position where the sound pressure formed on the tubular body 22 by the sound wave of the first natural vibration frequency corresponding to each soundproof cell 18I (18$I_1$ and 18$I_2$) is high. In particular, it is preferable that each of the two types of soundproof cell units 20$I_1$ and 20$I_2$ is disposed such that the central axis is located at the position of the antinode of the standing wave formed on the tubular body 22 by the sound wave of the first natural vibration frequency corresponding to each soundproof cell 18I (18$I_1$ and 18$I_2$). Specifically, the soundproof cell unit 20$I_1$ is preferably disposed such that the central axis is located at the position of the antinode of the standing wave formed on the tubular body 22 by the sound wave of the first natural vibration frequency of the soundproof cell 18$I_1$, and the soundproof cell unit 20$I_2$ is preferably disposed such that the central axis is located at the position of the antinode of the standing wave formed on the tubular body 22 by the sound wave of the first natural vibration frequency of a plurality (four) of soundproof cells 18G'2.

By arranging the two types of soundproof cell units in this manner, the soundproof structure 10I of the present embodiment can obtain the higher soundproofing effect (absorbance) than in the soundproof structure 10F of Embodiment 7 in which a plurality of soundproof cells 18F are arranged only at the position of the antinode of the standing wave.

In Embodiment 10 shown in FIG. 50A, the soundproof cell units 20$I_1$ and 20$I_2$ are used. However, as long as a plurality of soundproof cells are arranged in series in the central axis direction of the tubular body 22, it is possible to use a plurality of cells obtained by separating adjacent soundproof cells from each other without being limited thereto.

The plurality of soundproof cells 18I of Embodiment 10 shown in FIG. 50A are arranged in a column. However, as long as the plurality of soundproof cells 18I are arranged in series in the central axis direction, there may be deviation in the arrangement of the soundproof cells 18I without being limited thereto.

Eleventh Embodiment

Figure 52:
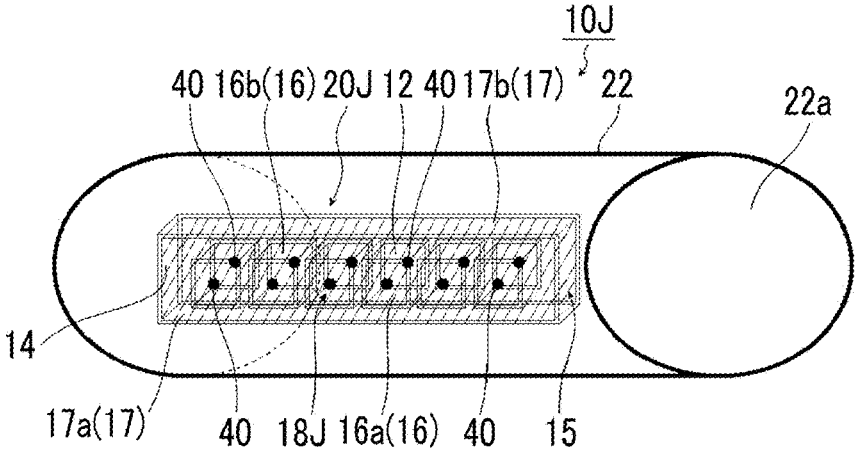
FIG. 52 is a perspective view schematically showing an example of a soundproof structure according to Embodiment 11 of the present invention.

FIG. 52 is a perspective view schematically showing an example of a soundproof structure according to Embodiment 11 of the present invention.

A soundproof structure 10J of the present embodiment shown in FIG. 52 has a structure in which a soundproof cell unit 20J, in which a plurality of soundproof cells 18J each having a frame 14 having a hole portion 12 penetrating therethrough, a film 16 (16*a* and 16*b*) fixed to the frame 14 so as to cover both surfaces of the hole portion 12, and a weight 40 bonded and fixed to the film 16 (16*a* and 16*b*) are arranged (in the illustrated example, six soundproof cells 18J are arranged in a column), is disposed in the aluminum tubular body 22 (its opening 22*a*), which is an opening member of the present invention, in a state in which the film surface of the film 16 is inclined with respect to the opening cross section 22*b* of the tubular body 22 and a region serving as a ventilation hole through which gas passes is provided in the opening 22*a* in the tubular body 22 (refer to FIG. 14).

Since the soundproof structure 10J of the present embodiment shown in FIG. 52 has the same configuration as the soundproof structure 10C of Embodiment 4 shown in FIG. 8 except that the weight 40 is bonded and fixed to each film 16 (16*a* and 16*b*) fixed to both surfaces of the hole portion 12 of the frame 14, explanation regarding the same configuration will be omitted.

In the soundproof cell unit 20J of the soundproof structure 10J of the present embodiment, the controllability of sound insulation performance is improved by bonding and fixing the weight 40 to each film 16 (16*a* and 16*b*), compared with a soundproof structure with no weight such as the soundproof structures 10 and 10A to 10I of Embodiments 1 to 10 described above.

That is, by changing the weight of the weight 40, it is possible to control the frequency of the first sound insulation peak and the sound insulation performance.

In the soundproof cell unit 20J, the weight 40 is fixed to both the films 16*a* and 16*b*. However, the present invention is not limited thereto, and the weight 40 may be fixed to only one of the films 16*a* and 16*b*. Although the films 16*a* and 16*b* are fixed to both surfaces of the frame 14, the films 16*a* and 16*b* may be fixed to only one of the surfaces, and it is needless to say that the weight 40 is fixed to the film 16.

The shape of the weight 40 is not limited to the circular shape in the illustrated example, and can be the above-described various shapes similarly to the shape of the hole portion 12 of the frame 14, accordingly, the shape of the film 16. However, it is preferable that the shape of the weight 40 is the same as the shape of the film 16.

The size of the weight 40 is not particularly limited, but the size of the weight 24 is required to be smaller than the size of the film 16 that is the size of the hole portion 12. Accordingly, in a case where the size R of the hole portion 12 is 0.5 mm to 50 mm, the size of the weight 40 is preferably 0.01 mm to 25 mm, more preferably 0.05 mm to 10 mm, and most preferably 0.1 mm to 5 mm.

The thickness of the weight 40 is not particularly limited, and may be appropriately set according to the required weight and the size of the weight 40. For example, the thickness of the weight 40 is preferably 0.01 mm to 10 mm, more preferably 0.1 mm to 5 mm, and most preferably 0.5 mm to 2 mm.

It is preferable that the size and/or thickness of the weight 40 is expressed by an average size and/or average thickness, for example, in a case where different sizes and/or thicknesses are included in a plurality of films 16.

The material of the weight 40 is not particularly limited as long as the material of the weight 40 has a required weight and a required size, and the various materials described above can be used similarly to the materials of the frame 14 and the film 16. The material of the weight 40 may be the same as or different from the materials of the frame 14 and the film 16.

Although the soundproof cell 18J of Embodiment 11 has a structure in which the weight 40 is fixed to the film 16 fixed to the frame 14, the present invention is not limited thereto, and a structure in which the film 16, the frame 14, and the weight 40 formed of the same material are integrated may be adopted.

The configuration of the soundproof structure of the present embodiment in which a weight is fixed to a film can be applied not only to one soundproof cell 18 of the soundproof structure 10 of Embodiment 1 and one soundproof cell 18B of the soundproof structure 10B of Embodiment 3 but also to a plurality of soundproof cells 18A of the soundproof structure 10 of Embodiment 2 and the respective soundproof cells 18C to 18I of the soundproof structures 10D to 10I of Embodiments 1 to 10.

In the soundproof cell unit 20J of the soundproof structure 10J of the present embodiment shown in FIG. 52, a PET film having a thickness of 100 μm is fixed to both surfaces of the frame 14 as the film 16 by a double-sided adhesive tape similarly to the configuration of the soundproof structure 10C of Embodiment 4. In addition, a stainless weight 40 of 55 mg is fixed to the center of the PET film 16 (16*a* and 16*b*) on both surfaces of the frame 14 of the soundproof cell 18J by a double-sided adhesive tape.

Figure 53A:
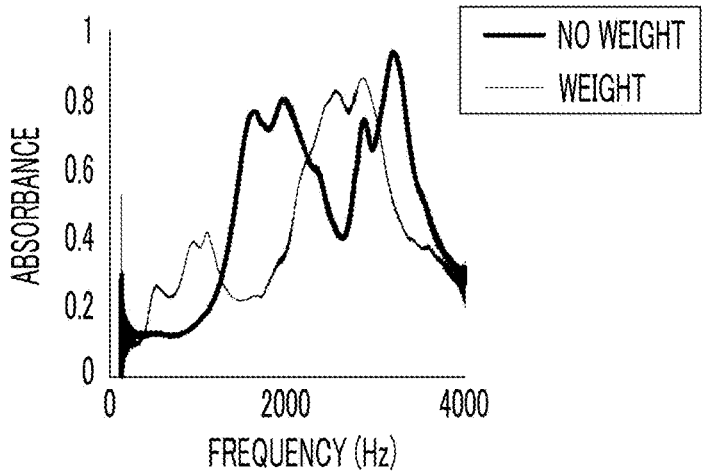
FIG. 53A is a graph showing the sound absorption characteristics of the soundproof structure shown in FIG. 52.
Figure 53B:
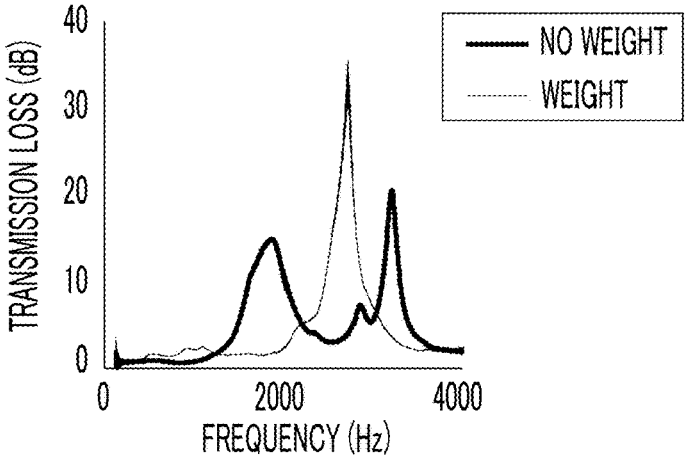
FIG. 53B is a graph showing the sound insulation characteristics of the soundproof structure shown in FIG. 52.

FIGS. 53A and 53B show the measurement results of the absorbance and the transmission loss of the soundproof structure 10J of Embodiment 11 and a soundproof structure (corresponding to the soundproof structure 10C of Embodiment 4), which has the same configuration as the soundproof structure 10J but is different from the soundproof structure 10J in that no weight is fixed to the film 16 (16*a* and 16*b*), using the measurement system shown in FIG. 13.

At the absorbance shown in FIG. 53A, two absorption peaks of about 1772 Hz and about 3170 Hz in a case where there is no weight are shifted to the low frequency side of about 993 Hz and about 2672 Hz by placing and fixing the weight 40 to the film 16. Therefore, the present embodiment is preferable in order to perform low frequency sound absorption. For the sound insulation shown in FIG. 53B, a sound insulation peak as high as 35 dB can be obtained by placing the weight 40 on the film 16.

In the soundproof structure 10J shown in FIG. 52, the soundproof cells 18J are arranged in series in the central axis direction of the tubular body 22. Therefore, it can be seen that the absorbance of 50% or more is obtained as shown in FIG. 53A and the soundproofing effect (absorbance) is also high.

Twelfth Embodiment

Figure 54:
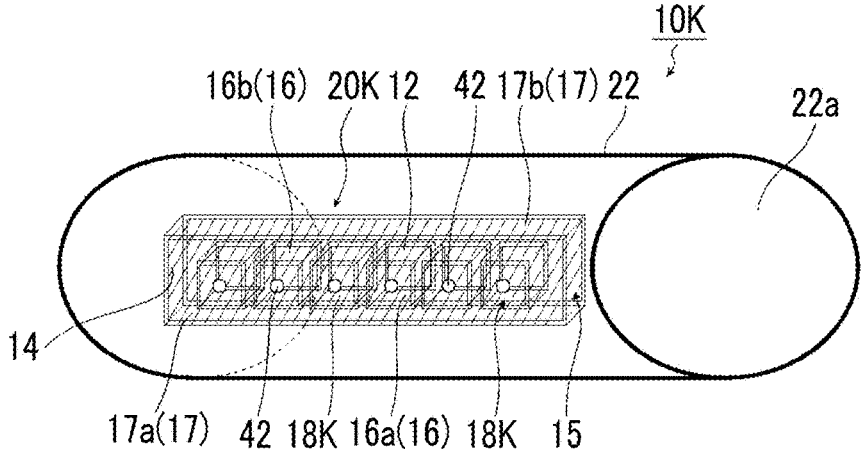
FIG. 54 is a perspective view schematically showing an example of a soundproof structure according to Embodiment 12 of the present invention.

FIG. 54 is a perspective view schematically showing an example of a soundproof structure according to Embodiment 12 of the present invention.

A soundproof structure 10K of the present embodiment shown in FIG. 54 has a structure in which a soundproof cell unit 20K, in which a plurality of soundproof cells 18K each having a frame 14 having a hole portion 12 penetrating therethrough, a film 16 (16*a* and 16*b*) fixed to the frame 14 so as to cover both surfaces of the hole portion 12, and a through-hole 42 drilled in one film 16*a* are arranged (in the illustrated example, six soundproof cells 18K are arranged in a column), is disposed in the aluminum tubular body 22 (its opening 22*a*), which is an opening member of the present invention, in a state in which the film surface of the film 16 is inclined with respect to the opening cross section 22*b* of the tubular body 22 and a region serving as a ventilation hole through which gas passes is provided in the opening 22*a* in the tubular body 22 (refer to FIG. 14).

Since the soundproof structure 10K of the present embodiment shown in FIG. 54 has the same configuration as the soundproof structure 10C of Embodiment 4 shown in FIG. 8 except that the through-hole 42 is drilled in one film 16*a* of the films 16 fixed to both surfaces of the hole portion 12 of the frame 14, the explanation of the same configuration will be omitted.

In the soundproof structure 10K of the present embodiment, since the through-hole 42 is formed in the film 16*a*, it is possible to improve the controllability of sound insulation performance compared with a soundproof structure having no through-hole as in the soundproof structures 10 and 10A to 10I of Embodiments 1 to 10.

That is, by changing the diameter weight of the through-hole 42, it is possible to control the frequency of the first sound insulation peak and the sound insulation performance.

In the soundproof structure 10K of Embodiment 12, since there is no need to add the weight 40 unlike in the soundproof structure 10J of Embodiment 11, it is possible to provide a lighter soundproof structure.

In the soundproof cell unit 20K, the through-hole 42 is drilled only in the film 16*a*. However, the present invention is not limited thereto, and may be drilled only in the film 16*b* or may be formed in both the films 16*a* and 16*b*. In addition, although the films 16*a* and 16*b* are fixed to both surfaces of the frame 14, the films 16*a* and 16*b* may be fixed to only one of the surfaces, and it is needless to say that the through-hole 42 is formed in the film 16.

In the following explanation, in a case where it is not necessary to specifically describe the film 16*a* in which the through-hole 42 is formed, the film 16*a* is represented by the film 16.

The shape of the through-hole 42 is not limited to the circular shape shown in FIG. 54, and can be the above-described various shapes similar to the shape of the hole portion 12 of the frame 14, accordingly, the shape of the film 16. However, it is preferable that the shape of the through-hole 42 is the same as the shape of the film 16.

The position where the through-hole 42 is provided in the film 16 corresponding to the hole portion 12 may be the middle or the center of the soundproof cell 18D or the film 16 for all the through-holes 42, or at least some of the through-holes 42 may be drilled at positions that are not the center. That is, this is because the sound insulation characteristics of the soundproof structure 10K and the soundproof cell unit 20K of the present invention are not changed simply by changing the drilling position of the through-hole 42.

In the present invention, however, it is preferable that the through-hole 42 is drilled in a region within a range away from the fixed end of the peripheral portion of the hole portion 12 more than 20% of the size of the surface of the film 16. Most preferably, the through-hole 42 is provided at the center of the film 16.

In the present embodiment, one through-hole 42 may be provide in one film 16 as shown in FIG. 54, but a plurality of (two or more) through-holes 42 may be provide in one film 16. The frequency of the first sound insulation peak and the sound insulation performance may be controlled by changing the number of through-holes 42 provided in one film 16 instead of changing the diameter of the through-hole 42.

In a case where a plurality of through-holes 42 are provided in one film 16, a circle equivalent diameter may be calculated from the total area of the plurality of through-holes 42, and be used as a size corresponding to one through-hole. Alternatively, an area ratio between the total area of the plurality of through-holes 42 and the area of the film 16 corresponding to the hole portion 12 may be calculated, and the size of the through-hole 42 may be expressed by the area ratio of the through-hole 42, that is, the opening ratio.

In a case where a plurality of through-holes 42 are present in one soundproof cell 18K, the sound insulation characteristics of the soundproof structure 10K and the soundproof cell unit 20K of the present invention indicate sound insulation characteristics corresponding to the total area of the plurality of through-holes 42, that is, a corresponding sound insulation peak at the corresponding sound insulation peak frequency. Therefore, it is preferable that the total area of the plurality of through-holes 42 in one soundproof cell 18K (or the film 16) is equal to the area of one through-hole 42 that is only provided in another soundproof cell 18K (or the film 16). However, the present invention is not limited thereto.

In a case where the opening ratio of the through-hole 42 in the soundproof cell 18K (the area ratio of the through-hole 42 to the area of the film 16 covering the hole portion 12 (the ratio of the total area of all the through-holes 42)) is the same, the same soundproof cell unit 20K is obtained with the single through-hole 42 and the plurality of through-holes 42. Accordingly, even if the size of the through-hole 42 is fixed to any size, it is possible to manufacture soundproof structures corresponding to various frequency bands.

In the present embodiment, the opening ratio (area ratio) of the through-hole 42 in the soundproof cell 18K is not particularly limited, and may be set according to the sound insulation frequency band to be selectively insulated. The opening ratio (area ratio) of the through-hole 42 in the soundproof cell 18K is preferably 0.000001% to 50%, more preferably 0.00001% to 20%, and even more preferably 0.0001% to 10%. By setting the opening ratio of the through-hole 42 within the above range, it is possible to determine the sound insulation peak frequency, which is the center of the sound insulation frequency band to be selectively insulated, and the transmission loss at the sound insulation peak.

From the viewpoint of manufacturing suitability, it is preferable that the soundproof cell unit 20K of the present embodiment has a plurality of through-holes 42 with the same size in one soundproof cell 18D. That is, it is preferable that a plurality of through-holes 42 having the same size are drilled in the film 16 of each soundproof cell 18D.

In the soundproof cell unit 20D, it is preferable that one through-hole 42 of each of all the soundproof cells 18K has the same size.

In the present invention, it is preferable that the through-hole 42 is drilled using a processing method for absorbing energy, for example, laser processing, or it is preferable that the through-hole 42 is drilled using a mechanical processing method based on physical contact, for example, punching or needle processing.

Therefore, assuming that a plurality of through-holes 42 in one soundproof cell 18K or one or a plurality of through-holes 42 in all the soundproof cells 18D are made to have the same size, in the case of drilling holes by laser processing, punching, or needle processing, it is possible to continuously drill holes without changing the setting of a processing apparatus or the processing strength.

In the soundproof structure 10 of the present invention, the size of the through-hole 42 in the soundproof cell 18K (or the film 16) may be different for each soundproof cell 18K (or the film 16).

The size of the through-hole 42 may be any size as long as the through-hole 42 can be appropriately drilled using the above-described processing method. Although the size of the through-hole 42 is not particularly limited, the size of the through-hole 42 needs to be smaller than the size of the film 16 that is the size of the hole portion 12.

However, from the viewpoint of processing accuracy of laser processing such as accuracy of laser stop, processing accuracy of punching or needle processing, manufacturing suitability such as easiness of processing, and the like, the size of the through-hole 42 on the lower limit side thereof is preferably 100 μm or more.

The upper limit of the size of the through-hole 42 needs to be smaller than the size of the frame 14. Therefore, since the size of the frame 14 is normally in mm order, the upper limit of the size of the through-hole 42 does not exceed the size of the frame 14 in a case where the size of the through-hole 42 is set to the order of several hundred micrometers. In a case where the upper limit of the size of the through-hole 42 exceeds the size of the frame 14, the upper limit of the size of the through-hole 42 may be set to be equal to or less than the size of the frame 14.

The size of the through-hole 42 is preferably expressed by an average size, for example, in a case where different sizes are included in a plurality of films 16.

The configuration of the soundproof structure of the present embodiment in which a through-hole is provided in the film can be applied not only to one soundproof cell 18 of the soundproof structure 10 of Embodiment 1 and one soundproof cell 18B of the soundproof structure 10B of embodiment 3 but also to a plurality of soundproof cells 18A of the soundproof structure 10 of Embodiment 2 and the respective soundproof cells 18C to 18I of the soundproof structures 10D to 10I of Embodiments 1 to 10.

In the soundproof cell unit 20K of the soundproof structure 10K of the present embodiment shown in FIG. 54, a PET film having a thickness of 100 μm is fixed to both surfaces of the frame 14 as the film 16 by a double-sided adhesive tape similarly to the configuration of the soundproof structure 10C of Embodiment 4. In addition, the through-hole 42 having a diameter of 2 mm is formed at the center of the PET film 16*a* on one surface of the frame 14 of the soundproof cell 18K.

Figure 55A:
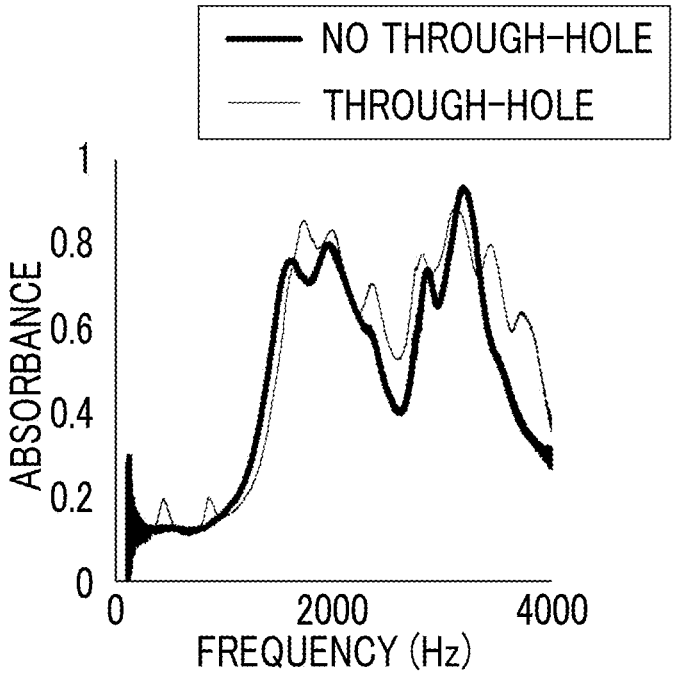
FIG. 55A is a graph showing the sound absorption characteristics of the soundproof structure shown in FIG. 54.
Figure 55B:
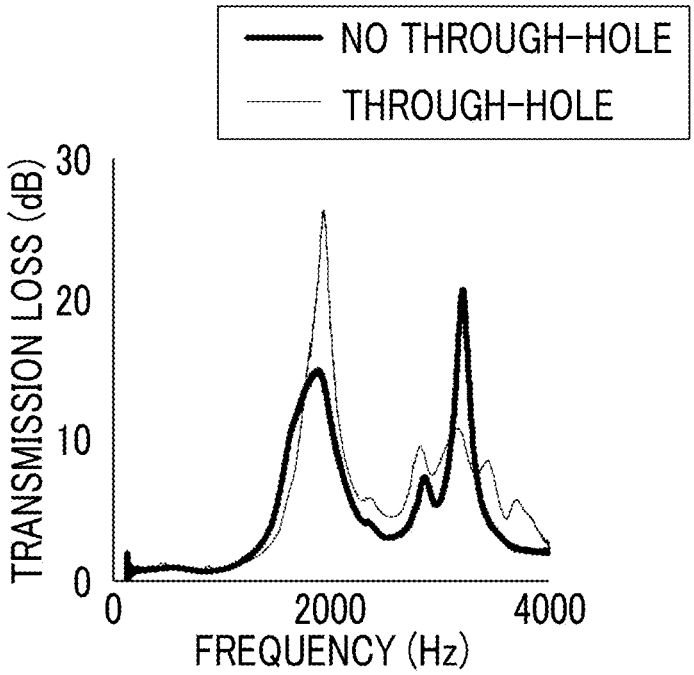
FIG. 55B is a graph showing the sound insulation characteristics of the soundproof structure shown in FIG. 54.

FIGS. 55A and 55B show the measurement results of the absorbance and the transmission loss of the soundproof structure 10K of Embodiment 12 and a soundproof structure (corresponding to the soundproof structure 10C of Embodiment 4), which has the same configuration as the soundproof structure 10K but is different from the soundproof structure 10K in that the through-hole 42 is not formed in the film 16*a*, using the measurement system shown in FIG. 13.

For the absorbance shown in FIG. 55A, it can be seen that absorption in a valley (2625 Hz) between the absorption peaks and absorption on the high frequency side (3000 Hz to 4000 Hz) are larger than in a case where there is no through-hole. Therefore, in the broadband sound absorption, the soundproof structure of Embodiment 12 is preferable.

In the transmission loss shown in FIG. 55B, a sound insulation peak on the low frequency side of 1915 Hz is increased. Therefore, in the low frequency sound insulation, the soundproof structure of Embodiment 12 is preferable.

Thirteenth Embodiment

Figure 56:
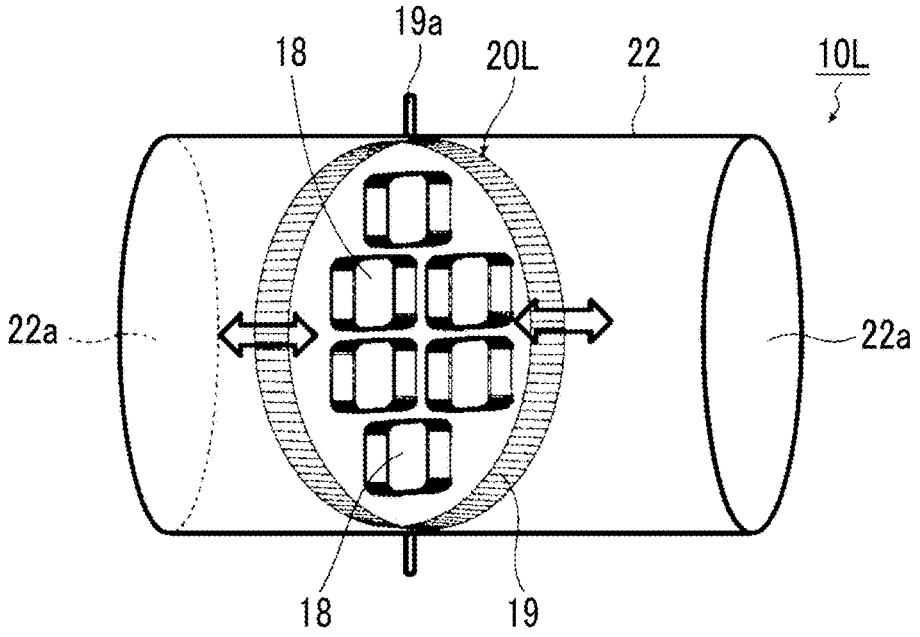
FIG. 56 is a perspective view schematically showing an example of a soundproof structure according to Embodiment 13 of the present invention.

FIG. 56 is a perspective view schematically showing an example of a soundproof structure according to Embodiment 13 of the present invention.

A soundproof structure 10L of Embodiment 13 shown in FIG. 56 includes a plurality of soundproof cells 18 (in the illustrated example, six soundproof cells 18), and a soundproof cell unit 20L configured to include a disk-shaped soundproof frame member 19 having a diameter smaller than the inner diameter of the tubular body 22 is rotatably disposed in the tubular body 22 so that the inclination of the tubular body 22 with respect to the opening cross section can be changed. Therefore, it is possible to adjust the opening ratio of the ventilation hole. That is, the inclination angle of the film surface of the soundproof cell 18 with respect to the opening cross section can be adjusted.

A method of rotatably arranging the soundproof cell unit 20L in the tubular body 22 is not particularly limited, and conventionally known arrangement methods and supporting methods can be used. For example, a rod-shaped support axis 19*a* extending on the extension line on both sides of one diameter of the disk-shaped soundproof frame member 19 of the soundproof cell unit 20L can be attached and a bearing or a bearing hole can be provided on the tube wall of one inner diameter of the tubular body 22, so that the rod-shaped support axis 19*a* of the disk-shaped soundproof frame member 19 can be rotatably supported by the bearing or the bearing hole of the tubular body 22.

As a soundproof cell provided in the soundproof cell unit 20L, any of the soundproof cells 18 and 18A to 18K of Embodiments 1 to 12 described above may be used.

Fourteenth Embodiment

Figure 57A:
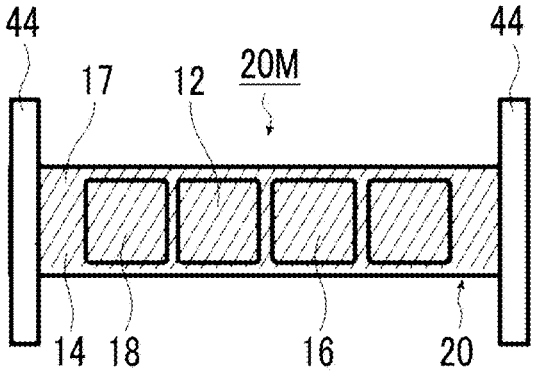
FIG. 57A is a front view schematically showing an example of a soundproof cell unit used in a soundproof structure according to Embodiment 14 of the present invention.
Figure 57B:
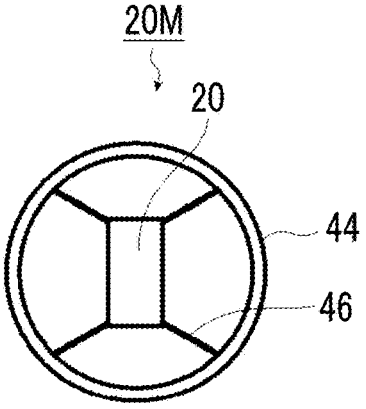
FIG. 57B is a side view of the soundproof cell unit shown in FIG. 57A.

FIGS. 57A and 57B are a front view and a side view schematically showing an example of a soundproof cell unit used in a soundproof structure according to Embodiment 14 of the present invention, respectively.

A soundproof cell unit 20M shown in FIGS. 57A and 57B has a soundproof cell unit 20M having a rectangular parallelepiped shape, in which a plurality of soundproof cells 18 each having a frame 14 having a hole portion 12 penetrating therethrough and a film 16 fixed to the frame 14 so as to cover both surfaces of the hole portion 12 are arranged (in the illustrated example, four soundproof cells 18 are arranged in a column), two annular support frame bodies 44 disposed at both ends of the soundproof cell unit 20M, and four linear support members 46 for fixing the four corners at both ends of the quadrangular shape of the soundproof cell unit 20M on the inner peripheral surface of each annular support frame body 44.

The soundproof cell unit 20M of Embodiment 14 having the above-described configuration can be easily disposed in the tubular body and can be easily removed.

As a soundproof cell unit used in the soundproof cell unit 20M and a soundproof cell provided therein, any of the soundproof cell units 20, 20C, 20D, and 20H to 20K of Embodiments 2, 4, 5, and 9 to 12 described above and the soundproof cells 18, 18D, and 18H to 18K may be used.

Fifteenth Embodiment

The soundproof structure of the present invention is not limited to one in which the soundproof cell unit is disposed in the tubular body, such as the plurality of soundproof structures described above. In addition to the inside of the tubular body 22, for example, as in the soundproof structure 50 according to Embodiment 15 of the present invention shown in FIG. 58, four soundproof cell units 20N of Embodiment 15 can be arranged in parallel in an opening 56*a* of an opening member 56 disposed on a wall 54 of a house 52, and this can be used as a soundproof louver 58.

Figure 58:
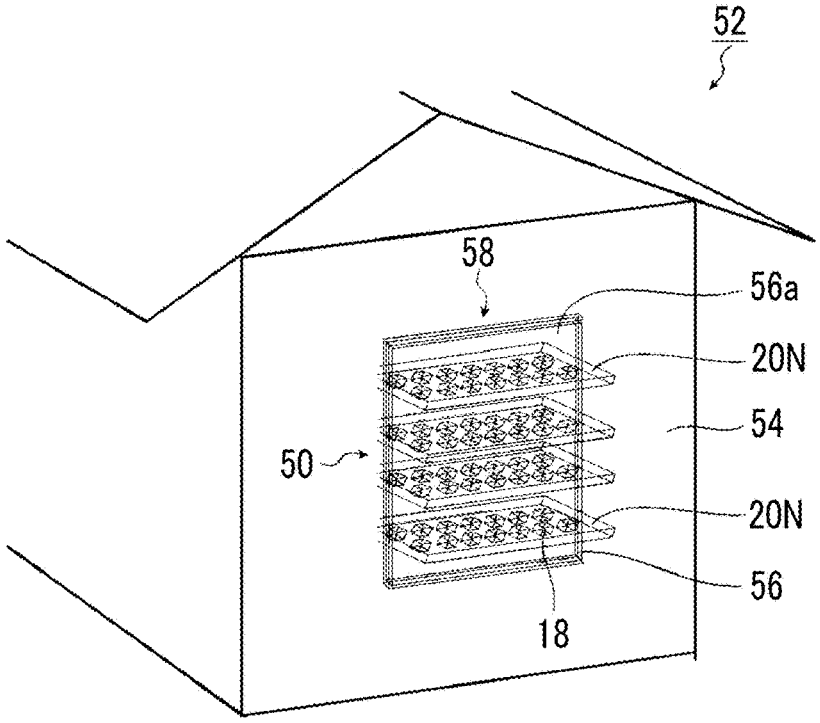
FIG. 58 is a perspective view schematically showing an example of a soundproof structure according to Embodiment 15 of the present invention.

In FIG. 58, the soundproof cell unit 20N used in the soundproof structure 50 of Embodiment 15 is a flat plate shaped soundproof cell unit in which seven soundproof cells 18 are arranged in two columns. However, the number of soundproof cells 18 and the arrangement method are not particularly limited. The number of soundproof cells 18 may be any number, and either one dimension arrangement or two dimension arrangement may be used.

In the illustrated example, the soundproof cell unit 20N used in the soundproof structure 50 of Embodiment 15 is disposed such that the angle of the film surface of the soundproof cell 18 with respect to the opening 56*a* is 90°. However, the angle is not limited, and can be adjusted according to a desired transmission loss peak or an opening ratio (ventilation).

As a soundproof cell unit used in the soundproof cell unit 20N and a soundproof cell provided therein, any of the soundproof cell units 20, 20C, 20D, and 20H to 20K of Embodiments 2, 4, 5, and 9 to 12 and the soundproof cells 18 and 18A to 18K may be used.

Figure 59:
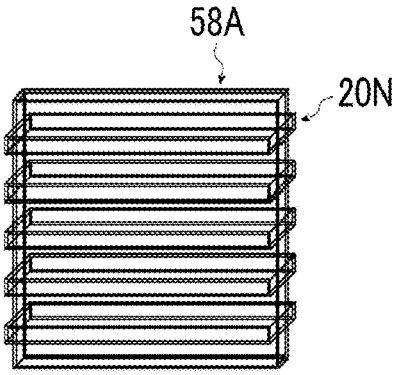
FIG. 59 is a perspective view schematically showing an example of a soundproof louver used in the soundproof structure according to Embodiment 15 of the present invention.

As an example of such a structure, as shown in FIG. 59, the transmission loss of a soundproof louver 58A in which a plurality of soundproof cell units 20N were arranged in parallel was measured.

Figure 60A:
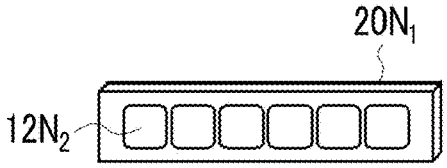
FIG. 60A is a diagram schematically showing an example of a soundproof cell unit used in the soundproof louver according to FIG. 59.
Figure 60B:
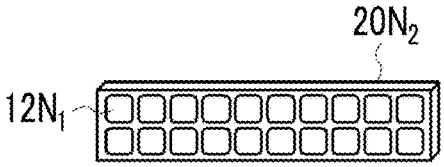
FIG. 60B is a diagram schematically showing an example of a soundproof cell unit used in the soundproof louver according to FIG. 59.

A soundproof cell unit 20$N_1$ shown in FIG. 60A or a soundproof cell unit 20$N_2$ shown in FIG. 60B was used as the soundproof cell unit 20N. The soundproof cell unit 20$N_1$ includes six through-holes 12$N_1$ of 40 mm square (1 (vertical)×6 (horizontal)) on an acrylic plate having a width (vertical) of 50 mm×length (horizontal) of 300 mm×thickness of 20 mm, and a PET film having a thickness of 250 μm is fixed to both surfaces of the through-hole 12$N_1$ by a double-sided adhesive tape. The soundproof cell unit 20$N_2$ has the same configuration as the soundproof cell unit 20$N_1$ except that the soundproof cell unit 20$N_2$ includes twenty through-holes 12$N_2$ of 20 mm square (2 (vertical)×10 (horizontal)).

Figure 61:
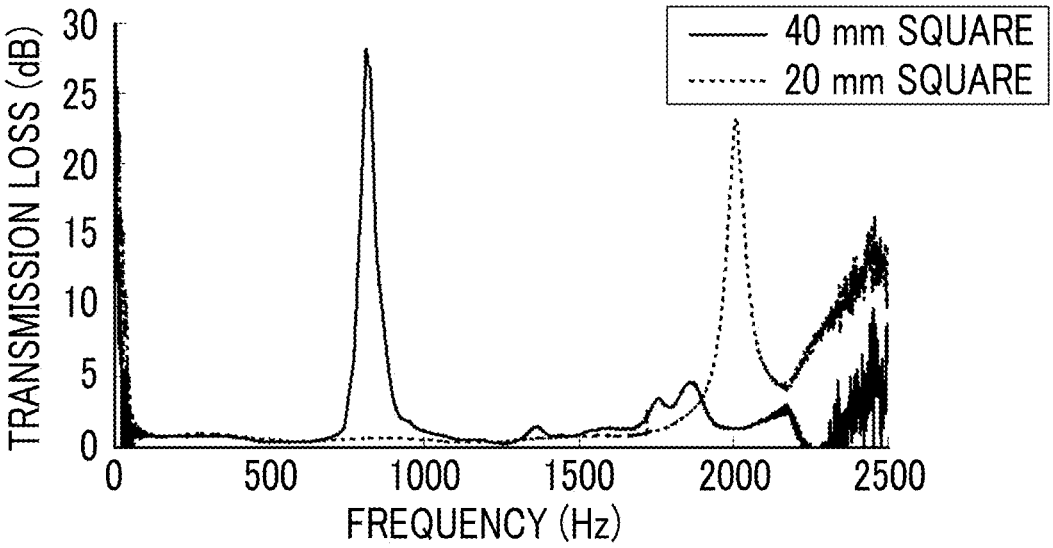
FIG. 61 is a diagram showing the transmission loss in a soundproof structure in which the soundproof cell unit according to FIG. 60A or 60B is disposed in an acoustic tube (tubular body).

As in the measurement system shown in FIG. 29, FIG. 61 shows the measurement result of the transmission loss of a soundproof structure in which the soundproof cell unit 20$N_1$ or 20$N_2$ is disposed in the acoustic tube (tubular body). The solid line shows the transmission loss of a soundproof structure in which the soundproof cell unit 20$N_1$ is disposed in the acoustic tube, and the broken line shows the transmission loss of a soundproof structure in which the soundproof cell unit 20$N_2$ is disposed in the acoustic tube.

From FIG. 61, it can be seen that there is a high transmission loss peak at about 820 Hz in case of the soundproof structure using the soundproof cell unit 20$N_1$ having the through-hole 12$N_1$ of 40 mm square and a high transmission loss peak at about 2000 Hz in case of the soundproof structure using the soundproof cell unit 20$N_2$ having the through-hole 12$N_2$ of 20 mm square.

Figure 62:
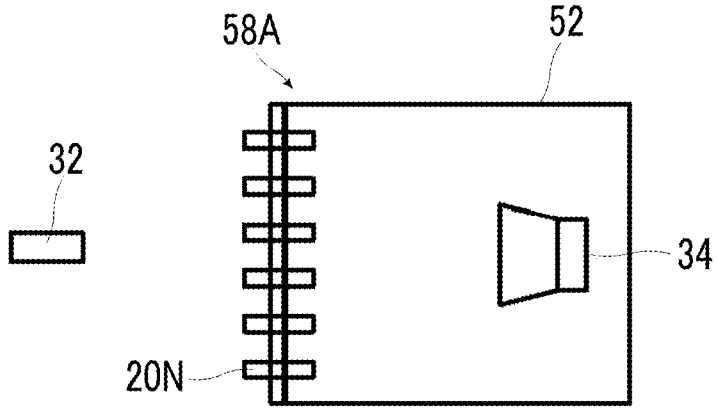
FIG. 62 is a perspective view illustrating an example of a measurement system for measuring the soundproofing performance of the soundproof structure according to FIG. 58 of the present invention.

The transmission loss of the soundproof louver 58A was measured by a measurement system shown in FIG. 62.

A speaker 34 was housed in an acrylic box (300 mm square cubic) 52 having one surface open, and the soundproof louver 58A was disposed on the opening surface. White noise sound was output from the speaker 34, and the sound flowing from the opening was detected by one microphone 32. The transmission loss was calculated from the ratio of the sound pressure detected in a case where the soundproof louver 58A was disposed in the opening of the acrylic box 52 to the sound pressure detected in a case where the soundproof louver 58A was not disposed in the opening of the acrylic box 52.

The film surface of the film fixed to the soundproof cell unit 20$N_1$ or 20$N_2$ disposed in the soundproof louver 58A is disposed so as to be perpendicular to the opening surface of the acrylic box 52.

Figure 63A:
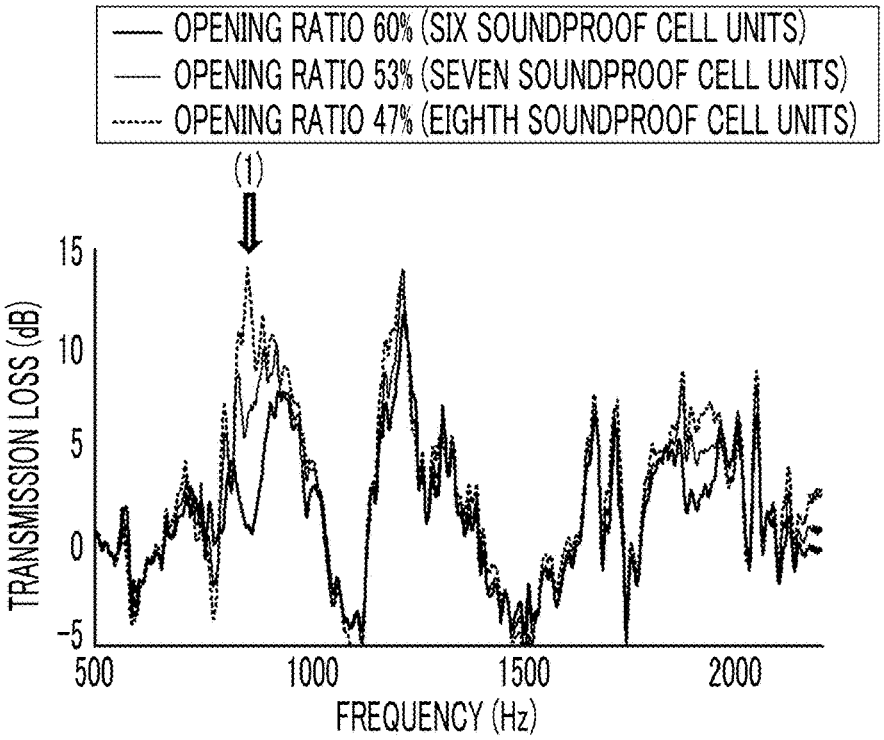
FIG. 63A is a graph showing the sound insulation characteristics of soundproof louvers that include the soundproof cell unit shown in FIG. 60A and have different opening ratios (number of louvers).
Figure 63B:
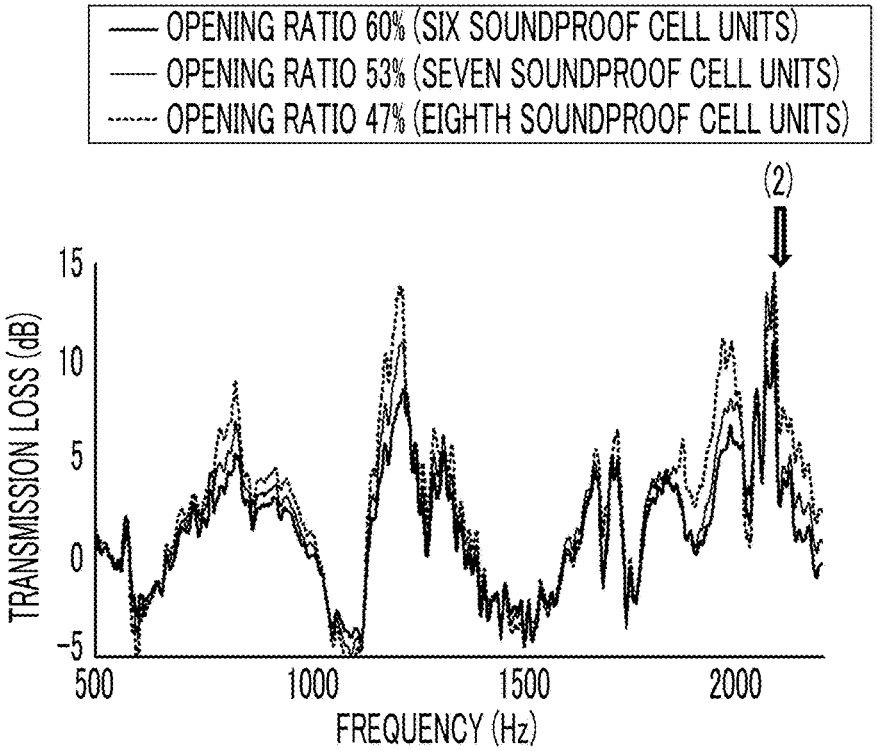
FIG. 63B is a graph showing the sound insulation characteristics of soundproof louvers that include the soundproof cell unit shown in FIG. 60B and have different opening ratios (number of louvers).

FIGS. 63A and 63B show the measurement results of the transmission loss of the soundproof louver 58A in which the soundproof cell units 20$N_1$ or 20$N_2$ are disposed in parallel by changing the number of soundproof cell units 20$N_1$ or 20$N_2$ to 6 (opening ratio of 60%), 7 (opening ratio of 53%), and 8 (opening ratio of 47%).

It can be seen that a high transmission loss peak (1) occurs near 850 Hz in case of the soundproof louver 58A using the soundproof cell unit 20$N_1$ having the through-hole 12$N_1$ of 40 mm square as shown in FIG. 63A and a high transmission loss peak (2) occurs near 2080 Hz in case of the soundproof louver 58A using the soundproof cell unit 20$N_2$ having the through-hole 12$N_2$ of 20 mm square as shown in FIG. 63B. In addition, it can be seen that each of these transmission loss peaks occurs near the frequency at which the transmission loss peak occurs in the soundproof structure in which the soundproof cell unit 20$N_1$ or 20$N_2$ is disposed in the acoustic tube (tubular body) shown in FIG. 61.

From FIGS. 63A and 63B, it can be seen that the transmission loss peak increases as the number of soundproof cell units 20N disposed in the soundproof louver 58A increases, that is, as the opening ratio decreases.

The transmission loss spectrum of the soundproof structure in which the soundproof cell unit 20$N_1$ or 20$N_2$ is disposed in the acoustic tube shown in FIG. 61 and the transmission loss spectrum of the soundproof louver using the soundproof cell unit 20$N_1$ or 20$N_2$ shown in FIG. 63A or 63B shows the same change except for the transmission loss peak height. Therefore, it can be seen that the transmission loss peak shown in FIG. 63A or 63B is not due to the structure of the soundproof louver but due to shielding due to the vibration of the film fixed to the soundproof cell unit 20$N_1$ or 20$N_2$ provided in the soundproof louver.

Sixteenth Embodiment

Figure 64:
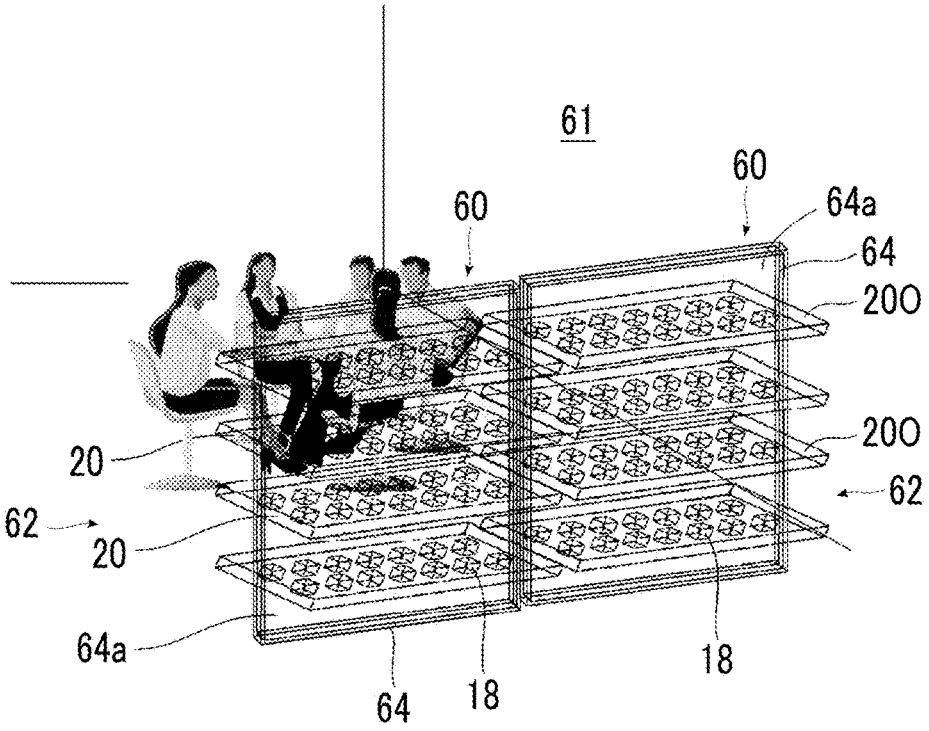
FIG. 64 is a perspective view schematically showing an example of a soundproof structure according to Embodiment 16 of the present invention.

The soundproof structure of the present invention can also be used as a soundproof wall or a soundproof partition 62 disposed in a space 61, such as a room of a house, a building, a factory, or the like, for example, like a soundproof structure 60 according to Embodiment 16 of the present invention shown in FIG. 64. Here, a room or the like of a house, a building, a factory, or the like having the space 61 corresponds to the opening member, and the soundproof wall or the soundproof partition may be a fixed wall or a fixed partition that is fixed to, for example, the floor in the space 61, or may be a movable wall or a movable partition wall that can move, for example, on the floor in the space 61.

In the soundproof partition 62 shown in FIG. 64, four soundproof cell units 20O of Embodiment 9 are arranged in parallel in an opening 64*a* of a frame body 64 of a partition that is an opening cross section.

Also in the soundproof structure 60 of Embodiment 16, the soundproof cell unit 20O can be used as in the soundproof structure 50 of Embodiment 15 described above.

Seventeenth Embodiment

Figure 65:
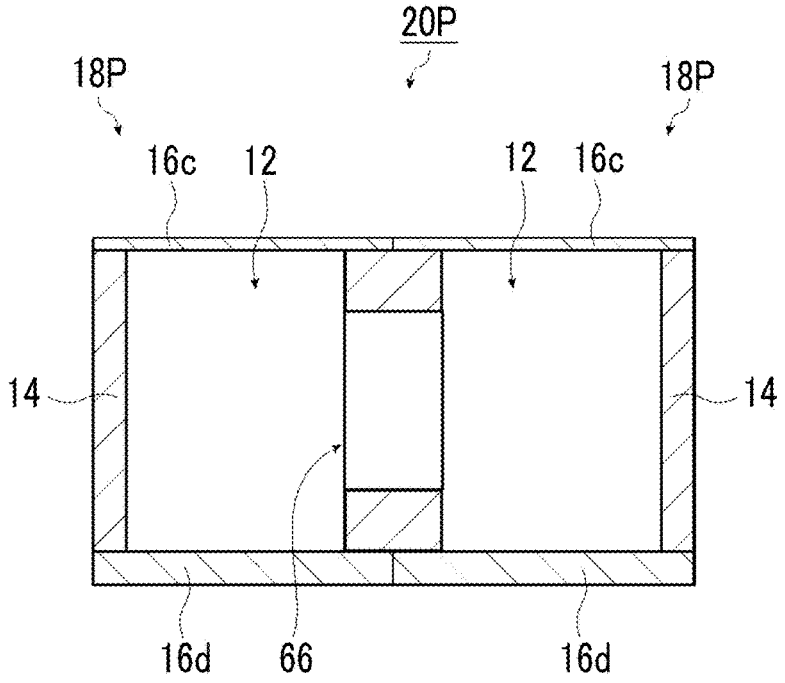
FIG. 65 is a cross-sectional view schematically showing an example of a soundproof cell unit used in a soundproof structure according to Embodiment 17 of the present invention.

FIG. 65 is a cross-sectional view schematically showing an example of a soundproof cell unit used in a soundproof structure according to Embodiment 17 of the present invention. A soundproof cell unit 20P shown in FIG. 65 has a structure in which two soundproof cells 18P, each of which has the same configuration as the soundproof cell 18D of Embodiment 5 and has two films 16 having different resonance frequencies, are arranged and a through opening 66 communicating with the film rear surface space of each of the two soundproof cells 18P, that is, a space in the hole portion 12 is formed.

As an example of the soundproof cell unit 20P having such a structure, for a configuration in which the film 16*c* of one soundproof cell 18P is a PET film having a thickness of 75 μm and the film 16*d* is an acrylic plate having a thickness of 2 mm, the film 16*c* of the other soundproof cell 18P is a PET film having a thickness of 50 μm and the film 16*d* is an acrylic plate having a thickness of 2 mm, and the through opening 66 of 1 cm square is provided in the frame 14 forming the film rear surface space of the soundproof cell 18P so that the rear surface space of the soundproof cell 18P is communicated (hereinafter referred to as "configuration 1"), the measurement result of the absorbance is shown in FIG. 36.

Figure 66:
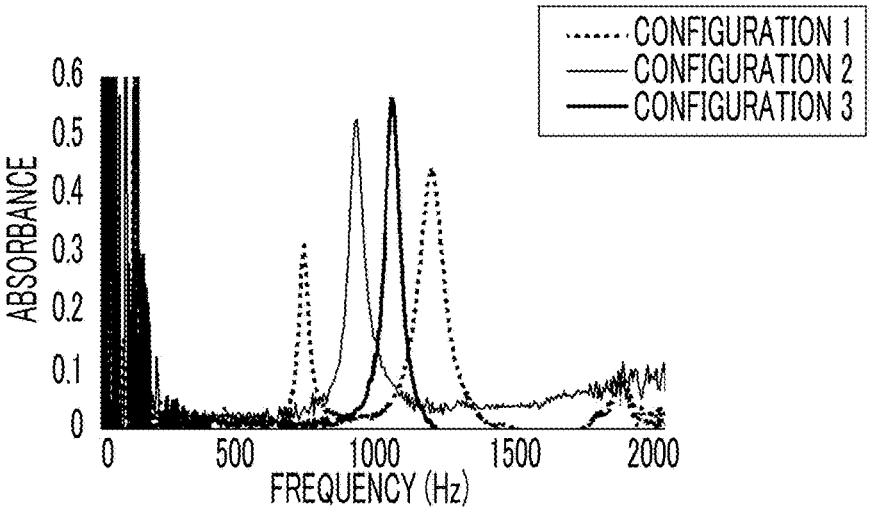
FIG. 66 is a graph showing the sound absorption characteristics of the soundproof cell unit (configurations 1 to 3) shown in FIG. 65.

As other examples, for a configuration in which the film 16*c* of one soundproof cell 18P is a PET film having a thickness of 50 μm and the film 16*d* is an acrylic plate having a thickness of 2 mm, the film 16*c* of the other soundproof cell 18P is an acrylic plate having a thickness of 2 mm and the film 16*d* is an acrylic plate having a thickness of 2 mm, and the through opening 66 of 1 cm square is provided in the frame 14 forming the film rear surface space of the soundproof cell 18P so that the rear surface space of the soundproof cell 18P is communicated (hereinafter referred to as "configuration 2") and a configuration in which the film 16*c* of one soundproof cell 18B is a PET film having a thickness of 75 μm and the film 16*d* is an acrylic plate having a thickness of 2 mm, the film 16*c* of the other soundproof cell 18P is an acrylic plate having a thickness of 2 mm and the film 16*d* is an acrylic plate having a thickness of 2 mm, and the through opening 66 of 1 cm square is provided in the frame 14 forming the film rear surface space of the soundproof cell 18P so that the rear surface space of the soundproof cell 18P is communicated (hereinafter referred to as "configuration 3"), the measurement result of the absorbance using the measurement system shown in FIG. 13 is shown in FIG. 66.

As shown in FIG. 66, since soundproof cells having different film thicknesses share the film rear surface space, the frequency shift of the absorption peak occurs, and the absorption peak frequency on the low frequency side shifts to the lower frequency side, which is preferable.

Figure 67:
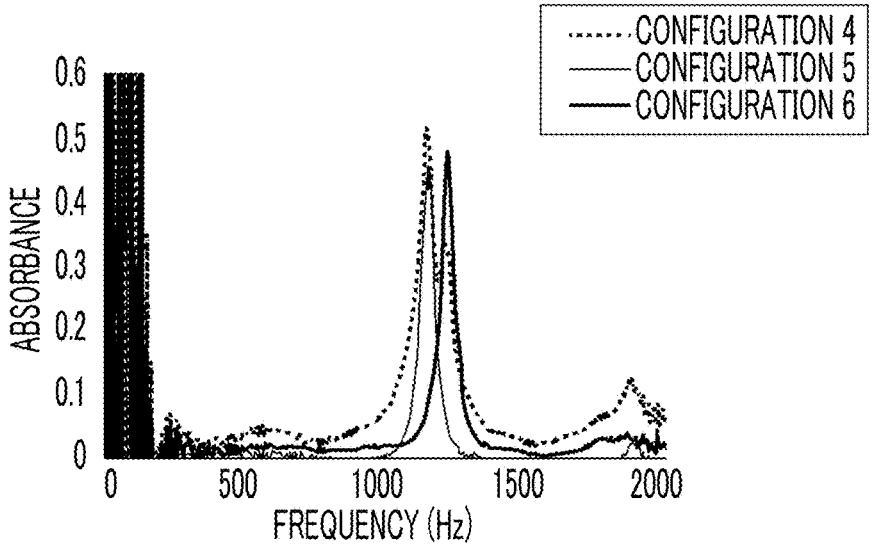
FIG. 67 is a graph showing the sound absorption characteristics of the soundproof cell unit (configurations 4 to 6) shown in FIG. 65.

For configurations 4 to 6 that are the same configurations as the above-described configurations 1 to 3 except that the through opening 66 communicating with the film rear surface spaces of both the soundproof cells 18P is not formed, the measurement result of the absorbance using the measurement system shown in FIG. 13 is shown in FIG. 67.

As shown in FIG. 67, in a case where there is no through opening 66 communicating with the film rear surface spaces of both the soundproof cells 18P, the waveform of the absorbance of the configuration 4 in which the thickness of the film 16 of each soundproof cell 18P is made different is only in a state in which the absorption peaks of the configurations 5 and 6 having different film thicknesses overlap each other. Therefore, it can be seen that no frequency shift occurs.

Hereinafter, the physical properties or characteristics of a structural member that can be combined with a soundproof member having the soundproof structure of the present invention will be described.

[Flame Retardancy]

In the case of using a soundproof member having the soundproof structure of the present invention as a soundproof material in a building or a device, flame retardancy is required.

Therefore, the film is preferably flame retardant. As the film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the film to the frame, a bonding method using a flame-retardant adhesive (Three Bond 1537 series (manufactured by Three Bond Co. Ltd.)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray Industries, Inc.) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure of the present invention is disposed outdoors or in a place where light is incident, the weather resistance of the structural member becomes a problem.

Therefore, as a film, it is preferable to use a weather-resistant film, such as a special polyolefin film (ARTPLY (registered trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As a frame material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

Figure 68:
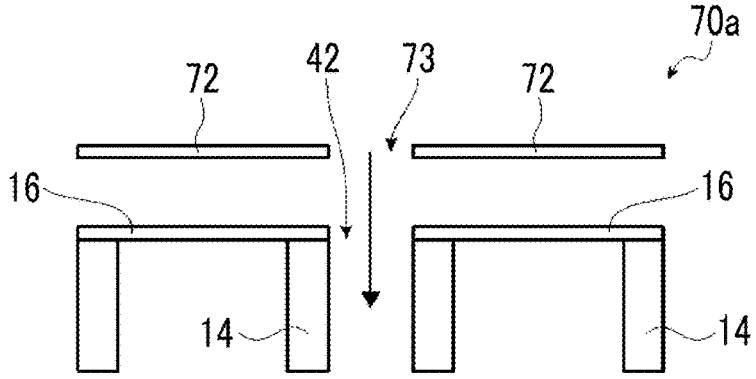
FIG. 68 is a schematic cross-sectional view of an example of a soundproof member having the soundproof structure of the present invention.
Figure 69:
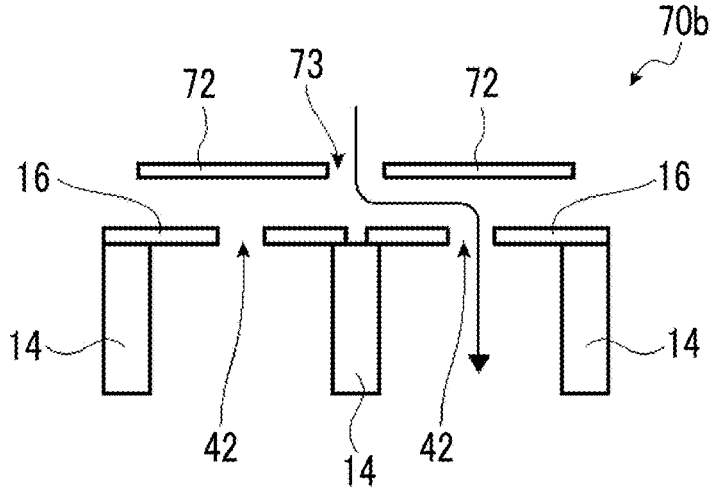
FIG. 69 is a schematic cross-sectional view of another example of the soundproof member having the soundproof structure of the present invention.
Figure 70:
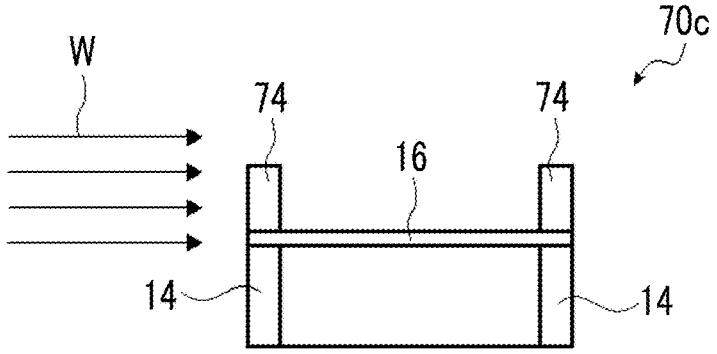
FIG. 70 is a schematic cross-sectional view of another example of the soundproof member having the soundproof structure of the present invention.
Figure 71:
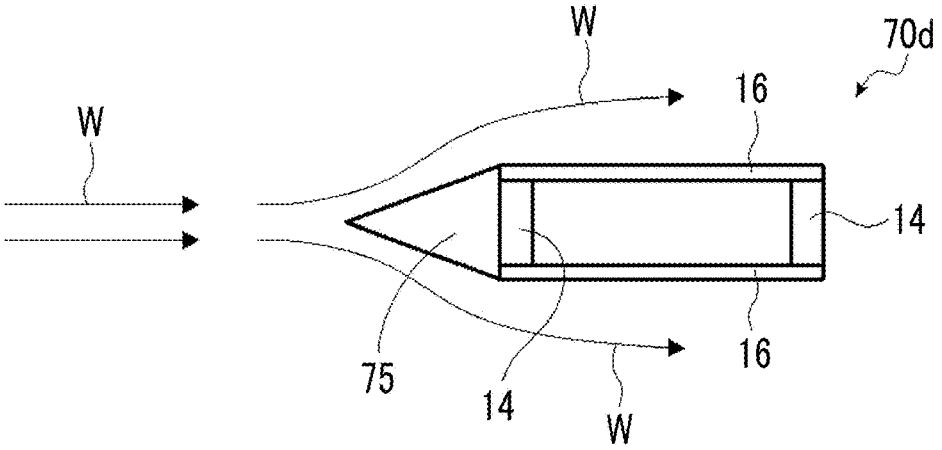
FIG. 71 is a schematic cross-sectional view of another example of the soundproof member having the soundproof structure of the present invention.

In the case of the soundproof structure 10K having the through-hole 42 serving as a ventilation hole in the film 16 as shown in FIG. 54, it is preferable to drill a hole 73 in a cover 72 provided on the film 16, as in soundproof members 70*a* and 70*b* shown in FIGS. 68 and 69, in order to prevent wind or dust from becoming in direct contact with the film 16.

As a method of removing adhering dust, it is possible to remove dust by emitting sound having the resonance frequency of a film and strongly vibrating the film. The same effect can be obtained even if a blower or wiping is used.

[Wind Pressure]

In a case where a strong wind hits a film, the film may be pressed to change the resonance frequency. Therefore, by covering the film with a nonwoven fabric, urethane, and/or a film, the influence of wind can be suppressed. In the case of the soundproof structure 10K having the through-hole 42 in the film 16 as shown in FIG. 54, in the same manner as in the above case of dust, it is preferable to drill the hole 73 in the cover 72 provided on the film 16, as in the soundproof members 70*a* and 70*b* shown in FIGS. 68 and 69, in order to prevent wind from becoming in direct contact with the film 16.

In a soundproof member 70*c* using the soundproof structure of the present invention in which a film is inclined with respect to sound waves, the film surface is not parallel to the movement direction (vector) of sound. Accordingly, since the wind may suppress the film to affect the vibration, it is preferable to provide a wind prevention frame 74 for preventing wind W from directly hitting the film 16 on the film 16.

In a soundproof member 70*d* using the soundproof structure of the present invention, in order to suppress the influence (wind pressure on the film, wind noise) due to turbulence caused by blocking the wind W on the side surface of the soundproof member, it is preferable to provide a flow control mechanism 75, such as a flow straightening plate for rectifying the wind W, on the side surface of the soundproof member.

[Combination of Unit Cells]

The soundproof structures 10, 10A, 10B, 10C, 10D, 10E, 10F, 10G, 10H, 10J, 10L, 50, and 60 of the present invention shown in FIGS. 1, 4, 6, 8, 10, 42, 43, 46, 48, 49, 52, 56, 58, and 64 are formed by the frame member 15 or one frame member in which a plurality of frames 14 are continuous, such as the disk-shaped soundproof frame member 19. However, the present invention is not limited thereto, and the soundproof structures 10, 10A, 10B, 10C, 10D, 10E, 10F, 10G, 10H, 10J, 10L, 50, and 60 of the present invention shown in FIGS. 1, 4, 6, 8, 10, 42, 43, 46, 48, 49, 52, 56, 58, and 64 may be a soundproof cell as a unit cell having one frame and one film attached to the frame or as a unit cell having the one frame, the one film, and a through-hole formed in the film. That is, the soundproof member having the soundproof structure of the present invention does not necessarily need to be formed by one continuous frame body, and may be a soundproof cell having a frame structure as a unit cell and a film structure attached thereto or a soundproof cell having one frame structure, one film structure, and a hole structure formed in the film structure. Such a unit cell can be used independently, or a plurality of unit cells can be connected and used.

As a method of connecting a plurality of unit cells, as will be described later, a Magic Tape (registered trademark), a magnet, a button, a suction cup, and/or an uneven portion may be attached to a frame body portion so as to be combined therewith, or a plurality of unit cells can be connected using a tape or the like.

[Arrangement]

Figure 72:
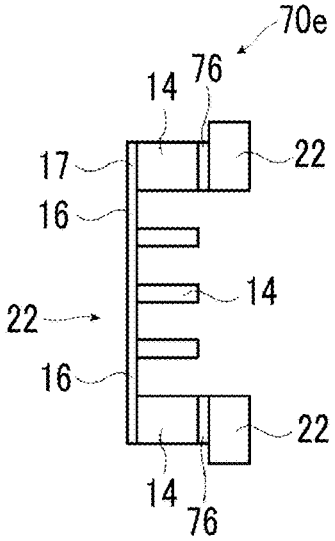
FIG. 72 is a schematic cross-sectional view showing an example of a state in which a soundproof member having the soundproof structure of the present invention is attached to the wall.
Figure 73:
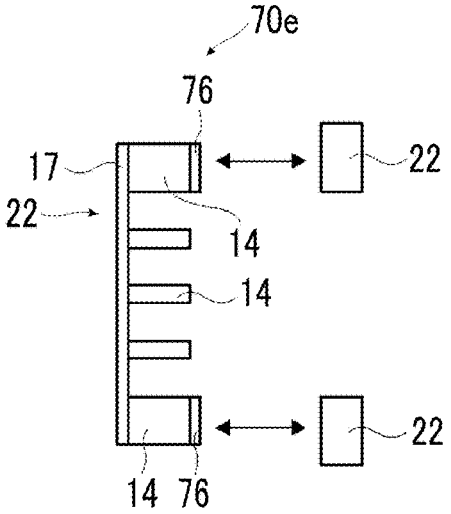
FIG. 73 is a schematic cross-sectional view of an example of a state in which the soundproof member shown in FIG. 72 is detached from the wall.

In order to allow the soundproof member having the soundproof structure of the present invention to be easily attached to a wall or the like or to be removable therefrom, a detaching mechanism formed of a magnetic material, a Magic Tape (registered trademark), a button, a suction cup, or the like is preferably attached to the soundproof member. For example, as shown in FIG. 72, a detaching mechanism 76 may be attached to the bottom surface of the frame 14 on the outer side of the frame member of a soundproof member (soundproof cell unit) 70*e*, and the detaching mechanism 76 attached to the soundproof member 70*e* may be attached to the side surface of an opening member 22 so that the soundproof member 70*e* is attached to a wall 78. As shown in FIG. 73, the detaching mechanism 76 attached to the soundproof member 70*e* may be detached from the side surface of the opening member 22 so that the soundproof member 70*e* is detached from the side surface of the opening member 22.

Figure 74:
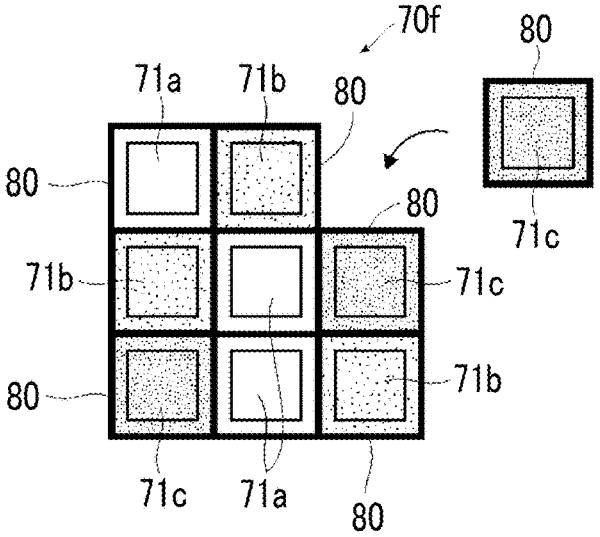
FIG. 74 is a plan view showing attachment and detachment of a unit cell in another example of the soundproof member having the soundproof structure according to the present invention.

In the case of adjusting the soundproofing characteristics of the soundproof member 70*f* by combining respective soundproof cells having different resonance frequencies, for example, by combining soundproof cells 71*a*, 71*b*, and 71*c* as shown in FIG. 74, it is preferable that a detaching mechanism 80, such as a magnetic material, a Magic Tape (registered trademark), a button, and a suction cup, is attached to each of the soundproof cells 71*a*, 71*b*, and 71*c* so that the soundproof cells 71*a*, 71*b*, and 71*c* are easily combined with each other.

Figure 75:
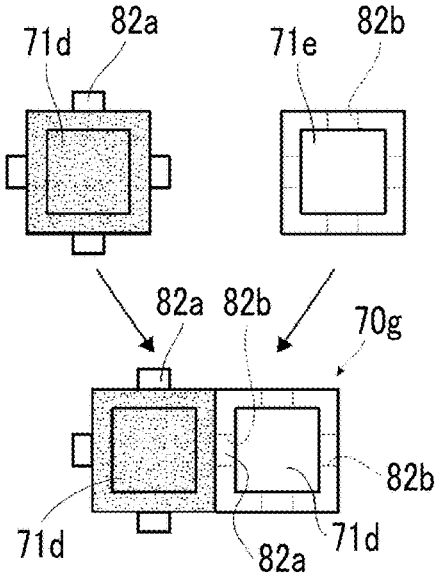
FIG. 75 is a plan view showing attachment and detachment of a unit cell in another example of the soundproof member having the soundproof structure according to the present invention.

In addition, an uneven portion may be provided in a soundproof cell. For example, as shown in FIG. 75, a protruding portion 82*a* may be provided in a soundproof cell 71*d* and a recessed portion 82*b* may be provided in a soundproof cell 71*e*, and the protruding portion 82*a* and the recessed portion 82*b* may be engaged so that the soundproof cell 71*d* and the soundproof cell 71*e* are detached from each other. As long as it is possible to combine a plurality of soundproof cells, both a protruding portion and a recessed portion may be provided in one soundproof cell.

Furthermore, the soundproof cells may be detached from each other by combining the above-described detaching mechanism 80 shown in FIG. 74 and the uneven portion, the protruding portion 82*a*, and the recessed portion 82*b* shown in FIG. 75.

[Mechanical Strength of Frame]

As the size of the soundproof member having the soundproof structure of the present invention increases, the frame easily vibrates, and a function as a fixed end with respect to film vibration is degraded. Therefore, it is preferable to increase the frame stiffness by increasing the thickness of the frame. However, increasing the thickness of the frame causes an increase in the mass of the soundproof member. This declines the advantage of the present soundproof member that is lightweight.

Figure 76:
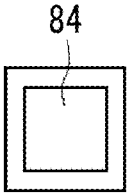
FIG. 76 is a plan view of an example of a soundproof cell of the soundproof structure of the present invention.
Figure 77:
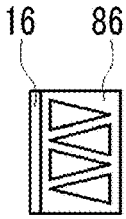
FIG. 77 is a side view of the soundproof cell shown in FIG. 76.
Figure 78:
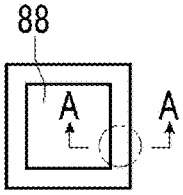
FIG. 78 is a plan view of an example of a soundproof cell of the soundproof structure of the present invention.
Figure 79:
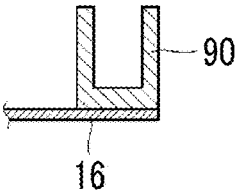
FIG. 79 is a schematic cross-sectional view of the soundproof cell shown in FIG. 78 as viewed from the arrow A-A.

Therefore, in order to reduce the increase in mass while maintaining high stiffness, it is preferable to form a hole or a groove in the frame. For example, by using a truss structure as shown in a side view of FIG. 77 for a frame 86 of a soundproof cell 84 shown in FIG. 76 or by using a Rahmem structure as shown in the A-A arrow view of FIG. 79 for a frame 90*d* of a soundproof cell 88 shown in FIG. 78, it is possible to achieve both high stiffness and light weight.

Figure 80:
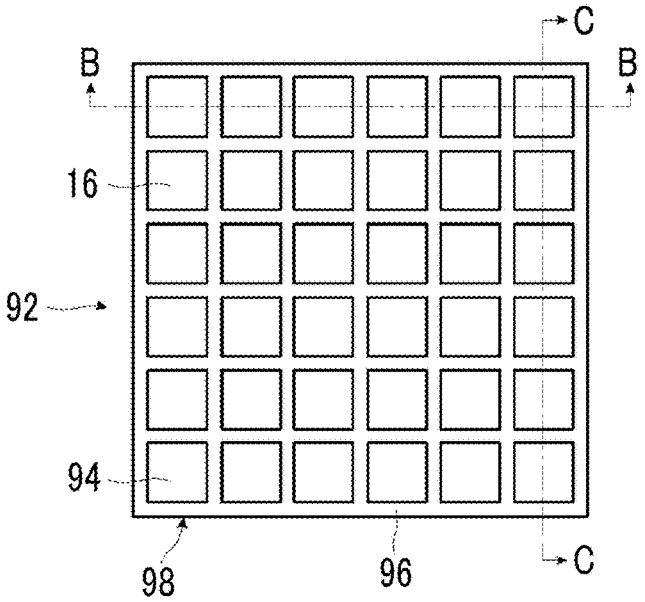
FIG. 80 is a plan view of another example of the soundproof member having the soundproof structure of the present invention.
Figure 81:
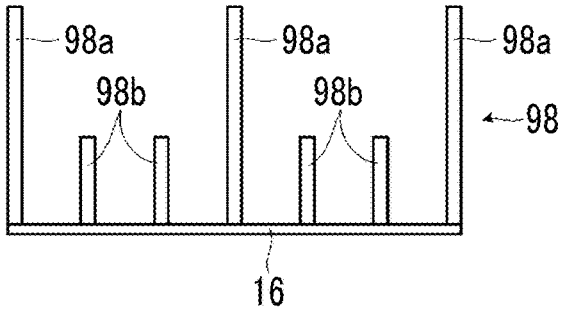
FIG. 81 is a schematic cross-sectional view of the soundproof member shown in FIG. 80 as viewed from the arrow B-B.
Figure 82:
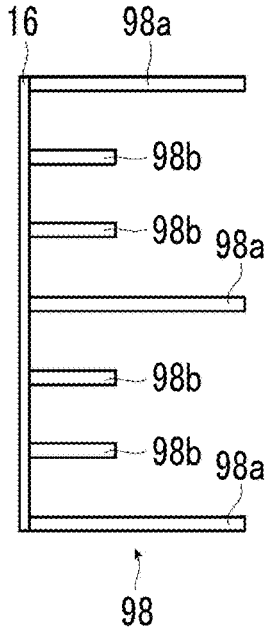
FIG. 82 is a schematic cross-sectional view of the soundproof member shown in FIG. 80 as viewed from the arrow C-C.

For example, as shown in FIGS. 80 to 82, by changing or combining the frame thickness in the plane, it is possible to secure high stiffness and to reduce the weight. As in a soundproof member 92 having the soundproof structure of the present invention shown in FIG. 80, as shown in FIG. 81 that is a schematic cross-sectional view of the soundproof member 92 shown in FIG. 80 taken along the line B-B, frame members 98*a* on both outer sides and a central frame member 98*a* of a frame body 98 configured to include a plurality of frames 96 of 36 soundproof cells 94 are made thicker than frame members 98*b* of the other portions. In the illustrated example, the frame members 98*a* on both outer sides and the central frame member 98*a* are made two times or more thicker than the frame members 98*b* of the other portions. As shown in FIG. 82 that is a schematic cross-sectional view taken along the line C-C perpendicular to the line B-B, similarly in the direction perpendicular to the line B-B, the frame members 98*a* on both outer sides and the central frame member 98*a* of the frame body 98 are made thicker than the frame members 98*b* of the other portions. In the illustrated example, the frame members 98*a* on both outer sides and the central frame member 98*a* are made two times or more thicker than the frame members 98*b* of the other portions.

In this manner, it is possible to achieve both high stiffness and light weight.

Although through-holes are not drilled in the film 16 of each soundproof cell shown in FIGS. 68 to 82 described above, the present invention is not limited thereto, and it is needless to say that the through-hole 42 may be provided as in the soundproof cell unit 20K of the example shown in FIG. 54.

The soundproof structure of the present invention can be used as the following soundproof members.

For example, as soundproof members having the soundproof structure of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site and preventing leakage of a lot of noise around the site); and a soundproof member for tunnel (soundproof member installed in a tunnel to prevent noise leaking to the inside and outside the tunnel).

While the soundproof structure of the present invention has been described in detail with reference to various embodiments and examples, the present invention is not limited to these embodiments and examples, and various improvements or modifications may be made without departing from the scope and spirit of the present invention.

EXPLANATION OF REFERENCES

10, 10A, 10B, 10C, 10D, 10E, 10F, 10G, 10H, 10I, 10J, 10K, 10L, 50, 60: soundproof structure
12: hole portion
14, 86, 90, 96: frame
15: frame member
16, 16*a*, 16*b*, 16*c*, 16*d*: film
17, 17*a*, 17*b*: sheet-shaped film body
18, 18A, 18B, 18C, 18D, 18E, 18F, 18G, 18H, 18I, 18J, 18K, 18L, 71*a*, 71*b*, 71*c*, 71*d*, 71*e*, 84, 88, 94: soundproof cell
19: disk-shaped soundproof frame member
20, 20C, 20D, 20H, 20I, 20J, 20K: soundproof cell unit
22: tubular body
22*a*, 56*a*, 64*a*: opening
22*b*: opening cross section
24: gully
25*a*, 25*b*: attachment portion
26: inclined portion
27: disk
32: microphone
34: speaker
36: box
38: wall
40: weight
42: through-hole
44: annular support frame body
46: linear support member
52: house
54: wall
56: opening member
58: soundproof louver
61: space
62: soundproof partition
64: frame body (opening cross section)
66: through opening
70*a*, 70*b*, 70*c*, 70*d*, 70*e*, 70*f*, 92: soundproof member
72: cover
73: hole
74: wind prevention frame
75: flow control mechanism
76, 80: detaching mechanism
82*a*: protruding portion
82*b*: recessed portion
98: frame body
98*a*, 98*b*: frame member

What is claimed is:

1. A soundproof structure, comprising:

at least one soundproof cell comprising a frame having a hole portion and a film fixed to the frame so as to cover the hole portion, wherein the soundproof cell is disposed in an opening member having an opening in a state in which a film surface of the film is inclined with respect to an opening cross section of the opening member and a region serving as a ventilation hole, through which the gas passes, is provided in the opening member, wherein no weight is fixed to the film of the soundproof structure.

2. The soundproof structure according to claim 1, wherein the soundproof cell is disposed within an opening end correction distance from an opening end of the opening member.

3. The soundproof structure according to claim 1,
wherein the soundproof cell has a size smaller than a wavelength of a first natural vibration frequency of the film.

4. The soundproof structure according to claim 3,
wherein the first natural vibration frequency is included within a range of 10 Hz to 100000 Hz.

5. The soundproof structure according to claim 1,
wherein the soundproof cell is disposed at a position where sound pressure formed on the opening member by sound waves of a first natural vibration frequency of the soundproof cell is high.

6. The soundproof structure according to claim 1,
wherein the soundproof cell is disposed at a position of an antinode of a sound pressure distribution of standing waves formed on the opening member by sound waves of a first natural vibration frequency of the soundproof cell.

7. The soundproof structure according to claim 1,
wherein the soundproof structure has a plurality of the soundproof cells.

8. The soundproof structure according to claim 7,
wherein the plurality of soundproof cells include two or more types of soundproof cells having different first natural vibration frequencies, and
each of the two or more types of soundproof cells having different first natural vibration frequencies is disposed at a position where sound pressure formed on the opening member by sound waves of the first natural vibration frequency corresponding to each soundproof cell is high.

9. The soundproof structure according to claim 7,
wherein the plurality of soundproof cells include two or more types of soundproof cells having different first natural vibration frequencies, and
each of the two or more types of soundproof cells having different first natural vibration frequencies is disposed at a position of an antinode of a sound pressure distribution of standing waves formed on the opening member by sound waves of the first natural vibration frequency corresponding to each soundproof cell.

10. The soundproof structure according to claim 7,
wherein the plurality of soundproof cells include two or more soundproof cells having the same first natural vibration frequency, and
the two or more soundproof cells are disposed on the same circumference of an inner peripheral wall of the opening member.

11. The soundproof structure according to claim 10,
wherein the plurality of soundproof cells further include one or more types of soundproof cells having the first natural vibration frequency different from the same first natural vibration frequency of the two or more soundproof cells, and
the one or more types of soundproof cells having the different first natural vibration frequency are disposed in series with one of the two or more soundproof cells having the same first natural vibration frequency in a central axis direction of the opening member.

12. The soundproof structure according to claim 7,
wherein the plurality of soundproof cells include two or more soundproof cells having the same first natural vibration frequency, and
the two or more soundproof cells are disposed in series in a central axis direction of the opening member.

13. The soundproof structure according to claim 12,
wherein the plurality of soundproof cells further include one or more types of soundproof cells having the first natural vibration frequency different from the same first natural vibration frequency of the two or more soundproof cells, and
the one or more types of soundproof cells having the different first natural vibration frequency are disposed in series in the central axis direction of the opening member.

14. The soundproof structure according to claim 1,
wherein the hole portion is open, and the film is fixed to both end surfaces of the hole portion.

15. The soundproof structure according to claim 1,
wherein the hole portion is open, and the film is fixed to both end surfaces of the hole portion, and
first natural vibration frequencies of the films on both the surfaces are different.

16. The soundproof structure according to claim 1, further comprising:
a through-hole communicating with rear surface spaces of the films of the soundproof cells adjacent to each other.

17. The soundproof structure according to claim 1,
wherein the film has a through-hole.

18. The soundproof structure according to claim 1, further comprising:
a sound absorbing material disposed in the hole portion of the frame.

19. The soundproof structure according to claim 1, further comprising:
a mechanism for adjusting an inclination angle of the film surface of the soundproof cell with respect to the opening cross section.

20. The soundproof structure according to claim 1,
wherein the soundproof cell is a member that is removable from the opening member.

21. The soundproof structure according to claim 1,
wherein the opening member is a cylindrical body, and the soundproof cell is disposed inside the cylindrical body.

22. A louver comprising the soundproof structure according to claim 1.

23. A soundproof wall comprising the soundproof structure according to claim 1.

* * * * *